US005290676A

United States Patent [19]

Nagaoka et al.

[11] Patent Number: 5,290,676

[45] Date of Patent: Mar. 1, 1994

[54] SILVER HALIDE PHOTOGRAPHIC LIGHT-SENSITIVE MATERIAL

[75] Inventors: Katsurou Nagaoka; Akihiko Ikegawa; Masayuki Kuramitsu, all of Minami-ashigara, Japan

[73] Assignee: Fuji Photo Film Co., Ltd., Kanagawa, Japan

[21] Appl. No.: 944,314

[22] Filed: Sep. 14, 1992

[30] Foreign Application Priority Data

| | | | |
|---|---|---|---|
| Sep. 24, 1991 | [JP] | Japan | 3-243128 |
| Oct. 30, 1991 | [JP] | Japan | 3-310220 |
| Oct. 31, 1991 | [JP] | Japan | 3-311382 |
| Nov. 6, 1991 | [JP] | Japan | 3-318507 |

[51] Int. Cl.[5] ..... G03C 1/14

[52] U.S. Cl. ..... 430/583; 430/584; 430/586; 430/588; 430/567

[58] Field of Search ..... 430/583, 584, 586, 588, 430/567

[56] References Cited

U.S. PATENT DOCUMENTS

| | | | |
|---|---|---|---|
| 3,264,110 | 8/1966 | Depoorter et al. | 430/583 |
| 3,282,933 | 11/1966 | Nys et al. | 430/588 |
| 3,615,634 | 10/1971 | Gotze et al. | 430/588 |
| 3,979,213 | 9/1976 | Gilman, Jr. et al. | 430/567 |
| 4,118,228 | 10/1978 | Corluy et al. | 430/588 |
| 4,425,426 | 1/1984 | Abbott et al. | 430/567 |
| 4,434,226 | 2/1984 | Wilgus et al. | 430/567 |
| 4,623,612 | 11/1986 | Nishikawa et al. | 430/569 |

FOREIGN PATENT DOCUMENTS

| | | |
|---|---|---|
| 0278510 | 8/1988 | European Pat. Off. . |
| 0344680 | 12/1989 | European Pat. Off. . |
| 1223289 | 6/1960 | France . |

*Primary Examiner*—Janet C. Baxter

*Attorney, Agent, or Firm*—Birch, Stewart, Kolasch & Birch

[57] ABSTRACT

Disclosed herein is a silver halide photographic light-sensitive material having at least one silver halide emulsion layer formed on a support. Said light-sensitive material having at least one layer contains a regular silver halide emulsion, a tabular silver halide emulsion containing tabular silver halide grains having an average diameter/average thickness ratio of 2 or more, which occupy 50% or more of the total projected area of all silver halide grains, and a silver halide emulsion containing internal latent-image silver halide grains each chemically sensitized to the depth of less than 0.02 μm from the surface of the grain. Each of these emulsions contains at least one methine compound represented by the following formula (I):

Formula (I)

where $R^1$ is $-(CH_2)_r-CONHSO_2-R_3$ or $-(CH_2)_s-SO_2NHCO-R_4$, where $R^3$ and $R^4$ are an alkyl group, r and s are an integer ranging from 1 to 5; $R^2$ is a sulfoalkyl group; $Z^1$ and $Z^2$ are non-metal atom groups required for forming a 5- or 6-membered heterocyclic group; p and q are 0 or 1; $L_1$, $L_2$ and $L_3$ are methine groups; and m is 0, 1 or 2, wherein said at least one methine compound has been added at 50° C. or more in any step from a step of preparing of the emultion to a step of coating of the emulsion.

5 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material which excels in sensitivity/graininess ratio and storage stability, which has less color-remaining after having been developed, and which contains methine compounds.

2. Description of the Related Art

In recent years, it has been increasingly demanded that photographic light-sensitive materials provide higher-quality images and have high sensitivity.

To meet the demand, various attempts have been made to increase the sensitivity/graininess ratio of a silver halide emulsion.

(1) JP-B-47-11386, for example, discloses a silver halide photographic light-sensitive material of which the graininess has been improved by the use of mono-dispersed grains. ("JP-B" means Published Examined Japanese Patent Application.)

To increase sensitivity or the like, a sensitizing dye should be absorbed in as great an amount as possible. In the spectral sensitization of a mono-dispersed regular silver halide emulsion, a sensitizing dye, even if suitable for enhancing sensitivity, fails to be dissolved completely out of the silver halide light-sensitive material if added in an increased amount. This results in the problem known as "color-remaining" i.e., coloring of the silver halide photographic light-sensitive material due to the sensitizing dye remaining in the material. Hence, in many cases, a sensitizing dye cannot be added in an amount great enough to make the material exhibit satisfactory properties.

JP-A-64-77047 (corresponding to DE 3819241A), for example, discloses the technique of adding a large amount of a sensitizing dye, thus controlling chemical sensitization, thereby to increase sensitivity. ("JP-A" means Published Unexamined Japanese Patent Application.) Like the technique described above, this technique causes color-remaining, and can hardly be applied to regular silver halide emulsions.

(2) Also, in recent years, many techniques have been disclosed which relate to methods of manufacturing and using tabular silver halide grains. This is because tabular silver halide grains are advantageous in that they may promote color sensitization, improve sensitivity and graininess, and increase sharpness. Among the publications disclosing these techniques are: U.S. Pat. Nos. 4,434,226, 4,439,520, 4,414,310, 4,433,048, 4,414,306, and 4,459,353.

In particular, tabular silver halide grains can have a large amount of a sensitizing dye absorbed to them since each grain has a great surface/grain size ratio (i.e., surface ratio). Hence, they can absorb a great amount of light, possibly increasing sensitivity. If the sensitizing dye is added in a large amount, however, it fails to be dissolved completely out of the silver halide light-sensitive material if added in an increased amount. This results in color-remaining, i.e., coloring of the light-sensitive material due to the sensitizing dye remaining in the material. In consequence, the sensitizing dye cannot be added in a sufficient amount, though it can be absorbed to the tabular silver halide grains.

(3) Further, a number of attempts have been made to enhance the sensitivity of a photographic light-sensitive material, without increasing the grain size of silver halide photographic emulsion. One of them is concerned with a light-sensitive material using an internal latent-image emulsion containing grains internally chemical-sensitized so that an latent image may be formed within each grain as the material is exposed to light. For example, U.S. Pat. Nos. 2,696,436, 3,206,313, 3,917,485, 3,979,213 and 4,623,612, JP-B-43-29405, JP-B-45-13259 describe silver halide photographic emulsions or silver halide photographic light-sensitive materials, which have good photographic properties. These emulsions and these materials have high internal sensitivities since they have been prepared by immersing samples, coated with silver halide emulsions, in an $AgNO_3$ solution or a silver-halide solvent, or by performing Ostwald ripening or adding an $AgNO_3$ aqueous solution and a soluble halogen-salt aqueous solution after the chemical sensitization carried out during the preparation of the silver halide emulsions. Although most of these emulsions and materials exhibit high photographic sensitivities if developed with specific internal development solutions, they cannot exhibit sufficient photographic sensitivities if developed with ordinary developing solutions which does not contain, on design, a large amount of a silver halide solvent such as KI or sodium thiosulfate.

Furthermore, U.S. Pat. No. 3,966,476 discloses a silver halide emulsion which forms latent images in the voids opening to the surface of the grain, and can be developed by a surface developer. This emulsion, however, cannot be considered an internal latent-image emulsion; it cannot have excellent photographic properties inherent in an internal latent-image emulsion.

U.S. Pat. Nos. 4,839,268 and JP-A-63-264740 disclose techniques relating to an internal latent-image emulsion which can exhibit a high sensitivity if developed with any of various developing solutions, and also relating to a photographic light-sensitive material using this specific emulsion. In these publications it is described that, if an emulsion is to exhibit a sufficient sensitivity when developed with an ordinary photographic developing solution, two conditions must be satisfied. First, the latent image formed due to exposure must be positioned within a specific distance from the surface of each grain and be formed. Second, a latent image must be formed, to some extent, also on the surface of each grain.

It is known that these internal latent-image emulsions can acquire an optimal minus blue-sensitivity when a relatively great amount of a sensitizing dye is added to it, since its blue sensitivity decreases due to the adsorption of the sensitizing dye, but less than that of a surface latent-image emulsion. When a large amount of a sensitizing dye is added to the internal latent-image emulsion, the sensitizing dye fails to be dissolved completely out of the light-sensitive material, consequently, color-remaining will occur, that is, the light-sensitive material will be colored with the residual sensitizing dye. The greater the amount of the sensitizing dye added, the more prominent the color-stain is. In consequence, the sensitizing dye cannot be added in a sufficient amount, though the addition of a large amount of the sensitizing dye can provide a high sensitivity.

(4) Further, for the purpose of increasing sensitivity, it is desirable that a sensitizing dye be adsorbed in as great an amount as is possible for more intensifying of its adsorption. As is known, the higher the temperature, the more readily a sensitizing dye can be adsorbed to silver halide grains. Some methods have been disclosed, in which a sensitizing dye is added during chemical ripening or during the forming of grains, so that the adsorption of the sensitizing dye is intensified. More specifically, U.S. Pat. No. 4,425,426 disclose methods wherein a sensitizing dye is added before the chemical sensitization or during the chemical sensitization, and U.S. Pat. Nos. 4,225,666, JP-A-61-103149, JP-A-61-133941, and JP-A-61-165751, for example, disclose methods wherein a sensitizing dye is added during the growth of grains, achieving intensified adsorption of the sensitizing dye.

The inventors hereof have been studying the above-described techniques in their effort to enhance the sensitivity/graininess ratio of a silver halide emulsion. They could not, however, achieve their objective since color-remaining occurs by the sensitizing dye which remains in the light-sensitive material after the processing of development because of the intensified adsorption of the sensitizing dye. To solve this problem, it has been proposed that use be made of a sensitizing dye which has hydrophilic substituent groups such as a sulfamoyl group and a carbamoyl group, e.g., the sensitizing dyes disclosed in JP-A-1-147451, JP-A-61-294429, JP-B-45-32749, and JP-A-61-77843. Generally, however, a sensitizing dye will be less readily adsorbed if rendered more hydrophilic. Hence, if the sensitizing dye is made more hydrophilic and thus less liable to remain in the light-sensitive material, it will desorbed from the grains while the light-sensitive material is stored at high temperature and high humidity, inevitably causing desensitization of the sensitizing dye. Although the sensitizing dye disclosed in U.S. Pat. No. 3,282,933 is less liable to cause color-stain, its spectral sensitization power is small, and cannot be achieve both effective spectral sensitization and sufficient control of color-remaining.

SUMMARY OF THE INVENTION

Accordingly, the object of this invention is to provide a silver halide photographic light-sensitive material which excels in sensitivity/graininess ratio and storage stability and which has less color-remaining after having been developed.

After having conducted various studies, aiming at solving the problem pointed out above, the present inventors have found the object can be attained by the photographic light-sensitive materials (1) to (5) described below:

(1) A silver halide photographic light-sensitive material having at least one silver halide emulsion layer formed on a support, said light-sensitive material having at least one layer which contains a regular silver halide emulsion spectrally sensitized with a methine compound represented by the following formula (I) which will be presented later.

(2) The silver halide photographic light-sensitive material as described in the paragraph (1), which is characterized in that the size of grains contained in the regular silver halide emulsion has a relative standard deviation of 20% or less.

(3) A silver halide photographic light-sensitive material having at least one silver halide emulsion layer formed on a support, said light-sensitive material having at least one layer which contains a tabular silver halide emulsion containing tabular silver halide grains having an average diameter/average thickness ratio of 2 or more, which occupy 50% or more of the total projected area of all silver halide grains, and said emulsion containing at least one methine compound represented by the following formula (I) which will be presented later.

(4) A silver halide photographic light-sensitive material having at least one silver halide emulsion layer formed on a support, said light-sensitive material having, at least one layer which contains a silver halide emulsion containing internal latent-image silver halide grains each chemically sensitized to the depth of less than 0.02 μm from the surface of the grain, and having been spectrally sensitized with at lease one methine compound represented by the following formula (I) which will be presented later.

(5) A silver halide photographic light-sensitive material having at least one silver halide emulsion layer formed on a support, said light sensitive material having at least one layer which contains a silver halide emulsion spectrally sensitized with at least one methine compound represented by the formula (I) which will be presented later, said at least one methine compound having been added at 50° C. or more in any step from a step of preparing of the emulsion to a step of coating of the emulsion.

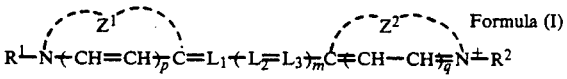

In the formula (I), $R^1$ is $—(CH_2)_r—CONHSO_2—R_3$ or $—(CH_2)_s—SO_2NHCO—R_4$, where $R^3$ and $R^4$ are an alkyl group, r and s are an integer ranging from 1 to 5. $R^2$ is a sulfoalkyl group. $Z^1$ and $Z^2$ are non-metal atom groups required for forming a 5- or 6-membered heterocyclic group. p and q are 0 or 1, and $L_1$, $L_2$, and $L_3$ are methine groups, and m is 0, 1 or 2.

Having the structure specified above, any silver halide photographic light-sensitive material according to the present invention has but very little color-remaining. In addition, any material of the present invention was found to exhibit sensitivity higher than the inventors had expected.

DETAILED DESCRIPTION OF THE PREFERRED EMBODIMENTS

The present invention will now be described in detail.

First, the methine compound generally represented by the formula (I) will be described in detail.

The alkyl group represented by $R^3$ or $R^4$ in the formula may be substituted; it is preferably one having 4 or less carbon atoms, more preferably methyl or ethyl. The sulfoalkyl group represented by $R^2$ may be substituted; it is preferably one having 5 or less carbon atoms, more preferably 2 sulfoethyl, 3-sulfopropyl, 4-sulfobutyl, or 3-sulfobutyl. Preferable as r or s is 1, 2, or 3. Preferable as the nuclei of 5- or 6-membered heterocyclic groups, which are represented by $Z^1$ and $Z^2$, are as follows:

Thiazole nucleus (e.g., thiazole, 4-methylthiazole, 4-phenylthiazole, 4,5-dimethylthiazole, or 4,5-diphenylthiazole), benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenetylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydroxybenzothiazole, or 4-phenylbenzothiazole), naphthothiazole nucleus (e.g., naphtho(2,1-d)thiazole, naphtho(1,2-d)thiazole, naphtho(2,3-d)thiazole, 5-methoxynaphtho(1,2-d)thiazole, 7-ethoxynaphtho(2,1-d)thiazole, 8-methoxynaphtho(2,1-d)thiazole, 5-mehoxynaphtho(2,3-d)thiazole), thiazoline nucleus (e.g., thiazoline, 4-methylthiazoline, or 4-nitrothiazoline), oxazole nucleus {oxazole nucleus (e.g., oxazole, 4-methyloxazole, 4-nitroxazole, 5-methyloxazole, 4-phenyloxazole, 4,5-diphenyloxazole, or 4-ethyloxazole), benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydoxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, or 5-ethoxybenzoxazole), naphthoxazole nucleus (e.g., naphtho(2,1-d)oxazole, naphtho(1,2-d)oxazole, naphtho(2,3-d)oxazole, or 5-nitronaphtho(2,1-d)oxazole)}, oxazoline nucleus (e.g., 4,4-dimethyloxazoline), selenazole nucleus {selenazole nucleus (e.g., 4-methylselenazole, 4-nitroselenazole, or 4-phenylselenazole), benzoselenazole nucleus (e.g., benzoselenazole, 5-chlorobenzoselenazole, 5-nitrobenzoselenazole, 5-methoxybenzoselenazole, 5-hydroxybenzoselenazole, 5-nitrobenzoselenazole, 5-chloro-6-nitrobenzoselenazole, or 5,6-dimethylenzoselenazole), naphthoselenazole nucleus (e.g., naphtho(2,1-d)selenazole or naphtho(1,2-d)selenazole)}, selenazoline nucleus (e.g., selenazoline or 4-methylselenazoline), tellurazole nucleus {tellurazole nucleus (e.g., tellurazole, 4-methyltellurazole, or 4-phenyltellurazole), benzotellurazole nucleus (e.g., benzotellurazole, 5-chlorotellurazole, 5-methylbenzotellurazole, 5,6-dimethylbenzotellurazole, or 6-methoxybenzotellurazole), napthotellurazole nucleus (e.g., naphtho(2,1-d)tellurazole or naphtho (1,2-d) tellurazole)}, tellurazoline nucleus (e.g., tellurazoline or 4-methyltellurazoline), 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, or 3,3-dimethyl-5-chloroindolenine), imidazole nucleus {imidazole nucleus (e.g., 1-alkylimidazole, 1-alkyl-4-phenylimidazole, or 1-arylimidazole), benzoimidazole nuleus (e.g., 1-alkylbenzoimidazole, 1-alkyl-5-chlorobenzoimidazole, 1-alkyl-5,6-dichlorobenzoimidazole, 1-aklyl-5-methoxybenzoimidazole, 1-alkyl-5-cyanobenzoimidazle, 1-alkyl-5-fluorebonzoimidazole, 1-alkyl-5-trifluoromethylbenzoimidazole, 1-alkyl-6-chloro-5-cyanobenzoimidazole, 1-alkyl-6-chloro-5-trifluoromethylbenzoimidazole, 1-aryl-5,6-dichlorobenzoimidazole, 1-aryl-5-chlorobenzoimidazole, 1-arylbenzoimidazole, 1-aryl-5-chlorobenzoimidazole, 1-aryl-5,6-dichlorobenzoimidazole, 1-aryl-5-methoxybenzoimidazole, or 1-aryl-5-cyanobenzoimidazole), naphthoimidazole nucleus (e.g., alkylnaphtho(1,2-d)imidazole or 1-arylnaphtho(1,2-d)imidazole)}, or pyridine nucleus (e.g., 2-pyridine, 4-pyridine, 5-methyl-2-pyridine, 3-methyl-4-pyridine), quinoline nucleus {quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-metyl-4-quinoline, 8-methoxy-4-quinoline, 6-methyl-4-quinoline, 6-methoxy-4-quinoline, or 6-chloro-4-quinoline), isoquinoline nucleus (e.g., 6-nitro-isoquinoline, 3,4-dihydro-1-isoquinoline, or 6-nitro-3-isoquinoline)}, imidazo(4,5-b)quinoxaline nucleus (e.g., 1,3-diethylimidazo(4,5-b)quinoxaline or 6-chloro-1,3-diarylimidazo(4,5-b)quinoxaline), oxadiazole nucleus, thiadiazole nucleus, tetrazole nucleus, and pyrimidine nucleus.

The alkyl group, described above, is preferably one having 1 to 8 carbon atoms, such as a nonsubstituted alkyl group (e.g., methyl, ethyl, propyl, isopropyl or butyl), or a hydroxyalkyl group (e.g., 2-hydroxyethyl or 3-hydroxypropyl). Of these alkyl groups, more preferable are methyl and ethyl.

The aryl group, described above, is phenyl, halogen-(e.g., chloro)-substituted phenyl, alkyl(e.g., methyl)-substituted phenyl, or alkoxy(e.g., methoxy)-substituted phenyl.

Of the heterocyclic nuclei specified above, preferable are thiazole nucleus, benzothiazole nucleus, naphthothiazole nucleus, oxazole nucleus, benzoxazole nucleus, naphthoxazole nucleus, benzoimidazole nucleus, naphthoimidazole nucleus, and quinoline nucleus, and the most preferable are benzothiazole nucleus, benzoselenazole nucleus, or quinoline nucleus.

The methine groups represented by $L^1$, $L^2$, and $L^3$ may be substituted; the substituent group is, for example, a substitutable alkyl group (e.g., methyl, ethyl, or 2-carboxyethyl), a substitutable aryl group (e.g., phenyl or o-carboxyphenyl), a halogen atom (e.g., chlorine atom or bromine atom), an alkoxy group (e.g., methoxy or ethoxy), or an alkylthio group (e.g., methylthio or ethylthio). The methine group may bond to another methine group or to a auxochrome group, to form a ring.

It is desirable that m be 0 or 1.

Typical examples of the methine compound represented by the formula (I) are as set forth below. Nonetheless, the methine compound used in the present invention is not limited to these.

I-1

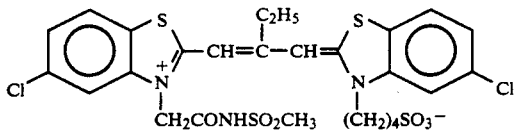

I-2

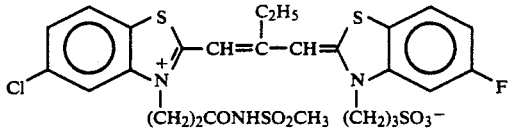

I-3

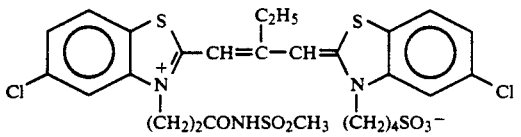

-continued
I-4
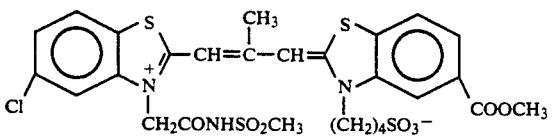
I-5
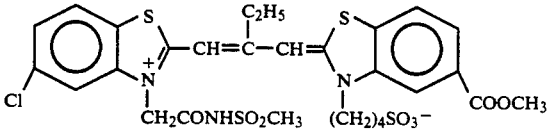
I-6
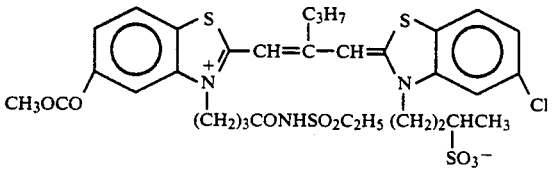
I-7
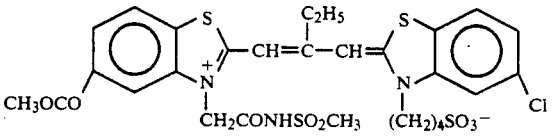
I-8
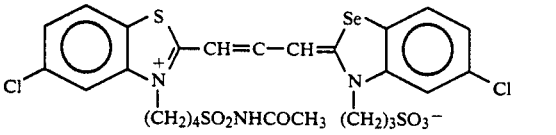
I-9
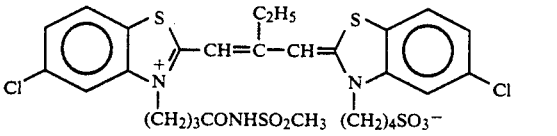
I-10
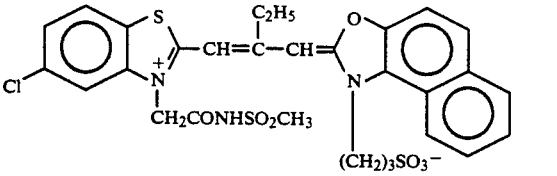
I-11
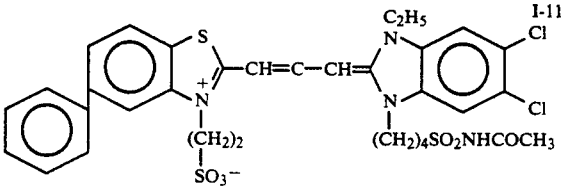
-continued
I-12
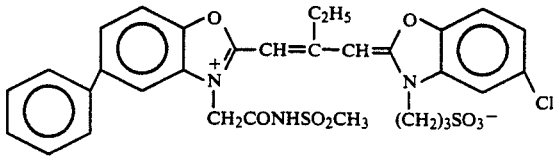
I-13
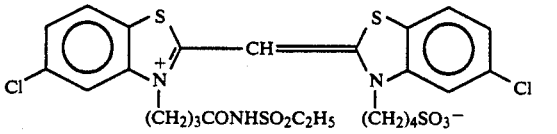
I-14
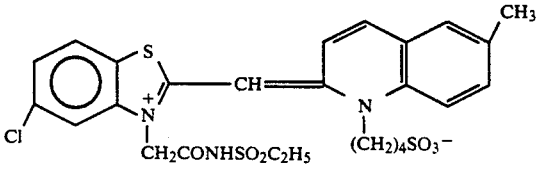
I-15
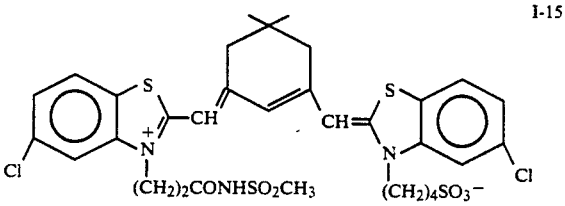
I-16
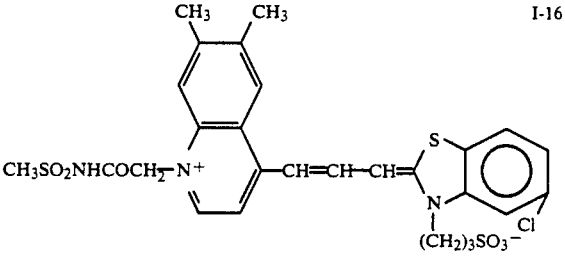
I-17
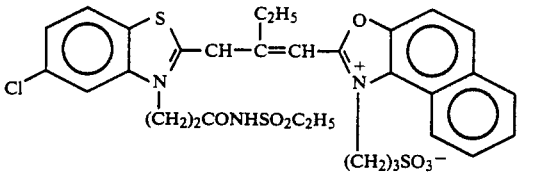
I-18
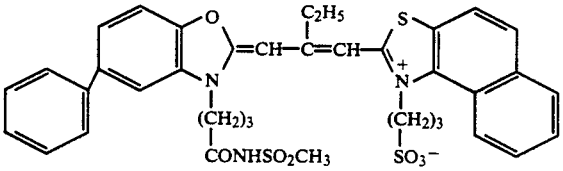
I-19
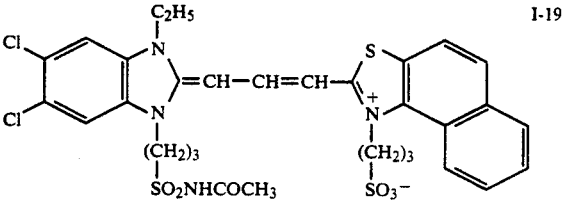

-continued
I-20
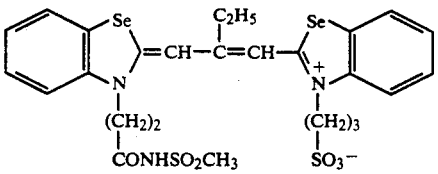
I-21
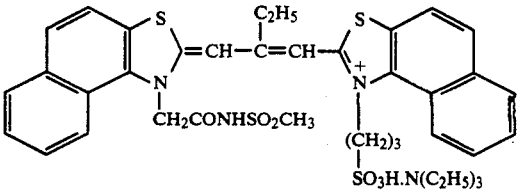
I-22
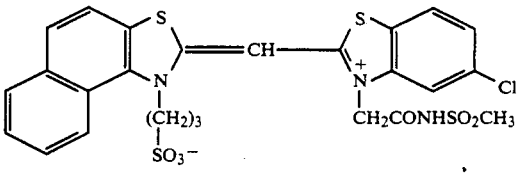
I-23
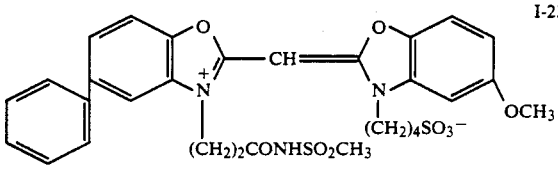
I-24
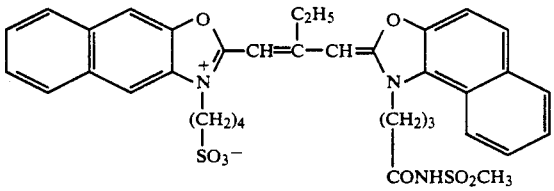
I-25
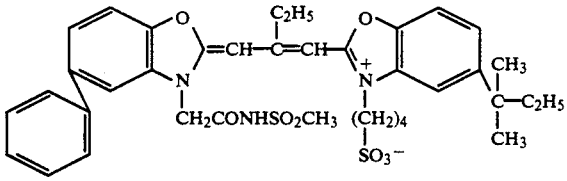
I-26
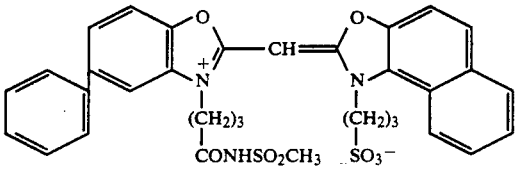
-continued
I-27
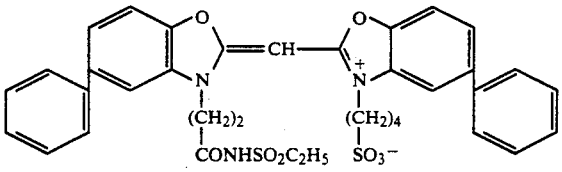
I-28
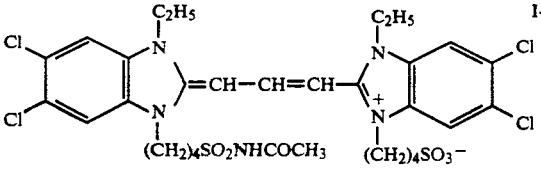
I-29
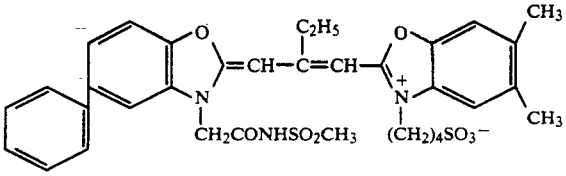
I-30
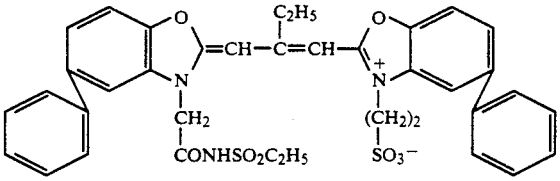
I-31
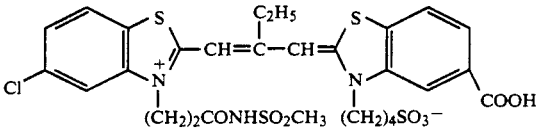
I-32
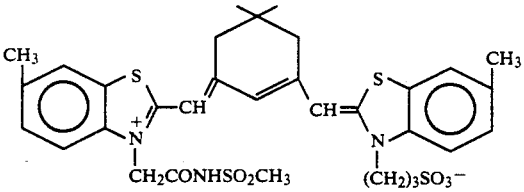
I-33
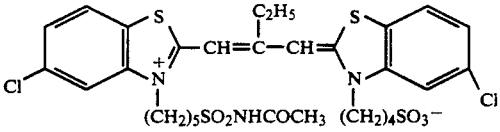
I-34
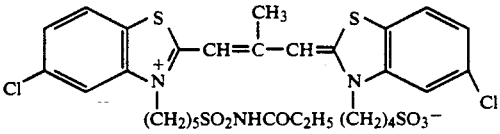
Synthesis of a few of the methine compounds represented by the formula (I) will be described below.

SYNTHESIS 1

(1) Synthesis of 5-chloro-3-methanesulfonylaminocarbonylmethyl-2-methylbenzothiazolium bromide 50 g of N-(bromoacetyl)methanesulfonamide which was prepared by the method disclosed in U.S. Pat. No. 3,282,933, 36.6 g of 5-chloro-2-methylbenzothiazole, and 4 milliliters of methylethylketone were stirred together for 5 hours on an oil bath heated to 105° C. After the reaction, 200 milliliters of acetone was added. The resultant mixture was refluxed for 1 hour, and then was cooled with water. One hour later, crystals were suction-filtered, washed with 100 milliliters of acetone, and dried. As a result, 59.6 g (75.7%) of 5-chloro-3-methanesulfonylaminocarbonylmethyl-2methylbenzothiazolium bromide.

(2) Synthesis of illustrated Compound I-1

First, 477 milliliters of methanol was added to 38.06 g of 5-chloro-3-methanesulfonylaminocarbonylmethyl-2-methylbenzothiazolium bromide and 40.46 g of 4-{5-chloro-2-(ethoxy-1-butenyl)-3-benzothiazolio}-butanesulfonate. These components were stirred, thus forming a solution. To this solution, 40.1 milliliters of triethylamine was dropped at room temperature, and then the solution was stirred for 1 hour. After the reaction, the resultant mixture was stirred with 82 milliliters of acetic acid for 20 minutes and cooled with water. One hour later, crystals were suction-filtered, washed with 150 milliliters of methanol, and dried. As a result, 48.7 g of the illustrated compound I-1 was obtained in the form of coarse crystals.

The coarse crystals, thus obtained, were dissolved in 600 milliliters of methanol and 30 milliliters of triethylamine. The insoluble matter was separated by means of suction filtration and washed with 300 milliliters of methanol. The filtrate was condensed undernormal pressure, and 400 milliliters of the filtrate, thus condensed, was distilled out. Acetic acid was added in an amount of 40 milliliters to the residual solution at 55° C. The resultant solution was stirred for 20 minutes and then was cooled with water. One hour later, crystals were suction-filtered, washed with 250 milliliters of methanol, and dried. As a result, 36.2 g (56.1%) of the illustrated compound I-1 was obtained. The physical properties of this compound were as follows:

λmax(MeOH) 554 nm($\epsilon 1.14\times10^5$).

Melting point >300° C.

Synthesis 2

(1) Synthesis of 5-chloro-3-methanesulfonylaminocarbonylmethyl-2-methylbenzothiazolium bromide 46 g of N-(β-bromopropionyl)methanesulfonamide which was prepared by the method disclosed in U.S. Pat. No. 3,282,933 and 20 g of 5-chloro-2-methylbenzothiazole were stirred together for 60 hours on an oil bath heated to 115° C. After the reaction, 200 milliliters of ethyl acetate was poured into the reaction product. Thereafter, crystals were filtered, thereby obtaining 40.8 g (82%) of 5-chloro-3-methanesulfonylaminocarbonylmethyl-2-methylbenzothiazolium bromide.

(2) Synthesis of illustrated Compound I-3

First, 2.1 g of 5-chloro-3-methanesulfonylaminocarbonylmethyl-2-methylbenzothiazolium bromide and 2.4 g of 4-{5-chloro-2-(ethoxy-1-butenyl)-3-benzothiazolio}butanesulfonate were dissolved in 20 milliliters of benzyl alcohol, preparing a solution. To this solution, 2 milliliters of triethylamine was added at room temperature. The resultant mixture was stirred for 1 hour. The insoluble matter was filtered out of the reacted solution, and 100 milliliters of ethyl acetate and 10 milliliters of glacial acetic acid were added to the solution. The resultant solution was stirred for 10 minutes, thereby obtaining crystals. The crystals were dissolved in methanol triethylamine. Then, the insoluble matter was filtered out of the solution. Next, 10 milliliters of glacial acetic acid was added to the filtrate, and a third of ethanol was distilled out under normal pressure. The solution was cooled with water, obtaining crystals. The crystals were separated from the solution by means of filtration. As a result, 0.6 g (17.4%) of illustrated compound I-3 was obtained. The physical properties of this compound were as follows:

λmax(MeOH) 553 nm($\epsilon 1.33\times10^5$).

Melting point >300° C.

Other methine compounds I-2 and I-4 to I-12 of the present invention were synthesized. The physical properties of these compounds were as follows:

| Illustrated compound | λ (MeOH) | Melting Point |
|---|---|---|
| I-2 | 550 ($1.20\times10^5$) | >300° C. |
| I-4 | 551 ($1.21\times10^5$) | >300° C. |
| I-5 | 551 ($1.13\times10^5$) | >300° C. |
| I-6 | 551 ($1.30\times10^5$) | >300° C. |
| I-7 | 551 ($1.19\times10^5$) | >300° C. |
| I-8 | 560 ($1.22\times10^5$) | >300° C. |
| I-9 | 552 ($1.30\times10^5$) | >300° C. |
| I-10 | 538 ($4.51\times10^5$) | >300° C. |
| I-11 | 503 ($1.37\times10^5$) | >300° C. |
| I-12 | 500 ($1.42\times10^5$) | >300° C. |

In the present invention, the methine compound represented by the formula (I) may be used in combination of at least one of the compounds which are generally represented by the following formula (II). The use of the methine compound in combination with at least one of the compounds of the formula (II) serves to increase the inter-image effect of a silver halide color photographic light-sensitive material and to make the material more easy to desilver.

$$A\text{-}(L)_n\text{-}(G)_m\text{-}(Time)_t\text{-}X \qquad \text{Formula (II)}$$

In the formula (II), A is a redox mother nucleus or a precursor thereof, and an atom group which enables —(Time)$_t$—X to leave when the compound is oxidized during the processing of development. "Time" is a group which will release X after it has been released from the oxidized form of A, X is a development inhibitor, L is a divalent linking group, and G is an acidic group. In the formula (II), n, m and t are 0 or 1 each.

The compounds represented by the formula (II) will be described below in greater detail.

The redox mother nucleus represented by A in the formula (II) is one which accords to the Kendall-Pelz law. Examples of this nucleus are: hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, gallate, gallic amide, hydrazine, hydroxylamine, pyrazolidone, or reductone.

It is desirable that the amino group which these redox mother nuclei have be substituted with a sulfonyl group having 1 to 25 carbon atoms or an acyl group having 1 to 25 carbon atoms. Examples of the sulfonyl group are substituted or unsubstituted aliphatic sulfonyl group and an aromatic sulfonyl group. The hydroxy or amino group which forms the redox mother nucleus represented by A may be protected by a protective group which enables to deprotect at the time of development. Examples of the protective group are those having 1 to 25 carbon atoms each, such as acyl group, alkoxycarbonyl group, carbamoyl group, and the protective groups disclosed in JP-A-59-197037 and JP-A-59-201057. The protective group may bond to the substituent group for A, if possible, will be described below, to form a 5-, 6-, or 7-membered ring.

The redox mother nucleus represented by A, in its substitutable position, may be substituted with a substituent group. Examples of this substituent group are those having 25 or less carbon atoms, such as alkyl group, aryl group, alkylthio group, arylthio group, alkoxy group, aryloxy group, amino group, amido group, sulfonamido group, alkoxycarbonylamino group, ureido group, carbamoyl group, alkoxycarbonyl group, sulfamoyl group, sulfonyl group, cyano group, a halogen atom, acyl group, carboxyl group, sulfo group, nitro group, heterocyclic residue, and $-(L)_m-(G)_m-(Time)_t-X$. These substituent groups may, in turn, be substituted with the substituent groups described above. These substituent groups may bond together, if possible, forming a saturated or unsaturated carbon ring or a saturated or unsaturated heterocyclic ring.

Preferable examples of A are: hydroquinone, catechol, p-aminophenol, o-aminophenol, 1,4-naphthalenediol, 1,4-aminonaphthol, gallate, gallic amide, and hydrazine. Of these, hydroquinone, catechol, p-aminophenol, o-aminophenol, and hydrazine are particularly preferable. Hydroquinone and hydrazine are more preferable than any other redox mother nucleus exemplified here.

L in the formula (II) is a divalent linking group. Preferable as this group are: alkylene, alkenylene, arylene, oxyalkylene, oxyarylene, aminoalkyleneoxy, aminoalkenyleneoxy, aminoaryleneoxy, and an oxygen atom.

G in the formula (II) is an acidic group. It is preferably —CO—, —COCO—, —CS—, —SO—, $SO_2$—, $-PO(OR^{11})-$, or $-C(=NR^{12})-$. Here, $R^{11}$ is is alkyl, aryl, or heterocyclic ring, and $R^{12}$ is a hydrogen atom or of the same meaning as $R^{11}$. Of the examples of G, —CO—, —COCO—, $-PO(OR^{11})-$ and $-C(-NR^{12})-$ particularly preferable. Of these four examples, —CO— and —COCO— are preferable. The most preferable is —CO—.

In the formula (II), n and m are 0 or 1. Whether n and m should better be 0 or 1 depends on the type of A. Preferably, n=0, more preferably n=m=0 if A is hydroquinone, catechol, aminophenol, naphthalenediol, aminonaphthol, or an gallic acid. Preferably, n=0, m=1 if A is hydrazine or hydroxylamine. Preferably, n=m=1 if A is pyrazolidone.

In the formula (II), $-(Time)_t-X$ is a group which will be released, in the form of $-(Time)_t-X$, when the redox mother nucleus undergoes cross oxidation and changes into an oxidized form during the processing of development.

It is desirable that "Time" links to G through a sulfur atom, a nitrogen atom, an oxygen atom, or a selenium atom.

"Time" may be a group which enables to release X after it has been released, and may have timing-adjusting function. Alternatively, it may be a coupler or a redox group which react with the oxidized form of a developing agent, thereby to release X.

Examples of "Time" which has timing-adjusting function are disclosed in, for example, U.S. Pat. Nos. 4,248,962, 4,409,323, British Patent 2,096,783, U.S Pat. No. 4,146,396, JP-A-51-146828, and JP-A-57-56837. Two or groups, selected from these, may be used in combination.

Preferred examples of the timing-adjusting group are as follows:

(1) Group Utilizing Cleavage Reaction of Hemiacetal

Example of this group are disclosed in, for example, U.S. Pat. Nos. 4,146,396, JP-A-60-249148, and JP-A-60-249149.

(2) Group Causing Cleavage Reaction by Using Intramolcular Nucleophilic Replacement Reaction An example of this group is the timing group disclosed in U.S. Pat. No. 4,248,292.

(3) Group Causing Cleavage Reaction by Using Electron Transfer Reaction along Conjugated System Example of this group are disclosed in, for example, U.S. Pat. Nos. 4,409,323 and 4,421,845.

(4) Group Utilizing Cleavage Reaction Achieved by Hydrolysis of Ester

An example of this group is the linking group disclosed in, for example, West German Laid-Open Patent Application 2,626,315.

(5) Group Utilizing Cleavage Reaction of Iminoketal

An example of this group is the linking group disclosed in U.S. Pat. No. 4,546,073.

The following can be cited as examples of the group represented by "Time" which is either a coupler or a redox group.

An example of "Time" which is a coupler is a phenol type coupler which is bonded to G in the formula (II) at the oxygen atom of the hydroxy group which is removed a hydrogen atom. Another example of "Time" which is a coupler is a 5-pyrazoline type coupler which is bonded to G at the oxygen atom of the tautomerized hydroxy group which is removed a hydrogen atom.

These couplers act as couplers only after they have left G, reacting with an oxidized form of a developing agent and then releasing X bonded the coupling position.

Preferable examples of "Time" which is a coupler are those represented by the following formulas (C-1) to (C-4):

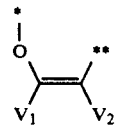

Formula (C-1)

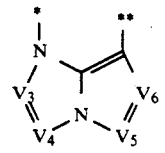

Formula (C-2)

-continued

Formula (C-3)

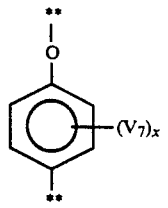

Formula (C-4)

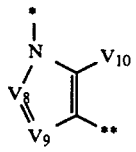

In these formulas, $V_1$ and $V_2$ are substituent groups, $V_3$, $V_4$, and $V_5$ are nitrogen atoms or substituted or unsubstituted methine groups, $V_7$ is a substituent group, x is an integer ranging from 0 to 4, $V_7$ represents identical or different groups if x is 2, 3 or 4, two groups $V_7$ may bond to each other to form a ring-like structure, $V_8$ is —CO— group, —$SO_2$— group, an oxygen atom, or a substituted imino group, $V_9$ is a non-metal atom group which combine with —$V_8$—N—C=C— to form a 5- to 8-membered ring, and $V_{10}$ is a hydrogen atom or a substituent group.

If the group represented by "Time" in the formula (II) is a redox group, it is preferably one which is represented by the following formula (R-1):

$$*-P-(Y=Z)_k-Q-B \qquad \text{Formula (R-1)}$$

In the formula (R-1), P and Q are independently an oxygen atom or a substituted or unsubstituted imino group, at least one of k number of Y's and k number of Z's is a methine group having X as a substituent group, and the remaining Y's and Z's are substituted or unsubstituted methine groups or nitrogen atoms, k is an integer ranging from 1 to 3 (k number of Y's are identical or different, and k number of Z's are likewise identical or different), and B is a group which can be removed by a hydrogen atom or alkali. Two of substituent groups P, Y, Z, Q and B may change to divalent groups, which link together to form a ring-like structure. For example, $(Y=Z)_k$ may form a benzene ring or a pyridine ring.

Of the groups which are represented by the formula (R-1), preferable are those which are represented by the following formulas (R-2) and (R-3):

Formula (R-2)

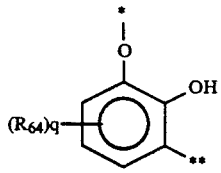

Formula (R-3)

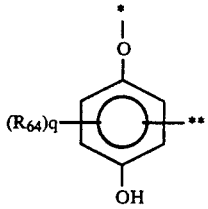

In the formulas (R-2) and (R-3), the mark * indicates the position where the group bonds to G of formulas (II), and the mark ** indicates the position where it bonds to X.

In these formulas, $R_{64}$ is a substituent group, and q is 0, 1, 2 or 3. If q is 2 or 3, the groups $R_{64}$ may be the same or different. If two substituent groups $R_{64}$ are on adjacent carbon atoms, they may change to divalent groups, which bond together to form a ring-like structure.

In the formula (II), X represents a development inhibitor. Preferable examples of X are a compound having a mercapto group which bonds to the heterocyclic ring which represented by the following formula (X-1), or a heterocyclic compound which can form imino silver which represented by the following formula (X-2).

Formula (X-1)

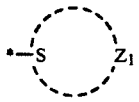

Formula (X-2)

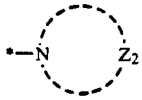

In the formulas (X-1) and (X-2), $Z_1$ is a non-metal atom group required for forming a monocyclic or condensed heterocyclic ring, $Z_2$ is a non-metal atom group required for forming, along with N, a monocyclic or condensed heterocyclic ring. The heterocyclic ring may have a substituent group. In the formulas (X-1) and (X-2), the mark * indicates the position where the compound X bonds to Time. Preferable as a heterocyclic ring is formed by $Z_1$ or $Z_2$ are 5- to 8-membered heterocyclic rings, each having at least one hetero atom such as a nitrogen atom, an oxygen atom, a sulfur atom, or a selenium atom. Of these, the most preferred is a 5- or 6-membered heterocyclic ring.

Examples of the heterocyclic ring represented by $Z_1$ are: azoles (tetrazole, 1,2,4-triazole, 1,2,3-triazole, 1,3,4-thiadiazole, 1,3,4-oxadiazole, 1,3-thiazole, 1,3-oxazole, imidazole, benzothiazole, benzoxazole, benzimidazole, pyrrole, pyrazole, and indazole), azaindenes (tetraazaindene, pentaazaindene, and triazaindene), and azines (pyrimidine, triazine, pyrazine, and pyridazine).

Examples of the heterocyclic ring represented by $Z_2$ are: triazoles (1,2,4-triazole, benzotriazole, and 1,2,3-triazole), indazole, benzimidazole, azaindenes (tetraazaindene and pentaazaindene), and tetrazole.

Preferable as the substituent group which the development inhibitors presented by the formula (X-1) and (X-2) have are: $R_{77}$ group, $R_{78}O$— group, $R_{77}S$— group, $R_{77}OCO$— group, $R_{77}OSO_2$— group, a halogen atom, a cyano group, a nitro group, $R_{77}SO_2$— group, $R_{78}CO$— group, $R_{77}COO$— group, $R_{77}SO_2N(R_{78})$— group, $R_{78}N(R_{79})SO_2$— group, $R_{18}N(R_{79})CO$— group, $R_{77}C(R_{78})=N$— group, $R_{77}N(R_{78})$— group, $R_{78}CON(R_{79})$— group, $R_{77}OCON(R_{78})$— group, $R_{78}N(R_{79})CON(R_{80})$— group, or $R_{77}SO_2O$— group. Here, $R_{77}$ is an aliphatic group, an aromatic group, a heterocyclic group, or a hydrogen atom. If there are two or more $R_{77}$ groups, two or more $R_{78}$ groups, two or more $R_{79}$ groups, and two or more $R_{80}$ groups, these may bond together, forming a ring (e.g., a benzene ring).

Examples of the compound represented by the formula (X-1) are: substituted or unsubstituted mercaptoazoles (e.g., 1-phenyl-5-mercaptotetrazole, 1-propyl-5-mercaptotetrazole, 1-butyl-5mercaptotetrazole, 2-methylthio-5-mercaptol-3,4-thiadiazole, 3-methyl-4-phenyl-5-mercapto-1,3,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido) phenyl}-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (e.g., 6-methyl-4-mercapto-1,2,3a,7-tetraazaindene and 4,6-dimethyl-2-mercapto-1,3,3a,7-tetraazaindene), and substituted or unsubstituted mercaptopyrimidines (e.g., 2-mercaptopyrimidine and 2-mercapto-4-methyl-6-hydroxypyrimidine).

Examples of the heterocyclic compound which can form imino silver are: substituted or unsubstituted triazoles (e.g., 1,2,4-triazole, benzotriazole, 5-methylbenzotriazole, 5-nitrobenzotriazole, 5-bromobenzotriazole, 5-n-butylbenzotriazole, and 5,6-dimethylbenzotriazole), substituted or unsubstituted indazoles (e.g., indazole, 5-nitroindazole, 3-nitroindazole, and 3-chloro-5-nitroindazole), and substituted or unsubstituted benzimidazoles (e.g., 5-nitrobenzimidazole and 5,6-dichlorobenzimidazole).

In the formula (II), X may be a development inhibitor which leaves Time, becoming a development-inhibiting compound, and then reacts with a developing component in a specific manner, changing to a compound which cannot inhibit development or can inhibit development but very little. A functional group which undergo such chemical reaction is, for example, ester group, carbonyl group, imino group, immonium group, a Michael addition receptor group, or imido group.

Groups which can be cited as examples of such a deactivated development inhibitor are the development-inhibiting residual groups described in, for example, U.S. Pat. Nos. 4,477,563, JP-A-60-218644, JP-A-60-221750, JP-A-60-233650, and JP-A-61-11743.

Of these compounds, any having ester is preferred. Examples of such a compound are: 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-phenoxycarbonylbenzotriazole, 4-(4-cyanophenoxycarbonyl)benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 6-phenoxycarbonyl-2-mercatobenzoxazole, 2-(1-methoxycarbonylethylthio)-5-mercapto-1,3,4-thiadiazole, 2-butoxycarbonylmethoxycarbonylmethylthio-5-mercapto-1,3,4-thiadiazole, 2-(N-hexylcarbamoylmethoxycarbonylmethylthio)-5-mercapto-1,3,4-thiadiazole, and 5-butoxycarbonylmethoxycarbonylbenzotriazole.

Of the compounds represented by the formula (II), preferable are those represented by the following formulas (III) and (IV):

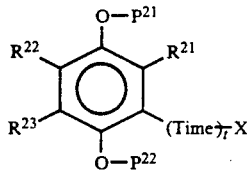

Formula (III)

wherein $R^{21}$ to $R^{23}$ are groups which can be substituted with hydrogen atoms or hydroquinone nuclei, $P^{21}$ and $P^{22}$ are hydrogen atoms or protective groups which can leave at the time of development, and "Time", X, and t are of the same meaning as in the formula (II).

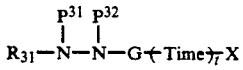

Formula (IV)

wherein $R^{31}$ is an aryl group, a heterocyclic group, an alkyl group, an aralkyl group, an alkenyl group, or an alkynyl group, $P^{31}$ and $P^{32}$ are hydrogen atoms or protective groups which can leave at the time of development, G, "Time", X, and t are of the same meaning as in the formula (II).

The formula (III) will be described in greater detail. The substituent groups represented by $R^{21}$ to $R^{23}$ can be those exemplified as substituent groups for A in the formula (II). Nonetheless, preferable as $R^{22}$ to $R^{23}$ are: a hydrogen atom, an alkylthio group, an arylthio group, an alkoxy group, an aryloxy group, an amido group, a sulfonamido group, an alkoxycarbonylamino group, and an ureido group. Of these, particularly preferable are: a hydrogen atom, an alkylthio group, an alkoxy group, an amido group, a sulfonamido group, an alkoxycarobnylamino group, and an ureido group.

Preferable as $R^{21}$ are: a hydrogen atom, a carbamoyl group, an alkoxycarbonyl group, a sulfamoyl group, a sulfonyl group, a cyano group, an acyl group, and a heterocyclic group. Of these, particular preferable are: a hydrogen atom, a carbamoyl group, an alkoxycarbonyl group, a sulfamoyl group, and a cyano group. $R^{22}$ and $R^{23}$ may combine, forming a ring.

Examples of protective groups $R^{21}$ and $R^{22}$ may be those exemplified above as protective groups for the hydroxy group of A in the formula (II). Preferable as the protective groups are: a group which can be decomposed by hydrolysis, such as an acyl group, an alkoxycarbonyl group, an aryloxycabonyl group, a carbamoyl group, an imidoyl group, an oxazolyl group, or a sulfonyl group; a precursor group of the type disclosed in U.S. Pat. No. 4,009,029 and utilizing reverse Mickael reaction; a precursor group of the type disclosed in U.S. Pat. No. 4,310,612 and utilizing an anion generated after ring-cleavage reaction, as an intramolcular nucleophilic group; a precursor group of the type disclosed in U.S. Pat. Nos. 3,674,478, 3,932,480 and 3,993,661 and causing cleavage reaction due to the motion of anion electrons along a conjugate system; a precursor group of the type disclosed in U.S. Pat. No. 4,335,200 and causing cleavage reaction due to the motion of the electron of an anion which had reacted after ring-cleavage; and a precursor group of the type disclosed in U.S. Pat. Nos. 4,363,865 and 4,410,618 and utilizing an imidomethyl group.

Preferable as $P^{21}$ and $P^{22}$ are hydrogen atoms.

Preferable as X are mercaptoazoles and benzotriazoles. Particularly preferable mercaptoazoles are mercaptotetrazoles, 5-mercapto-1,3,4-thiadiazoles, and 5-mercapto-1,3,4-oxadiazoles.

The most preferable as X is 5-mercapto-1,3,4-thiadiazole.

Of the compounds represented by the formula (III), particularly preferred are those represented by the following formulas (V) and (VI):

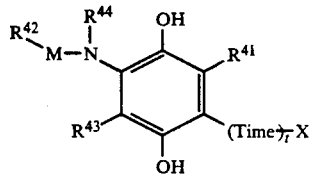

Formula (V)

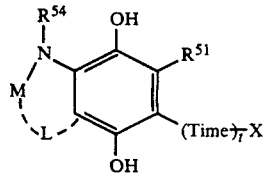

Formula (VI)

In the formulas (V) and (VI), $R^{42}$ is an aliphatic group, an aromatic group or a heterocyclic group, M is —CO—, —$SO_2$—, —N($R_{45}$)—CO—, —OCO— or —N($R_{45}$)—$SO_2$—. $R^{44}$, $R^{45}$, and $R^{54}$ are each a hydrogen atom, an alkyl group, or an aryl group. L is a divalent linking group required for forming a 5- to 7-membered ring. $R^{41}$ and $R^{51}$ are of the same meaning as $R^{21}$ in the formula (III), $R^{43}$ is of the same meaning as $R^{23}$ in the formula (II), —(Time)$_t$—X is of the same meaning as —(Time)$_t$—X in the formula (III).

$R^{42}$ will be described in more detail. If $R^{42}$ is an aliphatic group, it is an alkyl, alkenyl or alkynyl group in the form of a straight chain, a branched chain, or a ring having 1 to 30 carbon atoms. If it is an aromatic group, it is a phenyl or naphthyl group having 6 to 30 carbon atoms. If it is a heterocyclic group, it is a 3- to 12-membered one having at least one element selected from the group consisting of nitrogen, oxygen and sulfur. Group $R^{42}$ may be substituted with any group exemplified above as substituent groups for A.

The formula (IV) will be described in more detail.

If $R^{31}$ is an aryl group, it has 6 to 20 carbon atoms and is, for example, phenyl or naphthyl. If it is a heterocyclic group, it is a 5- to 7-membered one having at least one element selected from the group consisting of nitrogen, oxygen and sulfur and is, such as furyl or pyridyl. If it is an alkyl group, it has 1 to 30 carbon atoms and is, for example, methyl, hexyl, or octadecyl. If it is an aralkyl group, it has 7 to 30 carbon atoms and is, for example, benzyl or trityl. If it is an alkenyl group, it has 2 to 30 carbon atoms and is, for example, allyl. If it is an alkynyl group, it has 2 to 30 carbon atoms and is, for example, propagyl. $R^{31}$ is preferably an aryl group, and more preferably phenyl.

Examples of the protective groups $P^{31}$ and $P^{32}$ are those which have been ememplified above as protective groups for the amino group of A in the formula (II). Preferable as $P^{31}$ and $P^{32}$ are hydrogen atoms.

Preferable as G is —CO—, and preferable as X is one which has been described in conjunction with the formula (III).

$R^{21}$ and $R^{23}$ in the formula (III), and $R^{31}$ in the formula (IV) may each be substituted with a substituent group. This substituent group may be a so-called ballast group or a group adsorbed to silver halide, which will impart anti-diffusability. A ballast group is preferred. If $R^{31}$ is a phenyl group, the substituent group is preferably an electron-donating group, such as a sulfonamido group, a amido group, an alkoxy group, or an ureido group. If $R^{21}$, $R^{22}$, $R^{23}$ or $R^{31}$ has a ballast group, it is particularly desirable that a polar group, such as a hydroxy group, a carboxyl group, or a sulfo group, exist in the molecule.

To describe the present invention more specifically, the compounds represented by the formula (II) will be specified below. However, the compounds which can be used in the invention are not limited to these.

II-1

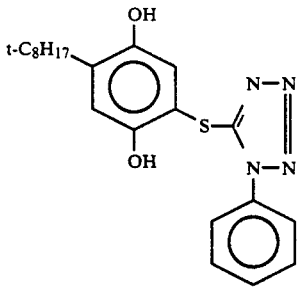

II-2

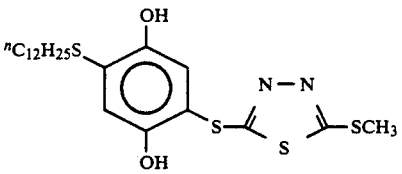

II-3

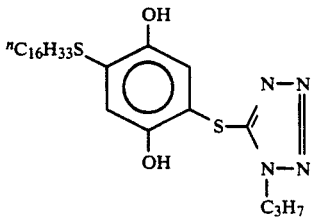

-continued
II-4
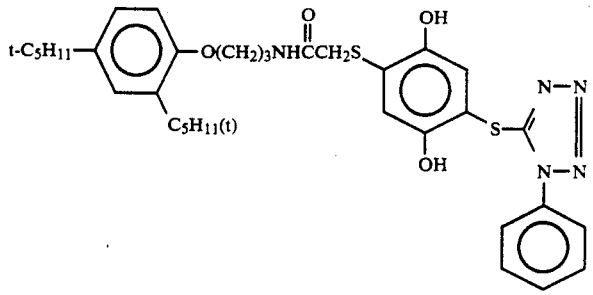
II-5
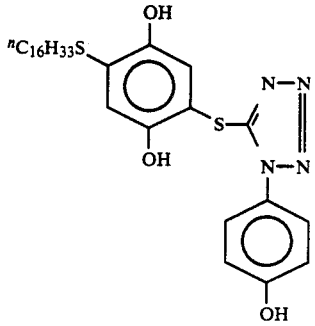
II-6
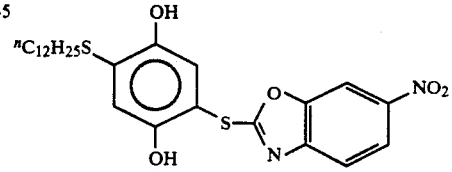
II-7
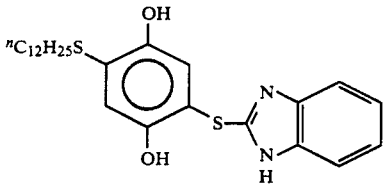
II-8
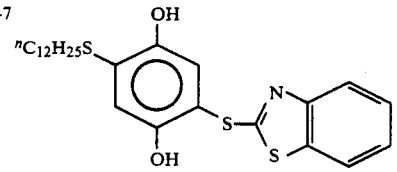
II-9
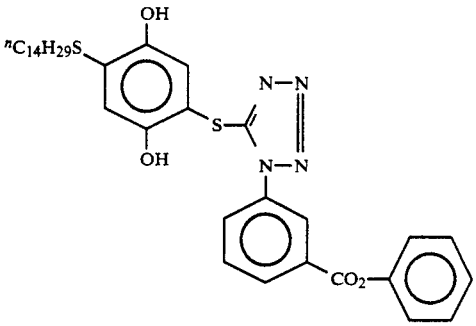
II-10
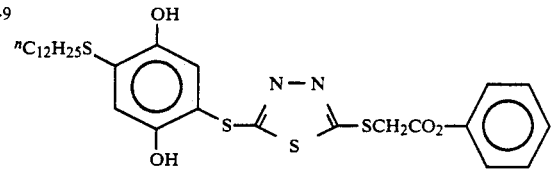
II-11
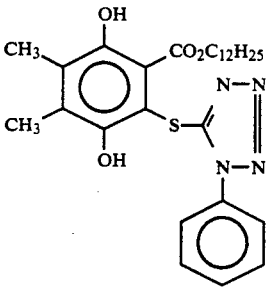
II-12
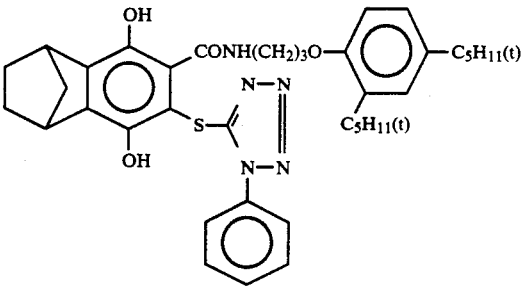
II-13
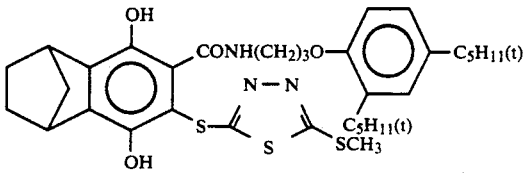

-continued
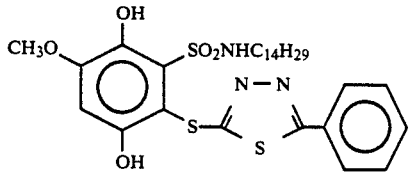
II-14
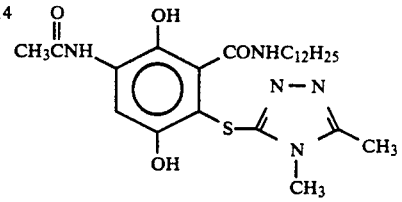
II-15
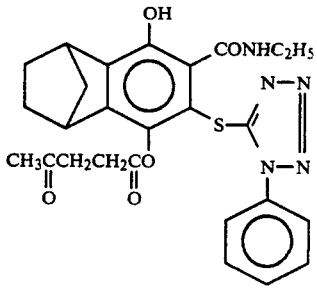
II-16
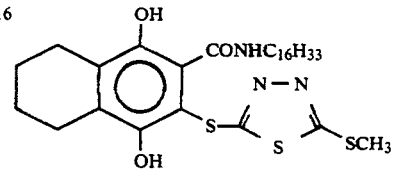
II-17
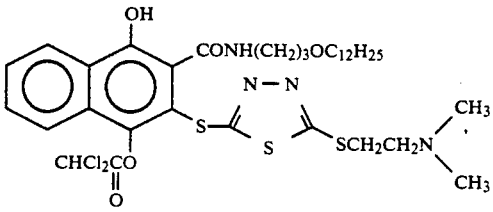
II-18
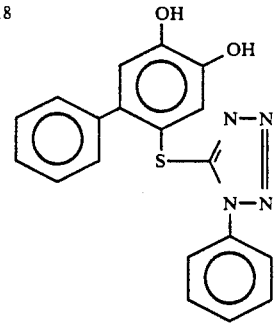
II-19
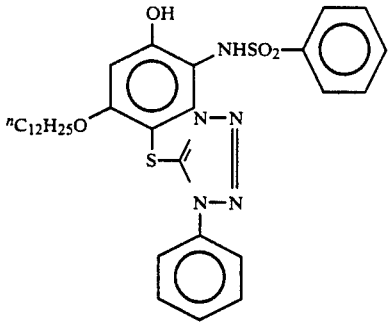
II-20
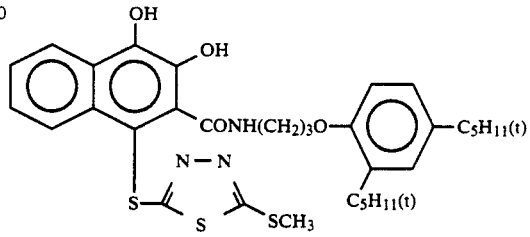
II-21
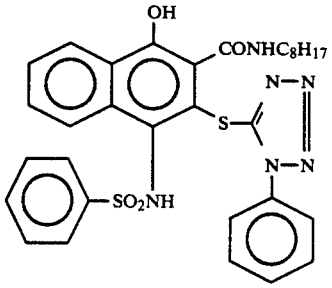
II-22
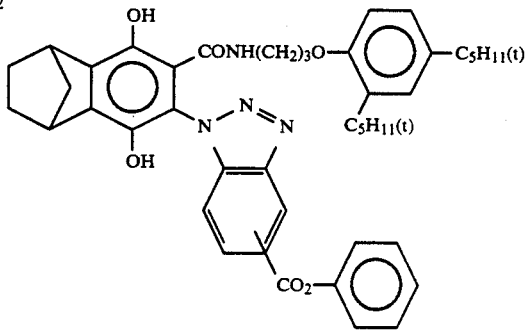
II-23

-continued
II-24
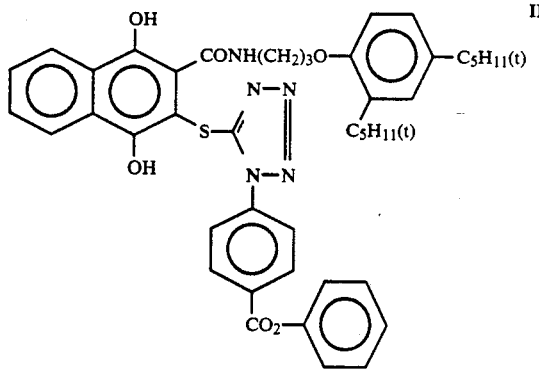
II-25
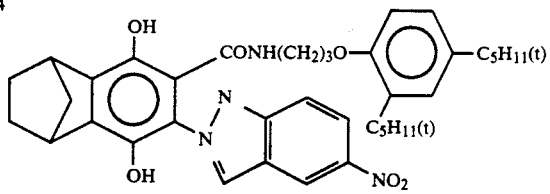
II-26
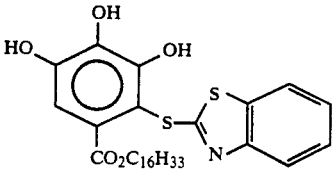
II-27
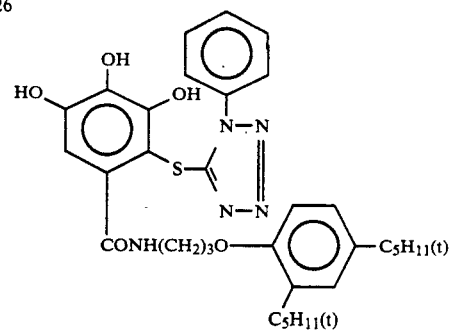
II-28
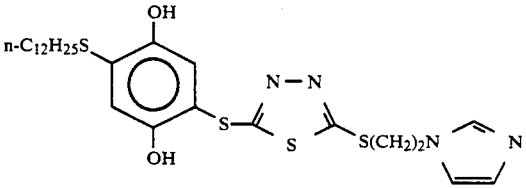
II-29
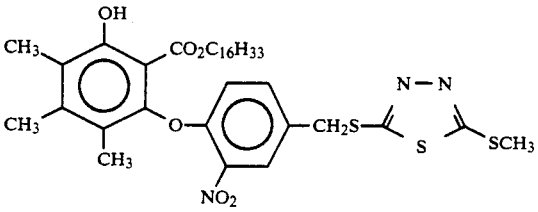
II-30
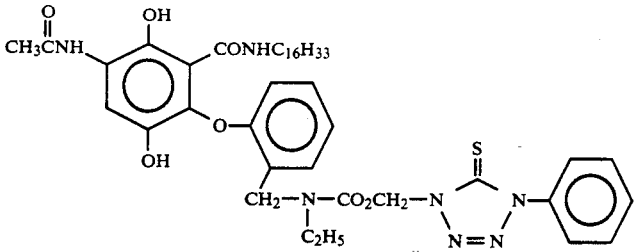
II-31
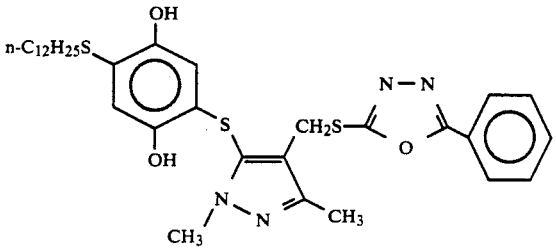

-continued
II-32
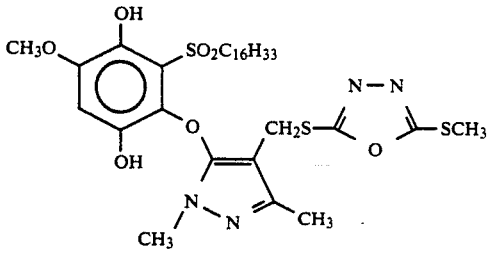
II-33
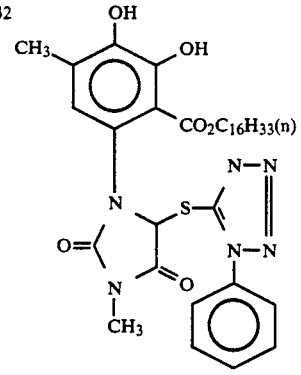
II-34
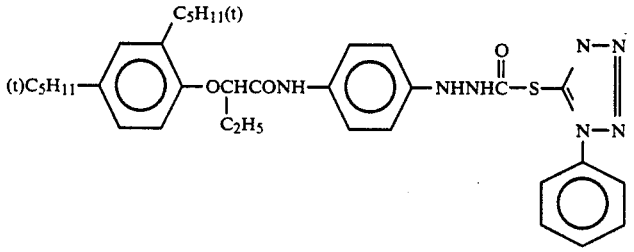
II-35
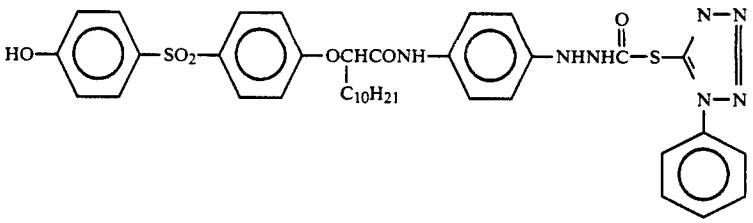
II-36
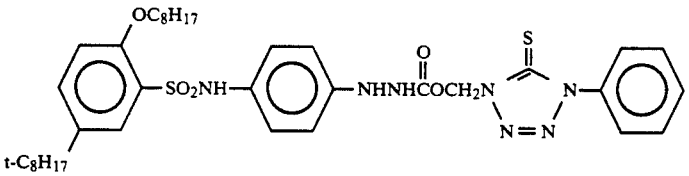
II-37
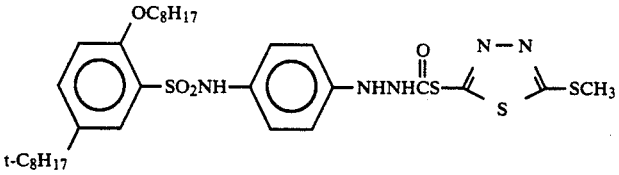
II-38
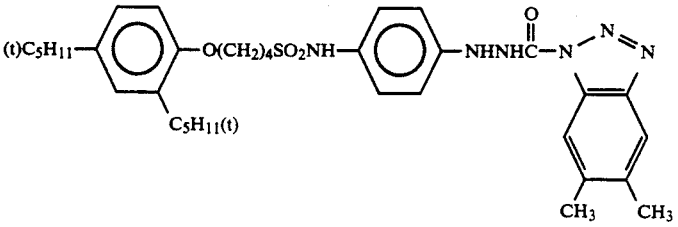

-continued
II-39
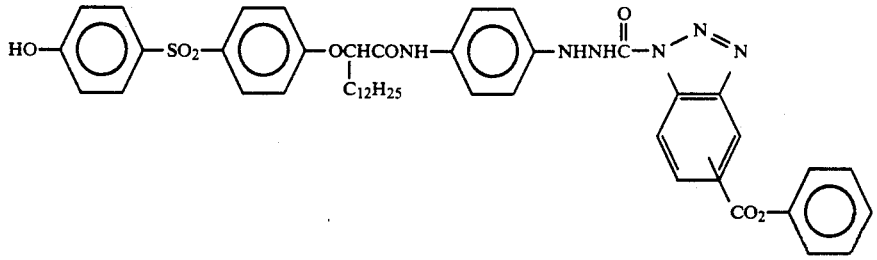
II-40
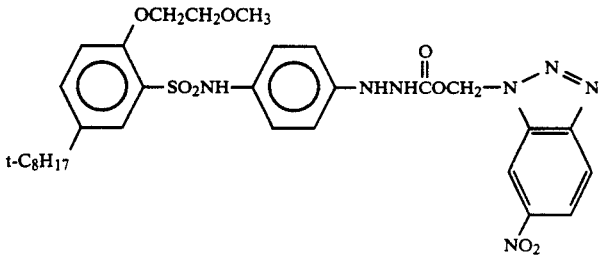
II-41
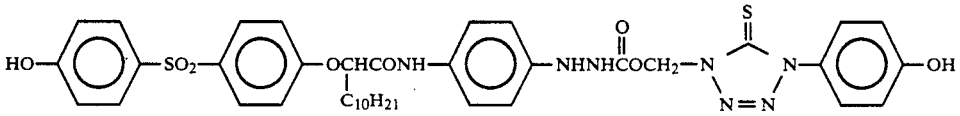
II-42
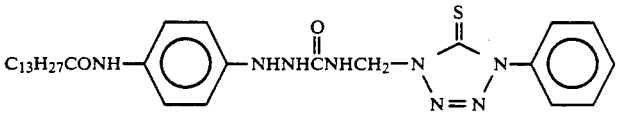
II-43
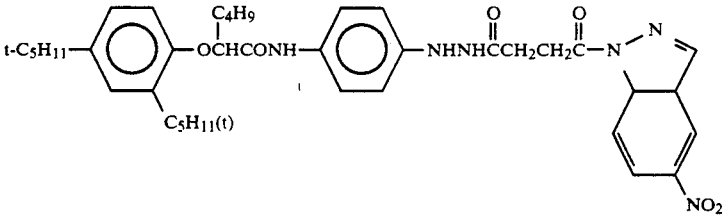
II-44
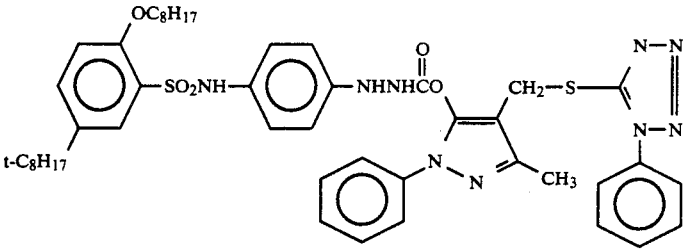
II-45
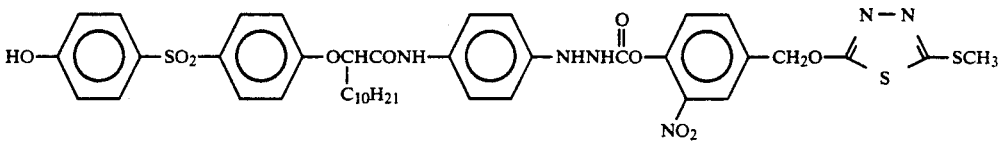

-continued
II-46
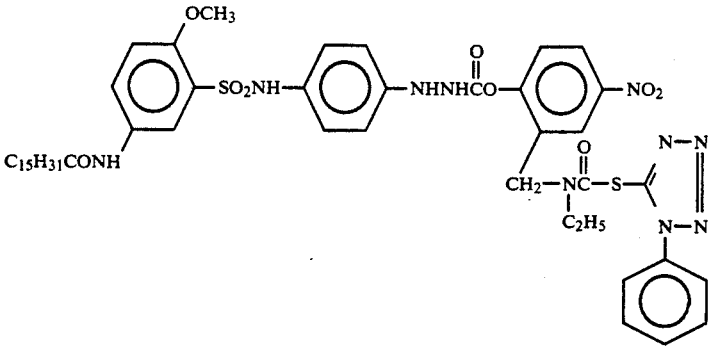
II-47
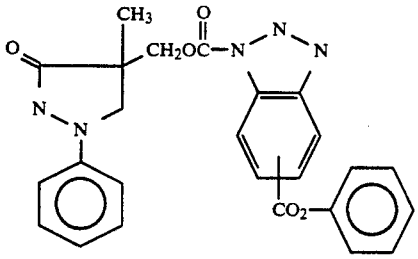
II-48
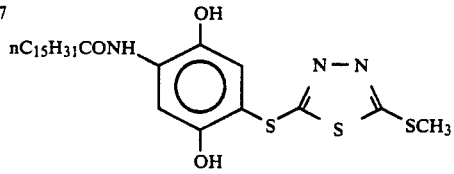
II-49
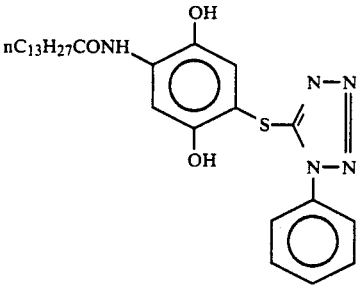
II-50
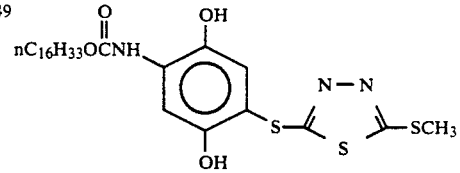
II-51
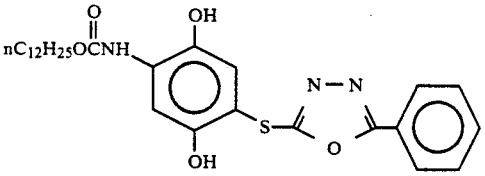
II-52
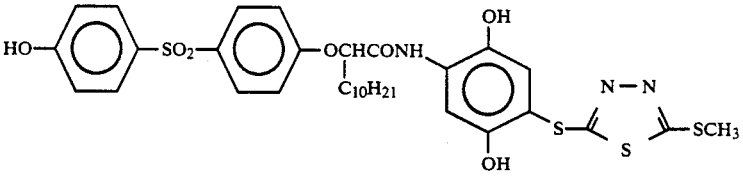
II-53
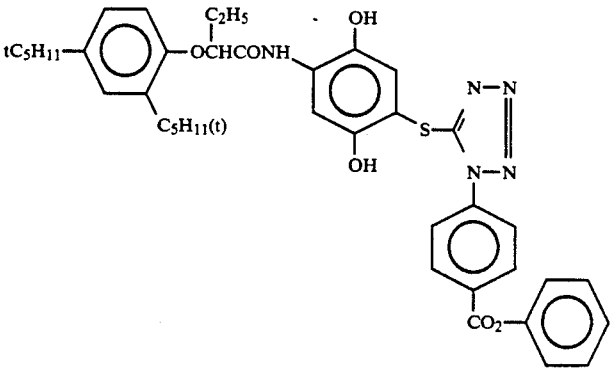

-continued
II-54
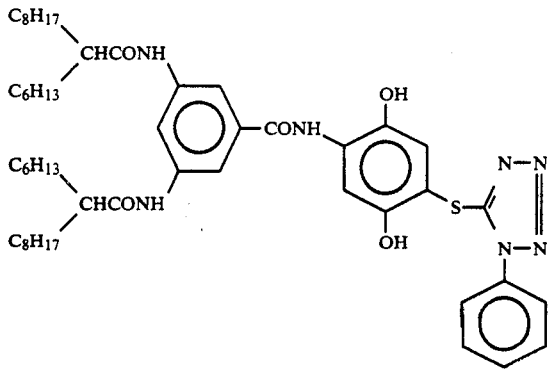
II-55
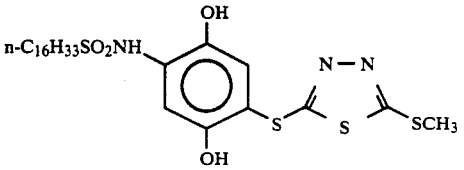
II-56
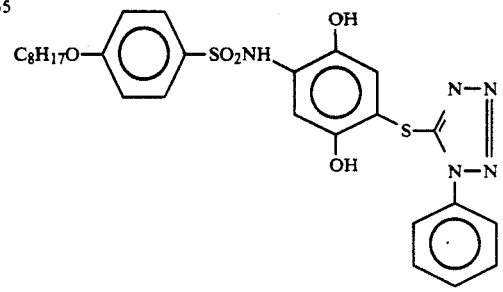
II-57
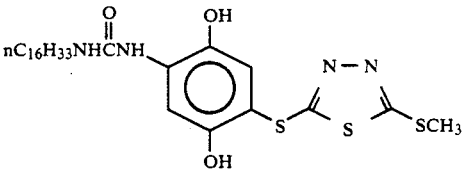
II-58
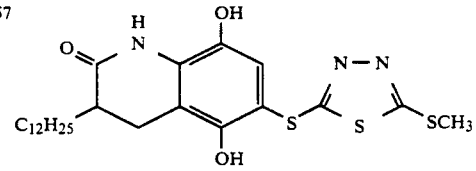
II-59
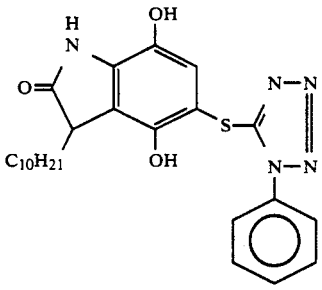
II-60
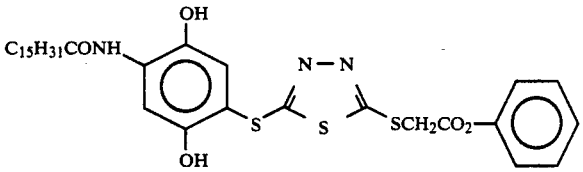
II-61
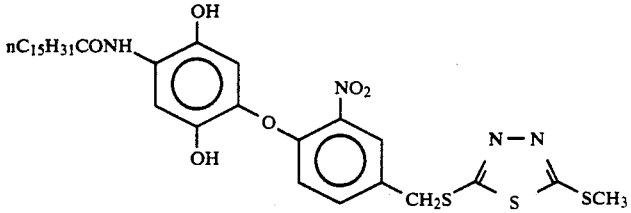

-continued
II-62
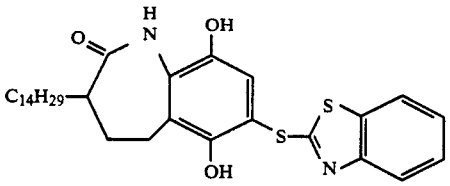
II-63
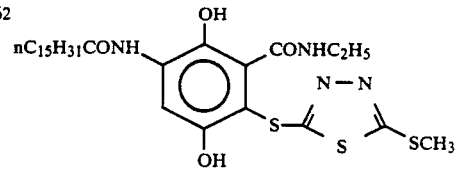
II-64
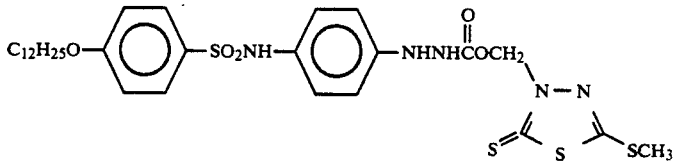
II-65
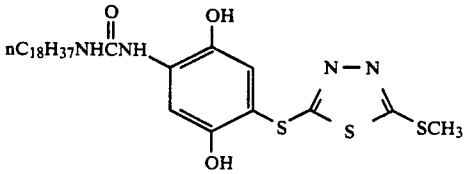
II-66
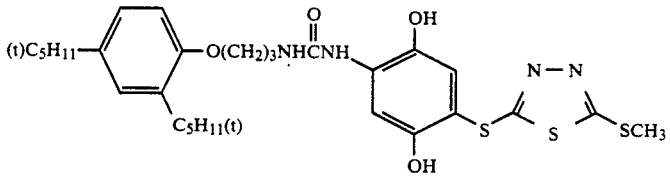
II-67
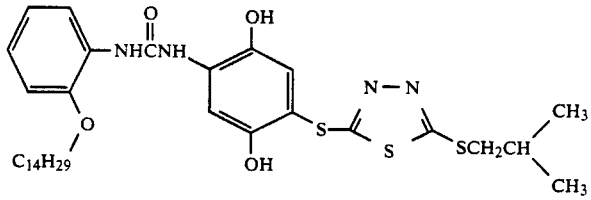
II-68
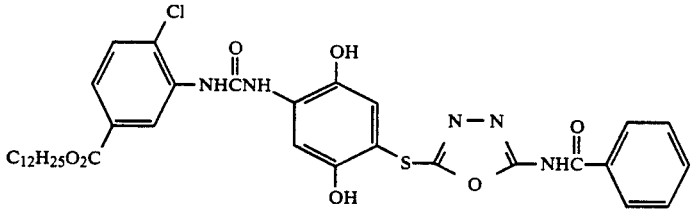
II-69
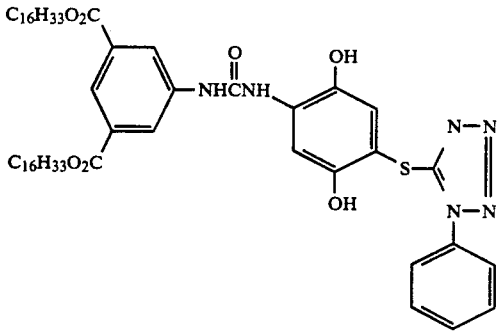

-continued
II-70
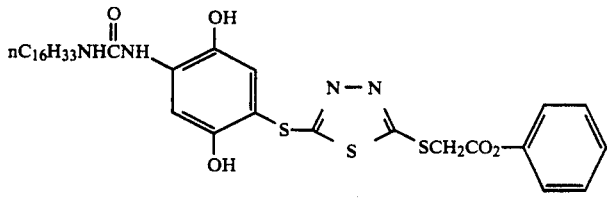
II-71
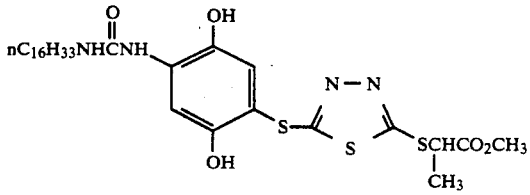
II-72
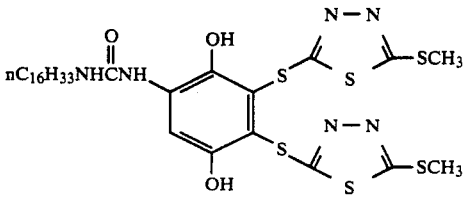
II-73
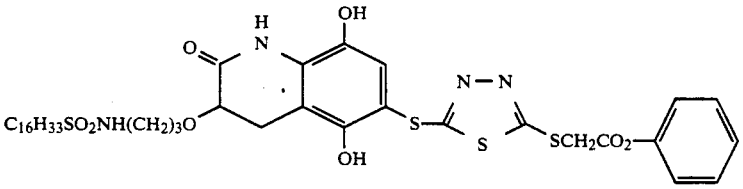
II-74
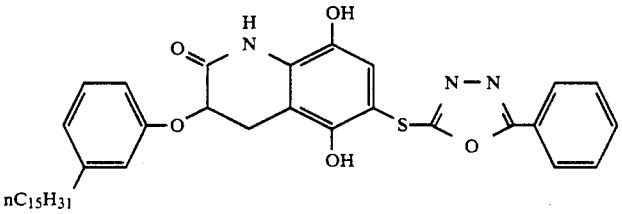
II-75
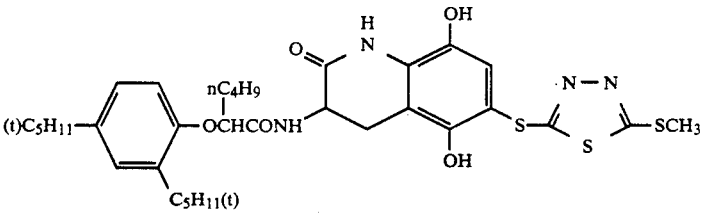
II-76
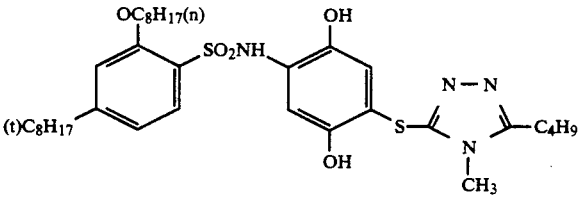
II-77
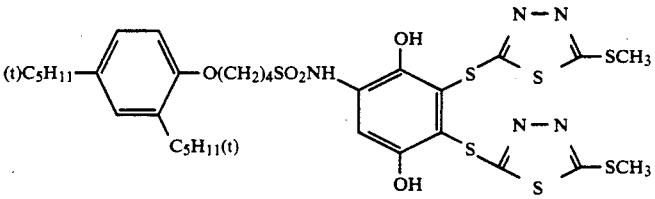

-continued
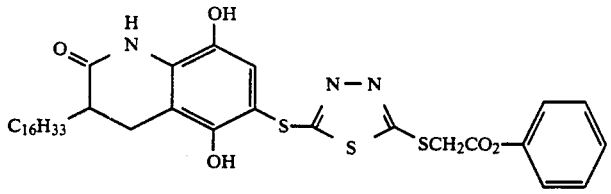
II-78
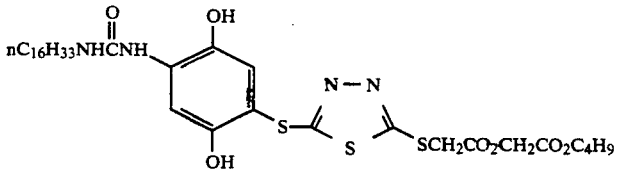
II-79
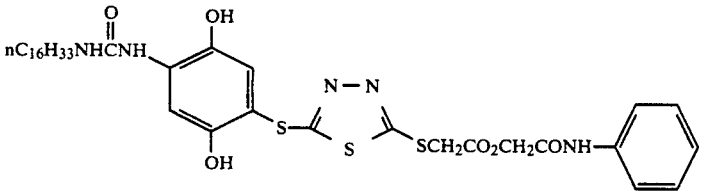
II-80
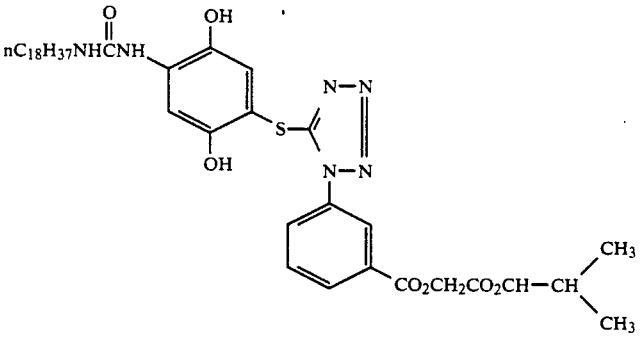
II-81
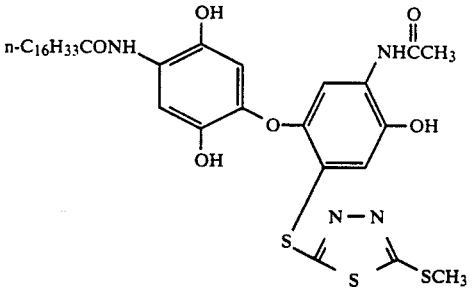
II-82
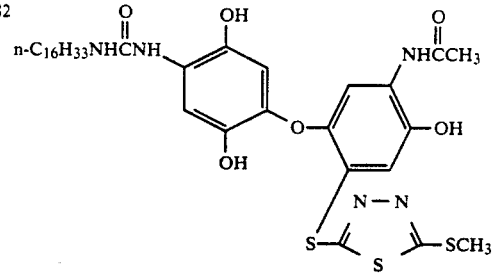
II-83
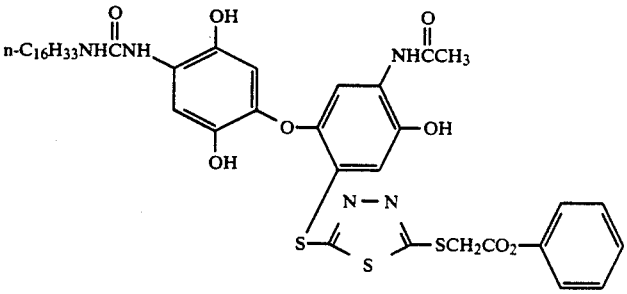
II-84

-continued

II-85

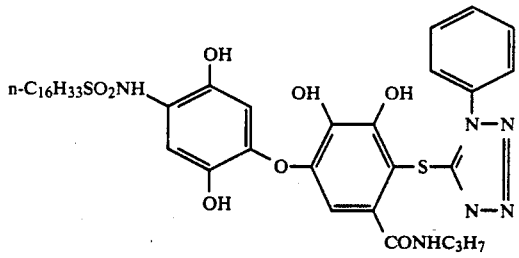

II-86

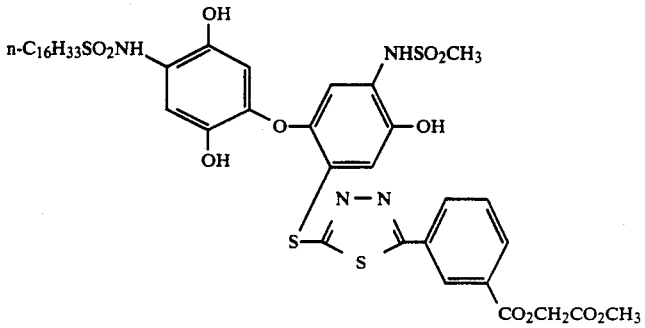

II-87

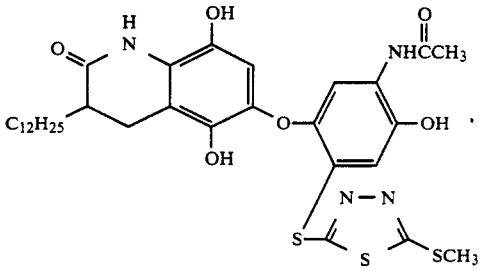

II-88

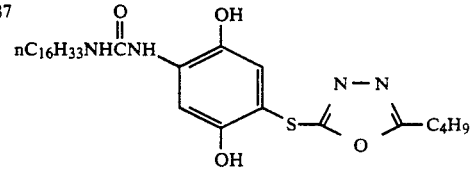

II-89

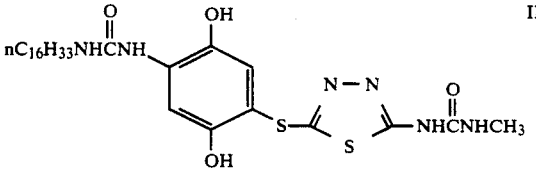

II-90

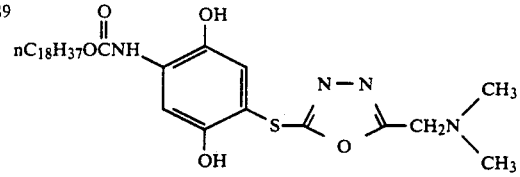

The compound represented by the formula (II) can be synthesized by the methods disclosed in JP-A-49-129536, JP-A-52-57828, JP-A-60-21044, JP-A-60-233642, JP-A-60-233648, JP-A-61-18946, JP-A-61-156043, JP-A-61-213847, JP-A-61-230135, JP-A-61-236549, JP-A-62-62352, JP-A-62-103639, U.S. Pat. Nos. 3,379,529, 3,620,746, 4,332,828, 4,377,634, 4,684,604, JP-A-2-21127, JP-A-2-21128, and JP-A-2-21129.

The compound represented by the formula (II) can be added to any emulsion layer or any non-light-senstive layer, or both. It is added in an amount of preferably 0.001 to 0.2 mmol/m$^2$, more preferably 0.01 to 0.1 mmol/m$^2$.

(1) The regular silver halide emulsion of the present invention will now be described below in detail.

The term "regular silver halide emulsion" means an emulsion which contains regular crystal grains having, mainly, (111) faces and (100) faces. In the present invention, it is desirable that regular grains occupy 50% or more of the total amount of silver of the silver halide grains spectrally sensitized with the methane compound of the invention. It is more desirable that regular grains occupy 70% or more of that total amount of silver.

The silver halide emulsion of the present invention, which contains regular grains, is obtained by controlling pAg and pH during the forming of the grains, as is described in Photographic Science and Engineering, Vol. 6, pp. 159-165 (1962), Journal of Photographic Science, Vol. 12, pp. 242-251 (1964), U.S. Pat. No. 3,655,394, and British Patent 1,413,748.

(2) The emulsion of the present invention, which contains tabular silver halide grains, will be described below in detail.

The term "tabular silver halide grain (hereinafter called "tabular grain)" means a grain having two major surfaces, either parallel or nearly parallel to each other, each having an equivalent-circle diameter which is two or more times greater than the distance between the major surfaces (i.e., the thickness of the grain). "Equivalent-circle diameter" is the diameter of the circle which has an area equal to projected area of either major surface.

Preferably, the ratio of the average diameter of the tabular grains, contained in the emulsion, to the average thickness of the tabular grains is 2 or more, preferably 3 to 12, more preferably 5-10. This ratio will be referred to as "diameter/thickness ratio." The diameter/thickness ratio can be obtained by dividing the sum of the diameter/thickness ratios of the individual grains by the number of the individual grains. It can, nonetheless, be determined by a more simple method, that is, by dividing the average diameter of the grains by the average thickness thereof.

The tabular grains of the present invention have an average (equivalent-circle) diameter of 0.3 to 10 μm, preferably 0.5 to 5.0 μm, more preferably 0.5 to 2.0 μm.

The tabular grains have an average thickness of preferably less than 0.5 μm, more preferably 0.05 to 0.4 μm, still more preferably 0.08 to 0.3 μm.

In the emulsion of the present invention, tabular grains occupy 50% or more, preferably 70% or more, and more preferably 90% or more, of the total projected area of all grains contained in the emulsion.

In the present invention, the diameter and thickness of a grain can be determined from an electron photomicrography, as is described in U.S. Pat. No. 4,434,226. Specific examples of the halogen composition for the grain are: silver chloroiodide, silver iodobromide, silver chloride, silver chlorobromide, silver bromide, and silver chloroiodobromide. Other example of the halogen composition are silver thiocyanate and silver cyanate.

Tabular grains can easily be formed by the methods disclosed in, for example, Gutoff, "Photographic Science and Engineering", Vol. 14, PP. 248 to 257 (1970); U.S. Pat. Nos. 4,434,226, 4,386,156, 4,414,310, 4,399,215, 4,433,048, 4,400,463, 4,444,306, 4,499,520 and 4,435,501, and British Patent 2,112,157. The use of tabular grains is advantageous since the grains will increase covering power and enhances the color-sensitizing efficiency of a sensitizing dye, as is detailed in U.S. Pat. No. 4,434,226 which has been cited above.

Tabular grains are formed, for example, in the following way. First, seed crystals, 40 wt % or more or which are tubular grains, are formed in a relatively high-pBr atmosphere having a pBr value of 1.3 or less. A silver solution and a halogen solution are added, while maintaining the pBr value at the same value or a greater value, thereby causing the seed crystal to grow.

It is desirable that the silver solution and the halogen solution be added such that no new crystal nuclei are formed during while the grains are growing.

Monodispersed hexagonal tubular grains of the present invention have such a structure and are formed by such a method, as is described in detail in JP-A-63-151618. The emulsion of the invention is prepared if a dispersion medium and silver halide grains. At least 70% of the total projected area of all grains is occupied by hexagonal tubular grains, each having two parallel surfaces—the ratio of the longest side of each grain to the shortest side thereof being 2 or less. These hexagonal tabular grains are monodispersed to such extend that the variation coefficient of their size distribution is 20% or less. (The variation coefficient is obtained by dividing the standard deviation of the grain size, i.e., the diameter of a circle having the same area as the projected area of the grain, by the average size of the grains.) The hexagonal tabular grains have an aspect ratio of 2.5 or more, and a size of 0.2 μm or more.

The silver halide emulsion can be manufactured by forming nuclei, performing Ostowald ripening, and growing the grains, as is detailed in JP-A-63-151618.

During the forming of the tabular grains of the present invention, a silver salt solution (e.g., $AgNO_3$ aqueous solution) and a halide solution (e.g., KBr aqueous solution) should better be added at an increased rate, an increased amount, or in an increased concentration, thereby to accelerate the growth of grains.

As for the method of accelerating the growth of grains, the descriptions in, for example, British Patent 1,335,925, U.S. Pat. Nos. 3,672,900, 3,650,757 and 4,242,445, JP-A-55-142329, and JP-A-55-15812 can be referred to.

Also, physical ripening can be carried out in the presence of a known silver halide solvent (e.g., ammonia, potassium rhodanid, or thioether and thione compound disclosed in U.S. Pat. Nos. 3,271,57, JP-A-51-12360, JP-A-53-82408, JP-A-53-144319, JP-A-54-100717, and JP-A-54-155828.

The property of silver halide grains can be controlled during the precipitation of silver halide, in the presence of various compounds. These compounds may be introduced into the reaction vessel from the beginning. Alternatively, they may be added, together with one or more salts, by the ordinary method. As is described in U.S. Pat. No. 2,448,060, 2,628,167, 3,737,313, 3,772,031, and Research Disclosure No. 134,13452 (June 1975), the character of silver halide can be controlled during the precipitation of silver halide, in the presence of a compound of copper, iridium, lead, bismuth, cadmium or zinc, a compound of chalcogen, such as sulfur, selenium or tellurium, or a compound of gold or a Group VIII precious metal. As is described in JP-B-58-1410 and Moisar et al., Journal of Photographic Science, Vol. 25, 1977, pp. 19–27, the inner parts of the grains contained in a silver halide emulsion can be reduction-sensitized during the precipitation of silver halide.

To remove soluble silver salt from the emulsion, before or after the physical ripening, the Noodle water-washing, flocculation precipitation, or ultrafiltration may be carried out.

A known emulsion may be used in the layer containing the emulsion of the present invention, or in the layer adjacent to this layer, or in any other layer of the light-sensitive material. In the case where the known emulsion and the emulsion of the invention are used in the same layer, the mixing ratio of the former to the latter can be changed, if necessary, in accordance with the silver iodide content in the surface of the grain, the use of the light-sensitive material, or the like.

If two emulsions are used in the form of a mixture, it is desirable that the mixing ratio by weight be 3:97 to 97:3.

Two or more emulsions of the present invention, which differ in halogen composition, halogen distribution in the grain, the grain size, the grain-size distribution, crystal shape, crystal habit, latent-image distribution, and the like, can be used in the same layer, in adjacent layers, respectively, or layers located apart from one another.

The size of the tabular grains can be adjusted by changing the temperature, by selecting the type and amount of the solvent, by using a specific silver salt, by controlling the rate of adding the halide or the like.

JP-A-63-011928 and JP-A-63-151618 discloses the technique of monodispersing the size of tabular grains, thereby to increase the ratio of tabular grains to other grains. This technique can be used very suitably in the present invention. In other words, the technique can be used to achieve the object of the present invention, i.e., to provide a silver halide light-sensitive material containing a silver halide emulsion having tabular silver halide grains including those having an average diameter/average thickness ratio of 2 or more, occupying 50% or more of the total projected area of all grains and a variation coefficient of 25% or less in terms of the grain size distribution, and containing at least one methine compound represented by the formula (I).

The "variation coefficient" can be determined by the equation of $R=(3r^2 d/2)^{\frac{1}{3}}$, where r is the equivalent-circle diameter (μm) of tabular grain, and d is the thickness (μm) of the grain. The variation coefficient is obtained by dividing the standard deviation of the grain size by the average grain size, and then by multiplying the result by 100. The tabular grains preferable for use in the present invention have a variation coefficient of 25% or less, preferably 20% or less, more preferably 15% or less.

Further, dislocation may be introduced into the tabular grains of the present invention, thereby to improve sensitivity, pressure property, and storage stability, as is described in JP-A-63-220238 and JP-A-2-318078.

The regular silver halide grains and tabular silver halide grains of the present invention can have the crystal structure described below.

The crystal structure may either uniform, or may be different in halogen compositions of inner part and outer part, or may be a multilayered one. These emulsion grains are disclosed in British Patents 1,027,146, U.S. Pat. Nos. 3,505,068, 4,444,877, and JP-A-60-143331 (corresponding to U.S. Pat. No. 4,668,614 and EP 147,854). Alternatively, different silver halides may epitaxially bonded together or may be bonded to compounds other than silver halide, such as silver rhodanide or lead oxide, thereby forming a grain.

It is desirable that the grains of the silver halide emulsion of the present invention have a specific distribution or structure with respect to halogen composition. Typical examples of such grains are core/shell or double-structure type grains, each comprising an inner part and a surface part of grains of different halogen compositions, which are disclosed in, for example, JP-B-43-13162, JP-A-61-215540, JP-A-60-222845, and JP-A-61-75337.

The grains may not be of double structure, but of such a triple structure or such a multilayered structure as is disclosed in JP-A-60-222844. Alternatively, they may be those formed by depositing thin layers of silver halide having different composition on core/shell type grains.

To form a structure within a grain, it is possible form not only such a wrapped structure as described above, but also a grain having so-called junction structure. Examples of grains having a junction structure are disclosed in JP-A-59-133540, JP-A-108525, EP 199290A2, JP-B-58-24772, and JP-A-59-16254. A junction crystal has a composition different from that of the host crystal, and is jointed to an edge, a corner or a face of the host crystal. Such a junction crystal can be formed no matter whether the host crystal has a uniform halogen composition or a core/shell structure.

In the case of a junction structure, silver halides can of course be combined. Further, a junction structure can be formed by combining a silver halide with silver chloride such as silver rhodanide or silver carbonate, which is not of rock salt structure. Also, non-silver chloride such as PbO may be used, if possible, to form a junction structure.

In the case of a silver iodobromide grain having one of these structures, for example a core/shell grain, the core part may have high silver iodide content and the shell part may have low silver iodide content, or vice versa. Similarly, in the case of a junction-structure grain, the host crystal may have high silver iodide content and the junction crystal may have low silver iodide content, or vice versa.

The boundary between the parts of a gain having one of these structures, which are different in halogen composition, may be distinctive or not distinctive. Alternatively, the boundary between these parts may positively be given a continuously changing structure.

The silver halide emulsion for use in the present invention may be processed such that the grains are rounded, as is described in, for example, EP 0096727B1 and EP 0064412B1, or may be subjected to such surface modification as is described in DE 2306447C2 and JP-A-60-221320.

Solvents for silver halide are useful in accelerating ripening. For example, it is known that halogen ions is introduced in an excessive amount into the reaction vessel, in order to accelerate ripening. Obviously, ripening can be accelerated merely by introducing an excessive amount of a halide solution into the reaction vessel. Other ripening agents can be used. A ripening agent can be contained, in its entirety, in the dispersion medium placed in the reaction vessel, before silver or salt of halide is added. One or more salts of halide, silver salts, or deflocculants can be added or introduced into the reaction vessel. Alternatively, a ripening agent can be independently introduced at the stage of adding halide salt and silver salt.

As ripening agents other than halogen ions, ammonia, amine compound, and thiocyanate, such as alkali metal thiocyanate, particularly sodium thiocyanate, potassium thiocyanate or ammonium thiocyanate, can be used.

In the present invention it is very important to perform chemical sensitization the typical examples of which are sulfur sensitization and gold sensitization. A grain doped with $1\times10^{-4}$ mol/mol Ag or more of polyvalent metal ions does not exhibit good photographic properties as long as it remains in a non-ripened state; it comes to have marked photographic properties when sensitized chemically. The site where chemical sensitization should be applied differs in accordance with the composition, structure and shape of the emulsion grain. and also the purpose for which the emulsion is used. Chemical sensitization nuclei may be embedded deep in the grain or in the surface region thereof. Alternatively, the nuclei may be formed on the surface of the grain. The chemical sensitization will be described later.

(3) The emulsion of the present invention, which contains internal latent-image silver halide grains, will be described below in detail.

The internal latent-image silver halide grains according to the present invention must be chemically sensitized at the depth of less than 0.02 μm from the surface of the grain. If they are chemically sensitized at the depth of 0.02 μm or more form their surfaces, the black and white, the color negative, or the color reversal light-sensitive material will be developed but insufficiently even if developed with a practically effective developer, and the sensitivity of the material will be impaired inevitably.

The term "practically effective developer does not mean a developer containing no silver halide solvent for the purpose of developing surface latent images only or a developer containing much silver halide solvent for the purpose of developing internal latent images, but it means a developer which contains a silver halide solvent which dissolves silver halide appropriately and causes reduction sensitization, thereby to impart the material an optimal sensitivity. A developer containing a large amount of a solvent is not desirable since the silver halide is dissolved too much during the process, degrading graininess due to contagious development. To be specific, it is desirable that the developer contains, as a silver halide solvent, 20 mg/liter to 100 mg/liter of potassium iodide or 10 mg/liter to 100 mg/liter of sodium sulfite or potassium sulfite. Alternatively, potassium thiocyanate or the like can be used as silver halide solvent in the developer.

The site where chemical sensitization should be applied is, preferably, 0.002 μm or more, but not exceeding 0.015 μm, more preferably 0.004 μm but not exceeding 0.01 μm, from the surface of the grain. Not only the site of chemical sensitization, but also the ratio of surface sensitivity to inner sensitivity (i.e., intra-grain latent image distribution) should better be taken into consideration. The intra-grain latent image distribution has at least one maximum value within the grain, at the depth of less than 0.02 μm from the surface of the grain. It is desirable that the surface of the grain is chemically sensitized 0.2 or more times but less than one time the maximum value, more preferably 0.2 times or more but less than 0.7 times the maximum value.

The "latent image distribution" is represented by a graph wherein the depth (xμm) of each latent image is plotted on the abscissa, and the number (y) of latent images is plotted on the ordinate. The depth x is defined by the following equation (1):

$$x=(S/2)\times(1-(Ag_1/Ag_0)^{\frac{1}{2}}) \quad (1)$$

S: Average grain size (μm) of the silver halide emulsion, $Ag_1$: Amount of silver remaining after the following process has been performed on the unexposed, emulsion-coated sample, $Ag_0$: Amount of coated silver prior to the process The value y is the reciprocal of the exposure amount which imparts a density of fog+0.2 when the following process is carried out after the sample has been exposed to white light for 1/100 second. To determine the latent image distribution, the sample is processed at 25° C. for 5 minutes with a solution prepared by adding 0 to 10 g/liter of sodium thiosulfate to a process solution of the composition specified below:

| | |
|---|---|
| N-methyl-p-aminophenol sulfate | 2.5 g |
| Sodium L-ascorbate | 10 g |
| Sodium methaborate | 35 g |
| Potassium bromide | 1 g |
| Water to make | 1 liter (pH 9.6) |

By adding sodium thiosulfate in various amounts ranging from 0 g/liter to 10 g/liter, latent images in the silver halide grain are formed during the development, at different depths from the surface of the grain. Thus, the relationship between the number of latent images and the depth thereof can be determined.

The internal latent-image emulsion can be prepared by various method described in, for example, U.S. Pat. Nos. 3,979,213, 3,966,476, 3,206,313 and 3,917,485, JP-B-43-29405, and JP-B-45-13259. In any of these methods, chemical sensitization must be effected appropriately, the amount in which to precipitate silver halide after the chemical sensitization must be adjusted, and the conditions of precipitation be selected properly, in order to prepare an emulsion which has a latent image distribution of the present invention.

According to U.S. Pat. No. 3,966,476, too, silver halide is precipitated on chemically sensitized emulsion grains by means of controlled double jet method. If silver halide is precipitated after chemical sensitization by the method disclosed in this patent, the light-sensitive nuclei cannot be embedded in the grains. Hence, to attain a latent image distribution of the present invention, it is necessary to use more silver halide than in the method of U.S. Pat. No. 3,966,476 or to control the precipitation condition (e.g., the solubitity of precipitated silver halide, and the rate at which to add a soluble silver salt and a soluble halogen salt), thereby to form a silver halide layer having a thickness of 0.2 μm or less.

According to U.S. Pat. No. 3,979,213, an internal latent-image emulsion is prepared by precipitating further silver halide, by controlled double jet method, on emulsion grains whose surfaces have been chemically sensitized. If silver halide of the amount specified in this patent is precipitated on grains, the surface sensitivity will be less than a tenth of the total sensitivity. Therefore, to attain an optimum latent image distribution, the amount in which to precipitate silver halide on grains which have been chemically sensitized should be less than that amount used in U.S. Pat. No. 3,979,213.

The internal latent-image emulsion most preferable for use in the present invention can be obtained by such a method of manufacturing a silver halide photographic emulsion as is disclosed in JP-A-3-15840, which has a step of forming a shell on a silver halide core and in which the shell is formed in the presence of a tetraazaindenic compound after the grain has been chemically sensitized.

In this method it is desirable that the tetraazaindenic compound be used in an amount of $10^{-1}$ to $10^{-5}$ mol per mol of silver halide which is contained in the dispersion system (i.e., the emulsion) containing core grains and/or silver halide grains growing with cores grains used as nuclei. More preferably, the tetraazaindene-based compound is used in an amount of $10^{-2}$ to $10^{-4}$ mol per mol of the dispersion system.

The amount in which the tetraazaindenic compound is added greatly influences the latent image distribution from the surface of each grain to the inner part thereof. The optimum amount of the compound is varied within the range specified above, in accordance with the pAg value, the pH value and the temperature at the time of further growing the core, that is, at the time of precipitating silver halide on the core.

For example, if the amount of Ag used for forming the shell is large, and the number of latent images formed on the shell surface is small, it is recommendable to add the tetraazaindene compound in an amount greater than the upper limit of the range described above. On the other hand, if the amount of Ag used for forming the shell is small, and a small number of latent images are likely to be formed on the shell surface, the tetraazaindene compound should better be added in an amount less than the lower limit of the range described above.

The tetraazaindenic compound can be added directly to a water-soluble protective colloid containing core grains, or can be first dissolved in a water-soluble silver halide solution and then added little as silver halide grains grow, with core grains used as nuclei.

It is sufficient that the tetraazaindenic compound exists when the core grains start growing. The compound can be added before the cores are chemically sensitized. Since the tetraazaindenic compound is adsorbed to silver halide gains, thereby designating the sites where each grain will be chemically sensitized, it should better exist at the time of chemical sensitization of the cores.

The amount (M) of silver used in forming a shell on a chemical sensitized core, i.e., the amount of silver forming the shell, should satisfy the following equation (2):

$$(1-(M_0/M_0+M)^{\frac{1}{3}})\times R<0.02 \quad (2)$$

$M_O$: Silver amount of the seed grain

R: Final grain size (μm)

The silver potential (SCE) in the step of forming a shell on each core grain is preferably −30 mV to +80 mV. If the silver potential is higher than +80 mV, the chemical sensitizer not consumed for the chemical sensitization during the forming of the shell is liable to react with the shell to render the surface sensitivity than the internal sensitivity in many cases. On the other hand, if the shell is formed on the core grain at the silver potential of less than −30 mV, the surface of the chemically sensitized core grain is oxidized with an excess of halogen, inevitably decreasing the sensitivity. More preferable silver potential in the step of growing the core grain is −10 mV to +60 mV.

In the present invention, the temperature at which to form a shell on each core grain is preferably +30° C. to +70° C. If the temperature is higher than +70° C., the residual chemical sensitizer is likely to react with the shell part as has been described, making it impossible for the grain to have a surface sensitivity higher than its inner sensitivity. On the other hand, if the core grain is formed at less than +35° C., new nucleus will likely be formed during the growth of the crystal, making it impossible for silver halide to precipitate sufficiently at the chemically sensitized site of the core grain. In short, any temperature below +35° C. is undesirable since a new nucleus will likely be formed during the forming of the shell at such a temperature. The temperature in the shell-forming step is more preferably 45° C. to 60° C.

In the present invention, it is desirable that the water-soluble silver halide solution be added at a rate which is 30 to 100% of the critical crystal growth speed.

The "critical crystal growth speed" is defined as the upper limit of the speed range within which substantially no new nucleus is formed in the step of growing the grain. The words "substantially no new nucleus is formed" mean that the weight of the crystal nuclei newly formed is preferably 10% or less of the total weight of the silver halide used.

In the present invention, the core grains can be chemically sensitized by using active gelatin as is described in T. H. James, "The Theory of the Photographic Process, 4th Ed.," Macmillan, 1977, pp. 67–76. Alternatively, the core grains can be chemically sensitized by using a sulfur sensitizer, a selenium sensitizer, a tellurium sensitizer, a gold sensitizer, a platinum sensitizer, an iridium sensitizer, or a combination of two or more of these sensitizers, as is described in Research Disclosure No. 12008, Vol. 120, April 1974, Research Disclosure No. 13452, Vol. 34, June 1975, U.S. Pat. Nos. 2,624,361, 3,297,446, 3,772,031, 3,857,711, 3,901,714, 4,266,018 and 3,904,415, and British Patent 1,315,755.

The core grains should better be Chemically sensitized in the presence of a gold compound and a thiocyanate compound, in the presence of a sulfur-containing compound of the type disclosed in U.S. Pat. Nos. 3,857,711, 4,266,018 and 4,054,457, or in the presence of a sulfur-containing compound such as a hypo, a thioureic compound or rhodaninic compound, at silver potential (SCE) of 0 mV to +120 mV, preferably +60 mV to +120 mV. Also is it recommendable to raise the silver potential, thus decreasing the aAg value, not only to effectively promote the chemical sensitization to impart high sensitivity to the grains, but also to reduce the amount of the chemical sensitizer remaining up until the shell-forming step, thereby to decrease the surface sensitivity below the inner sensitivity of the grains.

In the present invention, chemical sensitization can be performed in the presence of a chemical sensitizing aid. Used as chemical sensitizing aid is a compound known to decrease fog and increase sensitivity during the chemical sensitization, such as azapyridadine or azapyrimidine. Various methods of modifying chemical sensitizing aid are described in U.S. Pat. Nos. 2,131,038, 3,411,914 and 3,554,757, JP-A-58-126516, and G. F. Duffin, "Photographic Emulsion Chemistry," Focal Press, 1966, pp. 136–143. In addition to, or in place of, the chemical sensitization, reduction sensitization using, for example, hydrogen, can be carried out, as is described in U.S. Pat. Nos. 3,891,446 and 3,984,249. Further, the core grains can be reduction-sensitized with stannous chloride, thiourea dioxide or polyamine, or can be reduction-sensitized in a high-pH condition (pH value of, for example, greater than 8), as is disclosed in U.S. Pat. Nos. 2,518,698, 2,743,182 and 2,743,183. Also, the core grains can be subjected to the chemical sensitization disclosed in U.S. Pat. Nos. 3,917,485 and 3,966,476 to have their color sensitivity enhanced.

The sensitization described in JP-A-61-3134 or JP-A-61-3136, wherein an oxidizer is used, can be applied to the present invention.

A silver halide, such as silver iodobromide, silver iodochlorobromide or silver chloroiodobromide, can be used in the silver halide photographic emulsion of the present invention. The silver halide is preferably silver iodobromide or silver chloroiodobromide, which contains about 30 mol % or less of silver iodide. Particularly preferable is silver iodobromide containing about 0.5 mol % to about 15 mol %, preferably 1.5 mol % to 5 mol %, of silver iodide.

The silver iodide distribution in each grain may be uniform. Alternatively, the grain may be formed of parts having different halogen compositions; it may be multilayered. Emulsion grains of such types are disclosed in, for example, British Patent 1,027,146, U.S. Pat. Nos. 3,505,068 and 4,444,877, and JP-A-60-143331.

In the case of an emulsion having such silver iodide distribution that the silver iodide content in the surface of each grain is lower than the average silver iodide content of the grain, the surface of the grain has high solubility, and an image formed in the inner part of the grain is easy to develop. Hence, this emulsion is preferably used. For the same reason, grains each having high silver chloride content in the surface is preferred.

The silver iodide distribution in each grain may have one or more maximum values. The silver iodide content at the maximum value is preferably 2 or more times the average silver iodide content of all grains, more preferably 4 or more times. Most preferably, the silver halide content at the maximum value is 100%.

The greater the gradient of the silver iodide content toward the maximum value, the better. In an extreme case, the grain may have an epitaxial junction. Each of the grains of the present invention may be jointed to silver halide having a different composition, by means of epitaxial junction. It may be jointed to a compound other than silver halide, such as silver rhodanide or lead oxide. Emulsion grains of these types are disclosed in, for example, U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

The silver halide grains may be either fine ones having a diameter of about 0.1 micron or less, or large ones having a projected-area diameter of about 10 microns at most. The emulsion may be a monodispersed one having a narrow distribution, or one having a broad distribution. A monodispersed emulsion is preferred since it improves graininess.

A typical example of a monodispersed emulsion is one in which grains having diameters 40% greater or less than the average diameter occupy at least 95% of the total weight of all grains contained in the emulsion. Usable as a monodispersed emulsion in the present invention is an emulsion in which grains have an average diameter of 0.05 to 3 microns, and the grains occupying at least 95% of the total weight of all grains or occupying at least 95% in number have diameters 20% greater or less than the average diameter. Methods of manufacturing emulsions of this type are disclosed in, for example, U.S. Pat. Nos. 3,574,628 and 3,655,394, and British Patent 1,413,748. Also, monodispersed emulsions of the type disclosed in JP-A-48-8600, JP-A-51-39027, JP-A-51-83097, JP-A-53-137133, JP-A-54-48521, JP-A-54-99419, JP-A-58-37635, and JP-A-58-49938 can preferably be used in the present invention.

The silver halide emulsion for use in the present invention may have any grain size distribution. Nonetheless, it is desirable that the grain size distribution have a relative standard deviation of 20% or less, preferably 10% or less.

(4) According to the present invention, the methine compound of the formula (I) is added at 50° C. or more, in any step, from the preparation of the emulsion to the coating thereof, as will be described below in detail.

In the present invention, the temperature at which to add the methine compound represented by the formula (I) is preferably 50° C. to 90° C., more preferably 55° C. to 85° C., still more preferably 60° C. to 80° C. The time for which to maintain the temperature at 50° C. or more is preferably 1 minute or more, more preferably 2 minutes or more.

The methine compound represented by the formula (I) of the present invention can be added after dissolved in a known organic solvent such as methanol or ethanol. Alternatively, it can be added in the form of an aqueous solution or a gelatin dispersion system.

The methine compound of the formula (I) in the present invention performs its function if added to any layer of the light-sensitive material, that is coated with a silver halide emulsion. Preferable as the layer to which the compound should be added is, for example, a lower layer in the vicinity of the support.

The photographic emulsion for use in the present invention may be spectrally sensitized with both the methine compound of the formula (I) and other methine dyes or other dyes. Dyes which can be used are: cyanine dye, merocyanine dye, composite cyanine dye, composite merocyanine dye, holoporlar cyanine dye, hemicyanine dye, styryl dye, and hemioxonol dye. Of these, particular useful is any dye belonging to cyanine dye, merocyanine dye or composite merocyanine dye. In these dyes use can be made of any nucleus commonly used as basic heterocyclic nucleus in cyanine dyes. Examples of the nucleus are: pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus formed of any one of these nuclei and an aliphatic hydrocarbon ring fused to the nucleus; and a nucleus formed of any one of these nuclei and an aromatic hydrocarbon ring fused to the nucleus, such as indolenine nucleus, benzoindolenine nucleus, indole nucleus, benzoxazole nucleus, naphthoxazole nucleus, benzothiazole nucleus, naphthothiazole nucleus, benzoselenazole nucleus, benzimidazole nucleus, or quinoline nucleus. Any one of these nuclei may be substituted on a carbon atom.

A nucleus having ketomethylene structure can be applied to merocyanine dye or composite merocyanine dye. Examples of this nucleus are 5- or 6-membered heterocylic nuclei such as pyrazoline-5-one nucleus, thiohydantoin nucleus, 2-thioxazolidine-2,4-dione nucleus, thiazolidine-2,4-dione nucleus, rhodanine nucleus, and thiobarbituric acid nucleus.

Methine compounds represented by the formula (I) of the present invention can be used, either singly or in combination. In many cases, they are used in combination, for achieving supersensitization, as is disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,769,301, 3,814,609, 3,837,862, 4,026,707, British Patents 1,344,281 and 1,507,803, JP-B-43-49336, JP-B-53-12375, JP-A-52-110618, and JP-A-52-109925.

The emulsion may contain, along with the methine compound of the formula (I) of the present invention, a dye which has no function of performing spectral sensitization, or a substance which not absorbs substantially visible light and which performs supersensitization.

The methine compound of the formula (I) of the present invention may be added to the emulsion in any step of the method of preparing the emulsion, that has been hitherto known as suitable timing. In most cases, the compound is added after the completion of chemical sensitization and before the coating of the emulsion. The compound can be added simultaneously with the chemical sensitizer, so that the spectral sensitization is performed at the same time as the chemical sensitization, as is described in U.S. Pat. Nos. 3,628,969 and 4,225,666. Alternatively, it can be added before the chemical sensitization, as is described in JP-A-58-113,928, or before the completion of the forming of silver halide grains by means of precipitation. Still alternatively, the methine compound can be added in parts as is disclosed in U.S. Pat. No. 4,225,666—that is, two parts of the compound can be added before and after the chemical sensitization, respectively. Also, as is described in, for example, U.S. Pat. No. 4,183,756, the methine compound can be added at any time during the forming of silver halide grains.

The methine compound of the formula (I) of the present invention can be added in an amount of $4\times10^{-6}$ to $8\times10^{-3}$ mol per mol of silver halide. If the silver halide grains have sizes ranging from 0.2 to 1.2 μm, the methine compound should better be added in an amount of about $5\times10^{-5}$ to $2\times10^{-3}$ mol per mol of silver halide.

The monodispersed silver halide emulsion of the present invention can be prepared by the method disclosed in JP-A-54-48521. In this method, it is desirable that a potassium iodide-gelatin aqueous solution and an ammoniated silver nitrate aqueous solution be added to a gelatin aqueous solution containing silver halide grains, at a rate being varied as a function of time. A highly monodispersed silver halide emulsion can be obtained by controlling the time function for the rate of adding the aqueous solutions, the pH value, the pAg value, the temperature, and the like. This is detailed in, for example, Photographic Science and Engineering, Vol. 6, pp. 159–165 (1962), Journal of Photographic Science, Vol. 12, pp. 242–251 (1964), U.S. Pat. No. 3,655,394, and British Patent 1,413,748.

The photographic emulsion used in the present invention can contain various compounds to prevent fogging from occurring during the manufacture, storage or processing of the light-sensitive material. More precisely, compounds known as antifoggants and stabilizing agents can be added to the emulsion. Examples of these compounds are: azoles such as benzothiazolium salt, nitroimidazole, nitrobenzimidazole, chlorobenzimidazole, bromobenzimidazole, mercaptothiazole, mercaptobenzothiazole, mercaptobenzimidazole, mercapotthiadiazole, aminotriazole, benzotriazole, nitrobenzotriazole, mercaptotetrazole (particularly, 1-pheny-5-mercaptotetrazole); mercaptopyrimidines; mercaptotriazines; thioketo compounds such as oxadolinethione; azaindenes such as triazaindene, tetraazaindene (particuarly, 4-hydroxy-substituted (1, 3, 3a, 7) tetraazaindenes) and pentaazaindene. Specific examples of these compounds, and methods of using them are disclosed in, for example, U.S. Pat. Nos. 3,954,474 and 3,982,947, and JP-B-52-28660.

Various additives other than those specified above can also be added to the light-sensitive material according to the present invention, in accordance with various purposes. Further, sensitizing dyes or supersensitizers, all falling outside the scope of the present invention, can be used together with these additives.

More specifically, these additives are described in Research Disclosure No. 17643 (December 1978) and Research Disclosure No. 18716 (November 1979), as will be specified in the following table:

| Additives | RD17643 | RD18716 |
|---|---|---|
| 1. Chemical sensitizers | page 23 | page 648, right column |
| 2. Sensitivity increasing agents | | page 648, right column |
| 3. Spectral sensitizers, super sensitizers | pp. 23–24 | page 648, right column to page 649, right column |
| 4. Brighteners | page 24 | page 647, right column |
| 5. Antifoggants and stabilizers | pp. 24–25 | page 649, right column |
| 6. Light absorbent, filter dye, ultra-violet absorbents | pp. 25–26 | page 649, right column to page 650, left column |
| 7. Stain preventing agents | page 25, right column | page 650, left to right columns |
| 8. Dye image stabilizer | page 25 | page 650, left column |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pp. 26–27 | page 650, right column |
| 13. Antistatic agents | page 27 | page 650, right column |

Various color couplers can be used in the present invention, and specific examples of these couplers are described in patents described in above-mentioned Research Disclosure (RD), No. 17643, VII-C to VII-G.

Preferable examples of a yellow coupler are those described in, for example, U.S. Pat. Nos. 3,933,501, 4,022,620, 4,326,024 and 4,401,752, JP-B-58-10739, British Patents 1,425,020 and 1,476,760.

Examples of a magenta coupler are preferably 5-pyrazolonic and pyrazoloazolic compounds, and more preferably, compounds described in, e.g., U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24220 (June 1984), JP-A-60-43659, U.S. Pat. Nos. 4,500,630 and 4,540,654.

Examples of a cyan coupler are phenolic and naphtholic couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Application (OLS) 3,329,729, European Patent 121,365A, U.S. Pat. Nos. 3,446,622, 4,333,999, 4,451,559 and 4,427,767, and European Patent 161,626A.

Preferable examples of a colored coupler for correcting additional, undesirable absorption of a colored dye are those described in Research Disclosure No. 17643, VII-G, U.S. Pat. Nos. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, European Patent 96,570, and West German Patent Application (OLS) No. 3,234,533.

Typical examples of a polymerized dye-forming coupler are described in, for example, U.S. Pat. Nos. 3,451,820, 4,080,211, 4,367,282 and 4,409,320, and British Patent 2,102,173.

Couplers releasing a photographically useful residue upon coupling are preferably used in the present invention. DIR couplers, i.e., couplers releasing a development inhibitor are described in the patents cited in the above-described RD No. 17643, VII-F, JP-A-57-151944, JP-A-57-154234, JP-A-60-184248, and U.S. Pat. No. 4,248,962.

Preferable examples of a coupler for imagewise releasing a nucleating agent or a development accelerator are described in British Patents 2,097,140 and 2,131,188, JP-A-59-157638, and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound, described in, e.g., JP-A-60-185950 and JP-A-62-24252; couplers releasing a dye which turns to a colored form after being released, described in European Patent 173,302A; a coupler releasing a bleaching accelerator, described in RD No. 11449, RD No. 24241, and JP-A-61-201247; a legand releasing coupler described in, e.g., U.S. Pat. No. 4,553,477.

The couplers for use in the present invention can be added to the light-sensitive material by various known dispersion methods.

Examples of a high-boiling organic solvent to be used in the oil-in-water dispersion method are described in e.g. U.S. Pat. No. 2,322,027.

Examples of a high-boiling organic solvent to be used in the oil-in-water dispersion method and having a boiling point of 175° C. or more at atmospheric pressure are phthalic acid esters (e.g., dibutylphthalate, dicyclohexylphthalate, di-2-ethylhexylphthalate, decylphthalate, bis(2,4-di-t-amylpheny) phthalate, bis(2,4-di-t-amylphenyl) isophthalate, bis(1,1-diethylpropyl) phthalate), phosphoric esters or phosphonic esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethyl hexylphenylphosphonate), benzoic esters (e.g., 2-ethyl hexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylic esters (e.g., bis(2-ethylhexyl) sebacate, dioctylazelate, glyceroltributylate, isostearyllactate, and trioctylcitrate), aniline derivatives (e.g., N,N-dibutyl-2-butoxy-5-tert-octylaniline), and hydrocarbons (e.g., paraffin, dodecylbenzene, and disopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of a laudable latex using for impregnation are described in, e.g., U.S. Pat. Nos. 4,199,363 and German Patent Application (OLS) Nos. 2,541,274 and 2,541,230.

The present invention can be applied to various color light-sensitive materials. Typical examples of the material are a color negative film for a general purpose or a movie, a color reversal film for a slide or a television, color paper, a color positive film, and color reversal paper. The present invention can attain advantages, too, if applied to black and white photographic light-sensitive materials, X-ray sensitive materials, and light-sensitive materials for printing.

The present invention can be applied to a light-sensitive material for use in color photography, which comprises light-sensitive materials having different compositions, and which contains a combination of multi-layer and special coloring materials.

Typical examples of this type of a light-sensitive material will be described. A light-sensitive material characterized by the use of color couplers in various layers, which have different coupling speeds and diffusibilities is disclosed in, for example, JP-B-47-49031, JP-B-49-3843, JP-B-50-21248, JP-A-59-58147, JP-A-59-60437, JP-A-60-227256, JP-A-61-4043, JP-A-61-43743, and JP-A-61-42657. A light-sensitive material characterized in that a layer sensitive to the same color is divided into two or more layers is disclosed in, for example, JP-B-49-15495 and U.S. Pat. No. 3,843,469. A light-sensitive material characterized by a specific arrangement of high- and low-sensitivity layers or a particular arrangement of layers sensitive to different colors is described in, for example, JP-B-53-37017, JP-B-53-37018, JP-A-51-49027, JP-A-52-143016, JP-A-53-97424, JP-A-53-97831, JP-A-62-200350, and JP-A-59-177551.

A support which can be suitably used in the present invention is described in, for example, RD. No. 17643, page 28, and RD. No. 18716, from the right column, page 647 to the left column, page 648.

The color photographic light-sensitive material according to the present invention can be developed by conventional methods described in RD. No. 17643, pp. 28 and 29, and RD. No. 18716, the left to right columns, page 651.

A color developer used in development of the light-sensitive material of the present invention is an aqueous alkaline solution containing as a main component, preferably, an aromatic primary aminic color developing agent. As the color developing agent, although an aminophenolic compound is effective, a p-phenylenediaminic compound is preferably used. Typical examples of the p-phenylenediaminic compound are: 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamide ethylaniline, 3-methyl-4-amino-N-ethyl-N-$\beta$-methoxyethylaniline, and sulfates, hydrochlorides and p-toluenesulfonates thereof. These compounds can be used in a combination of two or more thereof in accordance with the application.

In general, the color developer contains a pH buffering agent such as a carbonate, a borate, or a phosphate of an alkali metal, and a development restrainer or an antifoggant such as a bromide salt, an iodide salt, a benzimidazole, a benzothiazole, or a mercapto compound. If necessary, the color developer may also contain a preservative such as hydroxylamine, diethylhydroxylamine, a hydrazine sulfite, a phenylsemicarbazide, triethanolamine, a catechol sulfonic acid, or triethylenediamine(1,4-diazabicyclo[2,2,2] octane; an organic solvent such as ethyleneglycol or diethyleneglycol; a development accelerator such as benzylalcohol, polyethyleneglycol, a quaternary ammonium salt or an amine a dye-forming coupler; a competing coupler; a fogging agent such as sodium boron hydride; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black and white development is performed and then color development is performed. As a black and white developer, well-known black and white developing agents, e.g., a dihydroxybenzene such as hydroquinone, a 2-pyrazolidone such as 1-phenyl-3-pyrazolidone, and an aminophenol such as N-methyl-p-aminophenol can be singly or in a combination of two or more thereof.

The pH of the color and black and white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air. Also, the replenishment amount can be reduced by using means for suppressing the accumulation of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), cobalt(III), cromium(VI), a copper(II), peroxides; quinones; and a nitro compound. Typical examples of the bleaching agent are: ferricyanide compound; dichromate; an organic complex salt of iron(III) or cobalt(III) with an aminopolycarboxylic acid such as ethylenediaminetetraacetic acid, diethylenetriaminepentaacetic acid, cyclohexanediamine- tetraacetic acid, methyliminodiacetic acid, 1,3-diaminopropanetetraacetic acid, and glycoletherdiamine tetraacetic acid, and of citric acid, tartaric acid, or malic acid; persulfate; bromate; permanganate; or nitrobenzenes. Of these compounds, an iron(III) complex salt of aminopolycarboxylic acid such as an iron(III) complex salt of ethylenediaminetetraacetic acid, and persulfate are preferred because they can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 5.5 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17129 (July, 1978); a thiazolidine derivative described in JP-A-50-140129; thiourea derivatives disclosed in JP-B-45-8506, JP-A-52-20832, JP-A-53-32735, and U.S. Pat. No. 3,706,561; iodide salts described West German Patent 1,127,715 and JP-A-58-16235; poly oxyethylene compounds descried in West German Patents 977,410 and 2,748,730; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light- sensitive material. These bleaching accelerators are useful especially in bleach-fixing of a photographic color light-sensitive material.

Examples of the fixing agent are thiosulfate, a thiocyanate, a thioetheric compound, a thiourea and a large amount of an iodide salts. Of these compounds, a thiosulfate, especially, ammonium thiosulfate can be used in the widest range of applications. As a preservative of the bleach-fixing solution, a sulfite, a bisulfite, or a carbonyl bisulfite adduct is preferred.

The silver halide photographic color light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorinic germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing formalin and a surface-active agent to be used as a final bath of the photographic color light-sensitive material.

Various chelating agents and various antifungal agents can be added to this stabilizing bath.

An overflow solution produced upon washing and/or replenishment of the stabilizing solution can be reused in another step such as a desilvering step.

The silver halide color light sensitive material of the present invention may contain a color developing agent in order to simplify processing and increases a processing speed. For this purpose, various types of precursors of a color developing agent can be preferably used. Examples of the precursor are an indoanilinic compound described in U.S. Pat. No. 3,342,597, Schiff base compounds described in U.S. Pat. No. 3,342,599 and Research Disclosure (RD) Nos. 14850 and 15159, an aldol compound described in RD No. 13924, a metal salt complex described in U.S. Pat. No. 3,719,492, and an urethanic compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature. Also, to save silver in the light-sensitive material, a process using cobalt intensification or perhydroxide intensification may be performed, as is described in West German Patent 2,226,770 or U.S. Pat. No. 3,674,499.

The silver halide light-sensitive material of the present invention can be applied to thermal development light-sensitive materials described in, for example, U.S. Pat. No. 4,500,626, JP-A-60-133449, JP-A-59-218443, JP-A-61-238056, and EP 210,660A2.

EXAMPLES

The present invention will be described in more detail below by way of its examples, but the present invention is not limited to these examples.

(1) Examples Using Regular Silver Halide Emulsions

Example 1

Preparation of Emulsions 1-1 to 1-11 a. Preparation of Non-Ripened Emulsion 1

A silver nitrate aqueous solution and an aqueous solution containing KBr and KI were added by double jet method to a gelatin aqueous solution maintained at 70° C., whose pBr value was maintained at 4.5. As a result, non-ripened emulsion 1 was prepared which had an average grain size of 0.4 μm and an average silver iodide content of 4.0 mol %.

b. Preparation of Non-Ripened Emulsion 2

A silver nitrate aqueous solution was added by single jet method to a gelatin aqueous solution containing potassium promide and potassium iodide, maintained at 70° C. As a result, non-ripened emulsion 2 was prepared, which had an average grain size of 0.4 μm and an average silver iodide content of 4.0 mol %.

c. Preparation of Non-Ripened Emulsion 3

Non-ripened emulsion 3 was prepared in the same way as non-ripened emulsion 1, except that the gelatin aqueous solution was maintained at 60° C. Non-ripened emulsion 3 had an average grain size of 0.3 μm and an average silver iodide content of 4.0 mol %.

d. Preparation of Non-Ripened Emulsion 4

Non-ripened emulsion 4 was prepared in the same way as non-ripened emulsion 2, except that the gelatin aqueous solution was maintained at 60° C. Non-ripened emulsion 4 had an average grain size of 0.3 μm and an average silver iodide content of 4.0 mol %.

Non-ripened emulsions 1 to 4, thus prepared, were optimally gold sulfur sensitized with sodium thiosulfate and sodium chloroaurate. Further, the sensitizing dyes specified in the following Table were added to the sensitized emulsions. As a result, there were prepared emulsions 1-1 to 1-11, the particulars of which are shown in Table 1, too.

TABLE 1

| Emulsion | Non-ripened emulsion | Sensitizing dye | Grain size (μm) | Relative standard deviation (%) |
|---|---|---|---|---|
| 1-1 (Comparative) | 1 | S-1/S-2 | 0.4 | 9.3 |
| 1-2 (Comparative) | 1 | S-9/S-2 | 0.4 | 9.3 |
| 1-3 (Invention) | 1 | I-1/S-2 | 0.4 | 9.3 |
| 1-4 (Invention) | 1 | I-2/S-2 | 0.4 | 9.3 |
| 1-5 (Invention) | 1 | I-4/S-2 | 0.4 | 9.3 |
| 1-6 (Comparative) | 2 | I-1/S-2 | 0.4 | 23.4 |
| 1-7 (Comparative) | 2 | I-4/S-2 | 0.4 | 23.4 |
| 1-8 (Comparative) | 3 | S-1/S-2 | 0.3 | 10.2 |
| 1-9 (Invention) | 3 | I-1/S-2 | 0.3 | 10.2 |
| 1-10 (Comparative) | 4 | I-1/S-2 | 0.3 | 24.2 |
| 1-11 (Control) | 1 | Not added | 0.3 | 9.3 |

Each of emulsions 1-1 to 1-11 were coated in an amount of 2 μg per square centimeter, thus forming coated samples.

The coated samples were exposed for 1/100 second to 1000-lux light applied through a blue or minus blue filter (SC-39), and were then developed by using the process solution which had the composition specified below:

| Process Solution | |
|---|---|
| 1-phenyl-3-pyrazolidone | 0.5 g |
| Hydroquinone | 10 g |
| Disodium ethylenediamine tetraacetate | 2 g |
| Potassium sulfite | 60 g |
| Boric acid | 4 g |
| Potassium carbonate | 20 g |
| Sodium bromide | 5 g |
| Diethylene glycol | 20 g |
| pH (adjusted with sodium hydroxide) | 10.0 |
| Water to make | 1 liter |

The samples, thus processed, were subjected to sensitometry, thereby determining their sensitivities, each being a relative value based on the reference value of 100, i.e., the reciprocal of the exposure amount which provided a density of fog+0.1 when the emulsion 1-1 was exposed to light applied through a minus blue filter.

The color-stain of each sample was evaluated in terms of the difference between the magenta stain density of the sample and that of the control sample.

The blue sensitivities, minus-blue sensitivities, and color-stains of the samples, thus measured, were as is shown in the following Table 2:

TABLE 2

| Emulsion | Blue sensitivity | Minus-blue sensitivity | Color-stain |
|---|---|---|---|
| 1-1 (Comparative) | 40 | 100 | 0.25 |
| 1-2 (Comparative) | 47 | 103 | 0.12 |
| 1-3 (Invention) | 48 | 114 | 0.00 |
| 1-4 (Invention) | 47 | 113 | 0.00 |
| 1-5 (Invention) | 48 | 114 | 0.00 |
| 1-6 (Comparative) | 39 | 104 | 0.00 |
| 1-7 (Comparative) | 38 | 103 | 0.01 |
| 1-8 (Comparative) | 34 | 93 | 0.26 |
| 1-9 (Invention) | 41 | 104 | 0.02 |
| 1-10 (Comparative) | 26 | 91 | 0.03 |

As is evident from Table 2, if the structure of the present invention is used, there will be formed silver halide photographic emulsions which excel in intrinsic sensitivity (i.e., the blue sensitivity) and color-sensitization sensitivity (i.e., the minus-blue sensitivity), and which have but very little color-stain.

Example 2

Forming of Sample 101

A multilayered color light-sensitive material constituted by layers having the following compositions was formed on an undercoated 127 μm thick triacetylcellulose film support, thereby obtaining Sample 101. Numerals indicate an addition amount per $m^2$. Note that the effects of the added compounds are not limited to those described here.

| | |
|---|---|
| Layer 1: Antihalation layer | |
| Black colloidal silver | silver 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Dispersed fine crystals in dye E-1 | 0.1 g |
| Layer 2: Interlayer | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.4 mg |
| Layer 3: Interlayer | |
| Surface-fogged and internally fogged fine grain silver iodobromide emulsion (average grain size = 0.06 μm, variation coefficient: 18%, AgI content: 1 mol %) | silver 0.05 g |
| Gelatin | 0.4 g |
| Layer 4: Low red-sensitive emulsion layer | |
| Emulsion specified in Table 5 | silver 0.5 g |
| Surface-fogged and internally fogged fine grain silver iodobromide emulsion (average grain size = 0.06 μm, variation coefficient: 18%, AgI content: 1.0 mol %) | silver 0.05 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Layer 5: Medium red-sensitive emulsion layer | |
| Emulsion specified in Table 5 | silver 0.5 g |
| Surface-fogged and internally fogged fine grain silver iodobromide emulsion (average grain size = 0.06 μm, variation coefficient: 18%, AgI content: 1.0 mol) | silver 0.05 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Layer 6: High red-sensitive emulsion layer | |
| Emulsion A-1 | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Layer 7: Interlayer | |
| Gelatin | 0.6 g |
| Additive M-1 | 0.3 g |
| Color-mixing inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye D-1 | 0.02 g |
| Compound Cpd-C | 5 mg |
| Compound Cpd-J | 5 g |
| Compound Cpd-K | 5 g |
| High-boiling organic solvent Oil-1 | 0.02 g |
| Layer 8: Interlayer | |
| Surface-fogged and internally fogged silver iodobromide emulsion (average grain size: 0.06 μm, variation coefficient: 16%, AgI content: 0.3 mol %) | silver 0.02 g |
| Gelatin | 1.0 g |
| Additive P-1 | 0.2 g |
| Color-mixing inhibitor Cpd-A | 0.1 g |
| Layer 9: Low green-sensitive emulsion layer | |
| Emulsion B-1 | silver 0.1 g |
| Emulsion C-1 | silver 0.2 g |
| Emulsion D-1 | silver 0.2 g |
| Surface-fogged and internally fogged fine grain silver iodobromide emulsion (average grain size = 0.06 μm, variation coefficient: 18%, AgI content: 1 mol %) | silver 0.05 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |

-continued

| | |
|---|---|
| High-boiling organic solvent Oil-1 | 0.1 g |
| High-boiling organic solvent Oil-2 | 0.1 g |
| Layer 10: Medium green-sensitive emulsion layer | |
| Emulsion D-1 | silver 0.3 g |
| Emulsion E-1 | silver 0.1 g |
| Surface-fogged and internally fogged fine grain silver iodobromide emulsion (average grain size = 0.06 μm, variation coefficient: 18%, AgI content: 1 mol %) | silver 0.05 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Layer 11: High green-sensitive emulsion layer | |
| Emulsion F-1 | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Layer 12: Interlayer | |
| Gelatin | 0.6 g |
| Layer 13: Yellow filter layer | |
| Yellow colloidal silver | silver 0.07 g |
| Gelatin | 1.1 g |
| Color-mixing inhibitor Cpd-A | 0.01 g |
| High-boiling organic solvent Oil-1 | 0.01 g |
| Dispersed fine crystals in dye E-2 | 0.05 g |
| Layer 14: Interlayer | |
| Gelatin | 0.6 g |
| Layer 15: Low blue-sensitive emulsion layer | |
| Emulsion G-1 | silver 0.6 g |
| Gelatin | 0.8 g |
| Coupler C-5 | 0.2 g |
| Coupler C-6 | 0.1 g |
| Coupler C-10 | 0.4 g |
| Layer 16: Medium blue-sensitive emulsion layer | |
| Emulsion H-1 | silver 0.4 g |
| Gelatin | 0.9 g |
| Coupler C-5 | 0.3 g |
| Coupler C-6 | 0.1 g |
| Coupler C-10 | 0.1 g |
| Layer 17: High blue-sensitive emulsion layer | |
| Emulsion I-1 | silver 0.4 g |
| Gelatin | 1.2 g |
| Coupler C-5 | 0.3 g |
| Coupler C-6 | 0.6 g |
| Coupler C-10 | 0.1 g |
| Layer 18: First protective layer | |
| Gelatin | 0.7 g |
| Ultraviolet absorbent U-1 | 0.02 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Layer 19: Second protective layer | |
| Colloidal silver | silver 0.1 mg |
| Fine grain silver iodobromide emulsion (average grain size: 0.06 μm; AgI content: 1 mol %) | silver 0.1 g |
| Gelatin | 0.4 g |

-continued

| | |
|---|---|
| Layer 20: Third protective layer | |
| Gelatin | 0.4 g |
| Polymethylmethacrylate (average grain size: 1.5 μm) | 0.1 g |
| Copolymer of methylmethacrylate and acrylic acid in the ratio of 4:6 (av. grain size: 1.5 μm) | 0.1 g |
| Silicone oil | 0.03 g |
| Surfactant W-1 | 3.0 mg |

The compounds used in forming Sample 101 will be identified by their names or chemical formulas, in Table A later presented.

In addition to the above compositions, additives F-1 to F-8 were added to all of the emulsion layers. Furthermore, in addition to the above compositions, a gelatin hardener H-1 and surfactants W-2 to W-4 for coating and emulsification were added to each layer.

Further, as antiseptic and mildewproofing agents, phenol, 1,2-benzisothiazoline-3-one, 2-phenoxyethanol, and phenethyl alcohol were added.

The silver iodobromide emulsions used in Sample 101 were as is specified in the following Table 3:

TABLE 3

| Emulsion | Features of grains | Average equivalent-sphere diameter (μm) | Variation coefficient (%) | AgI content (%) |
|---|---|---|---|---|
| A-1 | Tabular grain, average aspect ratio: 8.0 | 0.68 | 25 | 2.0 |
| B-1 | Monodispersed cubic grain | 0.20 | 17 | 4.0 |
| C-1 | Monodispersed cubic grain | 0.23 | 16 | 4.0 |
| D-1 | Monodispersed, cubic, internal latent image grain | 0.28 | 11 | 3.5 |
| E-1 | Monodispersed, cubic, internal latent image grain | 0.32 | 9 | 3.5 |
| F-1 | Tabular grain, average aspect ratio: 9.0 | 0.80 | 28 | 1.5 |
| G-1 | Monodispersed decahedral grain | 0.30 | 18 | 4.0 |
| H-1 | Monodispersed, tabular grain, average aspect ratio: 7.0 | 0.45 | 17 | 4.0 |
| I-1 | Monodispersed, tabular grain, average aspect ration: 10.0 | 0.55 | 13 | 4.0 |

Emulsions A-1 to I-1 were spectrally sensitized, each with a sensitizing dye specified in Table 4, used in the amount shown also in Table 4:

TABLE 4

| Emulsion | Sensitizing dye added | Amount (g) per mol of silver halide |
|---|---|---|
| A-1 | S-1 | 0.10 |
| | S-7 | 0.01 |
| B-1 | S-3 | 0.5 |
| | S-4 | 0.1 |
| C-1 | S-3 | 0.3 |
| | S-4 | 0.1 |
| D-1 | S-3 | 0.25 |
| | S-4 | 0.08 |
| | S-8 | 0.05 |
| E-1 | S-3 | 0.2 |
| | S-4 | 0.06 |
| | S-8 | 0.05 |

TABLE 4-continued

| Emulsion | Sensitizing dye added | Amount (g) per mol of silver halide |
|---|---|---|
| F-1 | S-3 | 0.3 |
| | S-4 | 0.07 |
| | S-8 | 0.1 |
| G-1 | S-6 | 0.2 |
| | S-5 | 0.05 |
| H-1 | S-6 | 0.2 |
| | S-5 | 0.05 |
| I-1 | S-6 | 0.15 |
| | S-5 | 0.04 |

Preparation of Samples 102 to 107

Samples 102 to 107 were formed, using the emulsions prepared in Example 1 in place of emulsions 1-1 and 1-8 used in Sample 101, as is specified in the following Table 5:

TABLE 5

| Emulsion | Emulsion in layer 4 | Emulsion in layer 5 |
|---|---|---|
| 101 (Comparative) | 1-8 | 1-1 |
| 102 (Comparative) | 1-8 | 1-2 |
| 103 (Invention) | 1-8 | 1-3 |
| 104 (Invention) | 1-9 | 1-3 |
| 105 (Comparative) | 1-10 | 1-6 |
| 106 (Invention) | 1-9 | 1-4 |
| 107 (Invention) | 1-9 | 1-5 |
| 108 (Invention) | 1-10 | 1-5 |
| 109 (Control) | 1-11 | 1-11 |

Samples 101 to 109, thus formed, were exposed for 1/100 second to white light applied through a gray wedge, at exposure amounts of 20 CMS, then were processed by the method specified below, and were subjected to sensitometry. The R sensitivities of these samples were thereby determined, each being a relative value based on the reference value of 100, i.e., the reciprocal of the exposure amount which imparted a cyan density of 0.1 to Sample 101.

Further, the color-remaining of each sample was evaluated in terms of the difference between the magenta stain density of the sample and that of the control sample (i.e., Sample 109).

The samples were also exposed, by using a wedge designed to measure granularity, whereby the granularity each sample had at density of 1.0 was measured.

The R sensitivities, color-remainings, and R granularity of the samples 8 were as is shown in the following Table 6.

TABLE 6

| Emulsion | R sensitivity | Color-remaining | R granularity |
|---|---|---|---|
| 101 (Comparative) | 100 | 0.34 | 0.023 |
| 102 (Comparative) | 102 | 0.23 | 0.032 |
| 103 (Invention) | 107 | 0.00 | 0.021 |
| 104 (Invention) | 112 | 0.00 | 0.020 |

TABLE 6-continued

| Emulsion | R sensitivity | Color-remaining | R granularity |
|---|---|---|---|
| 105 (Comparative) | 94 | 0.23 | 0.043 |
| 106 (Invention) | 110 | 0.02 | 0.023 |
| 107 (Invention) | 108 | 0.00 | 0.021 |
| 108 (Invention) | 107 | 0.01 | 0.020 |

As can be understood from Table 6, the use of the sensitizing dyes according to the present invention reduced color-remaining. Sample 105, however, has low sensitivity and poor graininess, through having color-stain reduced, in spite of the use of a multilayered, multi-crystal emulsion. Unless any sensitizing dye of the present invention is used, the sensitivity is low, and the color-remaining is not reduced, even if a mono-dispersed emulsion is used. Obviously, photographic light-sensitive materials which excel in sensitivity and graininess and which have a little color-remaining can be obtained only if the structure of the present invention is employed.

The steps of the process, described above, were as follows:

| Steps | Time | Temperature- |
|---|---|---|
| First developing | 6 min. | 38° C. |
| Washing | 2 min. | 38° C. |
| Reversing | 2 min. | 38° C. |
| Color Developing | 6 min. | 38° C. |
| Control | 2 min. | 38° C. |
| Bleaching | 6 min. | 38° C. |
| Fixing | 4 min. | 38° C. |
| Washing | 4 min. | 38° C. |
| Stabilization | 1 min. | 25° C. |

The compositions of the respective processing solutions were as follows.

| [First developing solution] | |
|---|---|
| Pentasodium nitrilo-N,N,N-trimethylene phosphonate | 2.0 g |
| Sodium sulfite | 30 g |
| Hydroquinone potassium monosulfonate | 20 g |
| Potassium carbonate | 33 g |
| 1-phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

The pH was adjusted by hydrochloric acid or potassium hydroxide.

| [Reversing solution] | |
|---|---|
| Pentasodium nitrilo-N,N,N-trimethylene phosphonate | 3.0 g |
| Stannous chloride dihydrate | 1.0 g |
| p-aminophenol | 0.1 g |
| Sodium hydroxide | 8 g |
| Glacial acetic acid | 15.0 ml |
| Water to make | 1000 ml |
| pH | 6.00 |

The pH was adjusted by hydrochloric acid or potassium hydroxide.

| [Color developing solution] | |
|---|---|
| Pentasodium nitrilo-N,N,N-trimethylene phosphonate | 2.0 g |
| Sodium sulfite | 7.0 g |
| Tripotassium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-(β-methane-sulfonamidoethyl)-3-methyl-4-aminoaniline sulfate | 11 g |
| 3,6-dithiaoctane-1,8-diol | 1 g |
| Water to make | 1000 ml |
| pH | 11.80 |

The pH was adjusted by hydrochloric acid or potassium hydroxide.

| [Control solution] | |
|---|---|
| Disodium ethylenediamine tetraacetate dihydrate | 8.0 g |
| Sodium sulfite | 12 g |
| 1-thioglycerol | 0.4 ml |
| Water to make | 1000 ml |

The pH was adjusted by hydrochloric acid or potassium hydroxide.

| [Bleaching solution] | |
|---|---|
| Disodium ethylenediamine tetraacetate dihydrate | 2.0 g |
| Ferric ammonium ethylenediamine tetraacetate dihydrate | 120 g |
| Potassium bromide | 100 g |
| Ammonium nitrate | 10 g |
| Water to make | 1000 ml |
| pH | 5.70 |

The pH was adjusted by hydrochloric acid or potassium hydroxide.

| [Fixing solution] | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted by hydrochloric acid or ammonia water.

| [Stabilizing Solution] | |
|---|---|
| Formalin (37%) | 5.0 ml |
| Polyoxyethylene-p-mono-nonylphenyl ether (av. polymerization degree: 10) | 0.5 ml |
| Water to make | 1000 ml |

EXAMPLE 3

The color photographic light-sensitive materials of Example 1 disclosed in JP-A-1-158431 were formed, by replacing the emulsions and sensitizing dyes used in layers 3 and 4 with the emulsions and sensitizing dyes of the present invention, in the same way as in Example 2 of the present invention. The light-sensitive materials, thus formed, were tested in the same way as in Example 2 of the present invention. These materials, which had the structure of Example 2 of the present invention, were found to achieve the object of the present invention.

(2) Examples Using Emulsions Containing Tabular Silver Halide Grains

Example 4

Preparation of Emulsions 2-1 to 2-5 a. Preparation of emulsion 2-1

First, potato-shaped silver iodobromide emulsion (AgI: 2 mol %) having an average grain size of 0.8 μm was prepared from silver nitrate, potassium bromide and potassium iodide, by means of ordinary ammonia method. The emulsion, thus prepared, was desilvered by ordinary flocculation, and was then optimally gold-sulfur sensitized with chloroauric acid and compound A-1 specified below. As a result, comparative emulsion 2-1 was prepared.

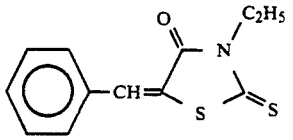

Compound A-1 b. Preparation of emulsion 2-2

An aqueous solution was prepared by dissolving 6 g of KBr and 30 g of inactive gelatin in 3.7 liters of distilled water. A 14% KBr aqueous solution and a 20% silver nitrate aqueous solution were added to said KBr-gelatin aqueous solution by double jet method at a predetermined rate over one minutes, while the KBr-gelatin solution was being stirred. This addition was performed at 55° C. and pBr value of 1.0. (During this addition I, 2.40% of all silver was consumed.) Then, 300 cc of 17% gelatin aqueous solution was added to the resultant solution, which was stirred at 55° C. Thereafter, 20% silver nitrate aqueous solution was added at a predetermined rate until the pBr value reached 1.40. (During this addition II, 5.0% of all silver was consumed.) Next, 20% KBr aqueous solution and 33% silver nitrate aqueous solution were added by double jet method over 42 minutes 51 seconds, while maintaining the temperature at 55° C. and the pBr value at 1.50. (During the addition III, 49.6% of all silver was consumed.) Then, solution containing 8.3 g of KI was added (addition IV). Further, 20% KBr aqueous solution and a 33% silver nitrate aqueous solution were added by double jet method over 37 minutes 9 seconds, while maintaining the temperature at 55° C. and the pBr value at 1.50. (During the addition V, 43% of all silver was consumed.) The total amount of silver nitrate, used in this emulsion, was 425 g. The result ant solution was desilvered by ordinary flocculation, and was subjected to optimal chemical sensitization using chloroauric acid and the compound A-1, thereby forming emulsion grains. The replica image of the emulsion grains was examined by means of a transmission electron microscope (TEM magnification: 3280). These grains were found to have an average diameter/thickness ratio of 6.5 and an equivalent-sphere diameter of 0.8 μm.

The chemical sensitization was optimized by adjusting the amounts of chloroauric acid and compound A-1 used for ripening, and also by controlling the temperature and time of ripening.

Preparation of emulsion 2-3

First, 27.5 cc of $AgNO_3$ aqueous solution (containing 32 g of $AgNO_3$, 0.7 g of gelatin having an average molecular weight of 20,000, 0.14 cc of $HNO_3$(1N), per 100 cc) and 27.5 cc of KBr aqueous solution (containing 0.7 g of gelatin having an average molecular weight of 20,000, per 100 cc) were added, each at the rate of 25 cc/min, to 1 liter of aqueous solution containing 6 g of gelatin having an average molecular weight of 20,000 and 4.5 g of KBr, while stirring the gelatin solution. The temperature was 30° C. Of this emulsion, 350 cc was used as seed crystals. To this part of the emulsion, there was added 650 cc of a gelatin aqueous solution (containing 20 g of gelatin and 1.2 g of KBr). The resultant solution was heated to 75° C. and was ripened for 40 minutes. Thereafter, $AgNO_3$ aqueous solution (containing 1.7 g of $AgNO_3$) was added over 1 minutes 30 seconds. Next, 6.2 cc of $NH_4NO_3$ aqueous solution (50 wt %) and 6.2 cc of $NH_3$ aqueous solution were added, and the resultant solution was ripened for 40 minutes. The pH value of the emulsion was changed to 7.0. Further, KBr 1 g was added, and $10^{-4}$ mol of compound K-1 specified below was added.

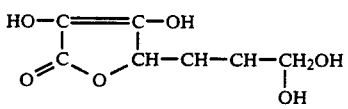

Compound K-1

Thereafter, $AgNO_3$ aqueous solution (containing 10 g of $AgNO_3$ per 100 cc) and KBr aqueous solution were added by means of CDJ addition at silver potential of −20 mV, at rate of 8 cc/min for the first 10 minutes and at rate of 15 cc/min for the next 20 minutes. This emulsion was washed with water, and re-dispersed.

Next, 620 g of this emulsion (containing 1.46 mol of Ag) was adjusted to a pH value of 7.1 and a pAg value of 8.8. To the emulsion, 1.1 mg of chloroauric acid and 1.7 mg of compound A-1 were added at the temperature of 55° C. The emulsion was chemically sensitized for 50 minutes, forming emulsion grains.

The replica image of the emulsion grains was examined by means of the transmission electron microscope (TEM magnification: 3280). These grains in the emulsion were found to have an average diameter of 0.8 μm, an average thickness of 0.12 μm, and an average aspect ratio of 6.7.

d. Preparation of emulsion 2-4

Emulsion 2-4 was prepared in the same way as emulsion 2-1 and 2-2, except that the addition of the $AgNO_3$ aqueous solution and the KBr aqueous solution was stopped upon adding 80% of the total amount of $AgNO_3$, the temperature was then set at 50° C., and 830 cc of KI aqueous solution was added for about 10 seconds.

e. Preparation of emulsion 2-5

Emulsion 2-5 was formed in the same way as emulsion 2-4, except that a KBr aqueous solution was added before the addition of the KI aqueous solution, and the silver potential was set at −60 mV.

The features of emulsions 2-1 to 2-5, thus prepared, were as is shown in the following Table 7:

TABLE 7

| Emulsion | Shape of grains | Variation coefficient (%) in grain size distribution | Ratio (%) of grains having 30 or more dislocations | Variation coefficient (%) in silver iodide content |
|---|---|---|---|---|
| 2-1 | Potato-shaped | 22 | 60 | 32 |
| 2-2 | tabular | 23 | 2 | 15 |
| 2-3 | tabular | 10 | 2 | 12 |
| 2-4 | tabular | 15 | 85 | 25 |
| 2-5 | tabular | 13 | 80 | 13 |

Preparatin of Samples 201 to 221

The sensitizing dyes shown in Table 8 were added to the emulsions immediately after the emulsions had been chemically sensitized. Dodecylbenzenesulfonate used as coading aid, and p-vinylbenzenesulfonate used as viscosity-imparting agent, a vinylsulfonic compound used as film hardener, and a polyethyleneoxidic compound used as agent for improving photograhic property were added to each emulsion. As a result, various coating emulsion solution were prepared. Subsequently, these solutions were uniformly coated on undercoated polyester supports, respectively. A surface protective layer, formed chiefly of a gelatin aqueous solution, was coated on each of the support already coated with a coating emulsion solution. Samples 201 to 221 were thereby formed, the amount of silver coated on each sample being 40 g/m², the amount of gelatin of protective layer coated thereon being 1.3 g/m², and the amount of gelatin of emulsion layer coated thereon being 2.7 g/m². The emulsions and the sensitizing dyes, all used in forming these samples, and the amounts in which the emulsions and dyes were used, were as is specified in Table 8.

TABLE 8

| Sample | Emulsion | Sensitizing dye | Amount (mg) of dye used per mol of silver halide | (logE) Relative sensitivity | Magenta stain density |
|---|---|---|---|---|---|
| 201 (Comparative) | 2-1 | — | — | — | 0.000 |
| 202 (Comparative) | 2-1 | S'-1 | 40 | −0.30 | 0.012 |
| 203 (Comparative) | 2-1 | S'-1 | 80 | +0.01 | 0.021 |
| 204 (Comparative) | 2-1 | S'-1 | 120 | −0.03 | 0.038 |
| 205 (Comparative) | 2-1 | S'-1 | 160 | −0.23 | 0.048 |
| 206 (Comparative) | 2-5 | S'-1 | 40 | +0.05 | 0.014 |
| 207 (Comparative) | 2-5 | S'-1 | 80 | +0.18 | 0.026 |
| 208 (Comparative) | 2-5 | S'-1 | 120 | +0.28 | 0.042 |
| 209 (Comparative) | 2-5 | S'-1 | 160 | +0.22 | 0.070 |
| 210 | 2-5 | I-1 | 40 | +0.08 | 0.001 |

TABLE 8-continued

| Sample | Emulsion | Sensitizing dye | Amount (mg) of dye used per mol of silver halide | (logE) Relative sensitivity | Magenta stain density |
|---|---|---|---|---|---|
| (Invention) 211 | 2-5 | I-1 | 80 | +0.23 | 0.003 |
| (Invention) 212 | 2-5 | I-1 | 120 | +0.35 | 0.005 |
| (Invention) 213 | 2-5 | I-1 | 160 | +0.31 | 0.007 |
| (Invention) 214 | 2-1 | I-1 | 80 | −0.01 | 0.004 |
| (Comparative) 215 | 2-5 | I-2 | 120 | +0.33 | 0.006 |
| (Invention) 216 | 2-5 | I-22 | 120 | +0.32 | 0.004 |
| (Invention) 217 | 2-5 | I-19 | 120 | +0.34 | 0.005 |
| (Invention) 218 | 2-5 | I-30 | 120 | +0.31 | 0.003 |
| (Invention) 219 | 2-2 | I-1 | 120 | +0.29 | 0.006 |
| (Invention) 220 | 2-3 | I-1 | 120 | +0.30 | 0.006 |
| (Invention) 221 | 2-4 | I-1 | 120 | +0.30 | 0.006 |
| (Invention) | | | | | |

Comparative sensitizing dye S'-1, which was used, will be specified as follows:

Comparative Sensitizing Dye S'-1

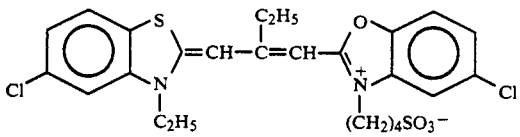

The experiment, described below, was conducted on Samples 201 to 221, thus formed, thereby evaluating these samples.

First, Samples 201 to 221 were exposed for 1/100 second to white light applied through a wedge, at exposure amount of 10 CMS, and then were processed at 20° C. for 4 minutes with the solution of the composition specified below. The samples were fixed, water-washed, and subjected to sensitometry. The color-remaining of each sample was evaluated by subtracting the magenta stain density of the sample containing no sensitizing dye from the magenta stain density of the sample.

| Process Solution | |
|---|---|
| 1-phenyl-3-pyrazolidone | 0.5 g |
| Hydroquinone | 10 g |
| Disodium ethylenediamine tetraacetate | 2 g |
| Potassium sulfite | 60 g |
| Boric acid | 4 g |
| Potassium carbonate | 20 g |
| Sodium bromide | 5 g |
| Diethylene glycol | 20 g |
| pH (adjusted with sodium hydroxide) | 10.0 |
| Water to make | 1 liter |

The relative sensitivities and magenta stain densities of the samples, thus measured, were as is shown in Table 8.

As is evident from Table 8, Samples 202 to 205, in which comparative sensitizing dye S'-1 was added to emulsion 2-1, had magenta stain densities of 0.010 or more, no matter how much the dye was added to emulsion 2-1. By contrast, Samples 206 to 209, in which sensitizing dye S'-1 was added to the tabular-grain emulsion 2-5, had high sensitivity. Of these samples, Sample 208 exhibited the highest sensitivity, because sensitivity dye S'-1 was added to emulsion 2-5 in an amount of 120 mg, greater than is added to emulsion 2-1. Sample 208, however, had much color-remaining of 0.042, and could not therefore be used in practice, though its sensitivity was higher than that of Sample 203. In other words, the effect of the tabular-grain emulsion was not sufficiently realized in Sample 208.

Sample 212, in which a sensitizing dye of the present invention is added in an optimal amount to emulsion 2-5, not only had sensitivity higher than that of Sample 208, but also had less color-stain (0.005). Obviously, Sample 212 is very desirable. This effect was remarkable in the samples using the tabular-grain emulsion of the present invention. This may be proved by the fact that Sample 214, in which sensitizing dye I-1 was added to emulsion 2-1, exhibited but a sensitivity lower by 0.36 than the sensitivity of Sample 212 of the present invention.

Samples 215 to 218, in which other sensitizing dyes of the present invention were added, achieved almost the same advantage.

Similar effect was realized in Samples 219 to 221 in which use was made of emulsions 2-2, 2-3, and 2-4, but the best effect was realized by using emulsion 2-5 which had an uniform distribution of grain size and an uniform inter-grain iodine content.

Example 5

Preparation of Sample 301

A multilayered color light-sensitive material constituted by layers having the following compositions was formed on an undercoated triacetylcellulose film support, thereby obtaining Sample 301.

Compositions of light-sensitive layers

Numerals corresponding to each component indicate a coating amount represented in units of g/m². The coating amount of a silver halide is represented by the coating amount of silver. The coating amount of a sensitizing dye is represented in units of moles per mole of a silver halide in the same layer.

| Sample 301 | | |
|---|---|---|
| Layer 1: Antihalation layer | | |
| Black colloidal silver | silver | 0.18 |
| Gelatin | | 1.40 |
| Magenta coupler ExM-1 | | 0.18 |
| Compound ExF-1 | | $2.0 \times 10^{-3}$ |
| Layer 2: Interlayer | | |
| Emulsion G-2 | silver | 0.065 |
| 2,5-di-t-pentadecyl-hydroquinone | | 0.18 |
| Cyan coupler C-12 | | 0.020 |
| Ultraviolet absorbent U-3 | | 0.060 |
| Ultraviolet absorbent U-4 | | 0.080 |
| Ultraviolet absorbent U-6 | | 0.10 |
| High-boiling organic solvent Oil-1 | | 0.020 |
| High-boiling organic solvent Oil-2 | | 0.10 |
| Gelatin | | 1.04 |
| Layer 3: Low red-sensitive emulsion layer | | |
| Emulsion A-2 | silver | 0.25 |
| Emulsion B-2 | silver | 0.25 |
| Sensitizing dye S-7 | | $6.9 \times 10^{-5}$ |
| Sensitizing dye S-10 | | $1.8 \times 10^{-5}$ |

-continued

Sample 301

| | | |
|---|---|---|
| Sensitizing dye S-11 | | $3.1 \times 10^{-4}$ |
| Cyan coupler C-11 | | 0.17 |
| Cyan coupler C-14 | | 0.17 |
| Cyan coupler C-17 | | 0.020 |
| Ultraviolet absorbent U-3 | | 0.070 |
| Ultraviolet absorbent U-4 | | 0.050 |
| Ultraviolet absorbent U-6 | | 0.070 |
| High-boiling organic solvent Oil-2 | | 0.060 |
| Gelatin | | 0.87 |
| Layer 4: Medium red-sensitive emulsion layer | | |
| Emulsion D-2 | silver | 0.80 |
| Sensitizing dye S-7 | | $3.5 \times 10^{-4}$ |
| Sensitizing dye S-10 | | $1.6 \times 10^{-5}$ |
| Sensitizing dye S-11 | | $5.1 \times 10^{-4}$ |
| Cyan coupler C-11 | | 0.20 |
| Cyan coupler C-12 | | 0.050 |
| Cyan coupler C-14 | | 0.20 |
| Cyan coupler C-15 | | 0.050 |
| Cyan coupler C-17 | | 0.015 |
| Ultraviolet absorbent U-3 | | 0.070 |
| Ultraviolet absorbent U-4 | | 0.050 |
| Ultraviolet absorbent U-6 | | 0.070 |
| Gelatin | | 1.30 |
| Layer 5: High red-sensitive emulsion layer | | |
| Emulsion E-2 | silver | 1.40 |
| Sensitizing dye S-7 | | $2.4 \times 10^{-4}$ |
| Sensitizing dye S-10 | | $1.0 \times 10^{-4}$ |
| Sensitizing dye S-11 | | $3.4 \times 10^{-4}$ |
| Cyan coupler C-11 | | 0.097 |
| Cyan coupler C-12 | | 0.010 |
| Cyan coupler C-13 | | 0.065 |
| Cyan coupler C-16 | | 0.020 |
| High-boiling organic solvent Oil-1 | | 0.10 |
| High-boiling organic solvent Oil-2 | | 0.22 |
| Gelatin | | 1.63 |
| Layer 6: Interlayer | | |
| Compound Cpd-1 | | 0.040 |
| High-boiling organic solvent Oil-1 | | 0.020 |
| Gelatin | | 0.80 |
| Layer 7: Low green-sensitive emulsion layer | | |
| Emulsion C-2 | silver | 0.30 |
| Sensitizing dye S-12 | | $2.6 \times 10^{-5}$ |
| Sensitizing dye S-13 | | $1.8 \times 10^{-4}$ |
| Sensitizing dye S-15 | | $6.9 \times 10^{-4}$ |
| Magenta coupler ExM-1 | | 0.021 |
| Magenta coupler ExM-2 | | 0.26 |
| Magenta coupler ExM-3 | | 0.030 |
| Yellow coupler ExY-1 | | 0.025 |
| High-boiling organic solvent Oil-2 | | 0.10 |
| High-boiling organic solvent Oil-4 | | 0.010 |
| Gelatin | | 0.63 |
| Layer 8: Medium green-sensitive emulsion layer | | |
| Emulsion D-2 | silver | 0.55 |
| Sensitizing dye S-12 | | $2.2 \times 10^{-5}$ |
| Sensitizing dye S-13 | | $1.5 \times 10^{-4}$ |
| Sensitizing dye S-14 | | $5.8 \times 10^{-4}$ |
| Magenta coupler ExM-2 | | 0.094 |
| Magenta coupler ExM-3 | | 0.026 |
| Yellow coupler ExY-1 | | 0.018 |
| High-boiling organic solvent Oil-2 | | 0.16 |
| High-boiling organic solvent Oil-4 | | $8.0 \times 10^{-3}$ |
| Gelatin | | 0.05 |
| Layer 9: High green-sensitive emulsion layer | | |

-continued

Sample 301

| | | |
|---|---|---|
| Emulsion E-2 | silver | 1.55 |
| Sensitizing dye S-12 | | $4.6 \times 10^{-5}$ |
| Sensitizing dye S-13 | | $1.0 \times 10^{-4}$ |
| Sensitizing dye S-14 | | $3.9 \times 10^{-4}$ |
| Cyan coupler C-11 | | 0.015 |
| Magenta coupler ExM-1 | | 0.013 |
| Magenta coupler ExM-4 | | 0.065 |
| Magenta coupler ExM-5 | | 0.019 |
| High-boiling organic solvent Oil-1 | | 0.10 |
| High-boiling organic solvent Oil-2 | | 0.25 |
| Gelatin | | 1.54 |
| Layer 10: Yellow filter layer | | |
| Yellow colloidal silver | silver | 0.035 |
| Compound Cpd-1 | | 0.080 |
| High-boiling organic solvent oil-2 | | 0.030 |
| Gelatin 1 | | 0.95 |
| Layer 11: Low blue-sensitive emulsion layer | | |
| Emulsion C-2 | silver | 0.18 |
| Sensitizing dye S-15 | | $8.6 \times 10^{-4}$ |
| Yellow coupler ExY-1 | | 0.042 |
| High-boiling organic solvent Oil-2 | | 0.28 |
| Gelatin | | 1.10 |
| Layer 12: Medium blue-sensitive emulsion layer | | |
| Emulsion D-2 | silver | 0.40 |
| Sensitizing dye S-15 | | $7.4 \times 10^{-4}$ |
| Cyan coupler C-15 | | $7.0 \times 10^{-3}$ |
| Yellow coupler ExY-2 | | 0.15 |
| High-boiling organic solvent Oil-2 | | 0.050 |
| Gelatin | | 0.78 |
| Layer 13: High blue-sensitive emulsion layer | | |
| Emulsion F-2 | silver | 0.70 |
| Sensitizing dye S-15 | | $2.8 \times 10^{-4}$ |
| Yellow coupler ExY-2 | | 0.20 |
| High-boiling organic solvent Oil-2 | | 0.070 |
| Gelatin | | 0.69 |
| Layer 14: First protective layer | | |
| Emulsion G-2 | silver | 0.20 |
| Ultraviolet absorbent U-5 | | 0.17 |
| Ultraviolet absorbent U-7 | | 0.11 |
| High-boiling organic solvent Oil-2 | | $5.0 \times 10^{-2}$ |
| Gelatin | | 1.00 |
| Layer 15: Second protective layer | | |
| Gelatin hardener H-1 | | 0.40 |
| Copolymer B-1 (diameter: 1.7 μm) | | $5.0 \times 10^{-2}$ |
| Copolymer B-2 (diameter: 1.7 μm) | | 0.10 |
| Copolymer b-3 | | 0.10 |
| Additive Cpd-H | | 0.20 |
| Gelatin | | 1.20 |

The compounds used in forming Sample 301 will be identified by their names or chemical formulas, in Table A later presented.

Further, W-1 to W-3, W-7, and W-8, B-4 to B-6, F-1 to F-17, iron salt, lead salt, gold salt, platinum salt, iridium salt, and rhodium salt were added to each layer, so that the sample might be more stable during storage, be processed more readily, be more resistant to pressure, more antifungal, more antibacterial, more antistatic, and be more readily coated.

The features of the emulsions used in Sample 301 will be specified in the following Table 9:

TABLE 9

| Emulsion | Average AgI content (%) | Average grain diameter (μm) | Variation coefficient in grain size (%) | Diameter/thickness ratio | Silver-amount ratio [core/intermediate layer/shell] (AgI content) | Grain structure/shape |
|---|---|---|---|---|---|---|
| A-2 | 4.0 | 0.45 | 27 | 1 | [1/3] (13/1) | Double structure, octahedral grain |
| B-2 | 8.9 | 0.70 | 14 | 1 | [3/7] (25/2) | Double structure, octahedral grain |
| C-2 | 2.0 | 0.55 | 25 | 7 | — | Uniform tabular grain |
| D-2 | 9.0 | 0.65 | 25 | 6 | [12/59/29] (0/11/8) | Triple structure, tabular grain |
| E-2 | 9.0 | 0.85 | 23 | 5 | [8/59/33] (0/11/8) | Triple structure, tabular grain |

TABLE 9-continued

| Emulsion | Average AgI content (%) | Average grain diameter (μm) | Variation coefficient in grain size (%) | Diameter/ thickness ratio | Silver-amount ratio [core/intermediate layer/shell] (AgI content) | Grain structure/shape |
|---|---|---|---|---|---|---|
| F-2 | 14.0 | 1.25 | 25 | 3 | [37/63] (34/3) | Double structure, tabular grain |
| G-2 | 1.0 | 0.07 | 15 | 1 | — | Uniform fine grain |

(1) Emulsions A-2 to F-2 had been reduction-sensitized with thiourea dioxide and thiosulfonic acid during the forming of grains, as in the embodiments described in JP-A-2-191938.

(2) Emulsions A-2 to F-2 had also been gold-sensitized, sulfur-sensitized, and selenium-sensitized in the presence of the spectral sensitizing dyes and sodium thiocyanate which were contained in the respective layers, as in the embodiments described in JP-A-3-237450 (corresponding to European Patent 443453A).

(3) The tabular grains were formed by the method disclosed in JP-A-1-158426, and low-molecular gelatin was used.

(4) Dislocation lines of the type described in JP-A-3-237450 (corresponding to European Patent 443453A) were observed, by means of a high-voltage electron microscope, in the tabular grains and the regular crystals grains having a grain structure.

Preparation of Samples 302 to 305

Samples 302 to 305 were formed by the same way as Sample 301, except that the sensitizing dyes specified in Table 10 were added to emulsions C-2 and D-2 in equimolar amounts, in place of the dyes used in Sample 301.

Samples 301 to 305, thus formed, were exposed for 1/100 second to white light applied through a gray wedge, at exposure amount of 20 CMS, then were processed by the method as will be specified below, and were subjected to sensitometry.

Further, the magenta stain density of each sample was evaluated by subtracting the magenta stain density of the sample containing no sensitizing dye from the magenta stain density of the sample. The magenta stain densities of Samples 301 to 305, thus measured, were as is shown in Table 10.

TABLE 10

| Sample | Layer | Emulsion | Sensitizing dye | Magenta stain density |
|---|---|---|---|---|
| 301 (Comparative) | 4 | D-2 | S-11 | 0.063 |
| | 7 | C-2 | S-14 | |
| | 8 | D-2 | S-14 | |
| | 11 | C-2 | S-15 | |
| | 12 | D-2 | S-15 | |
| 302 (Invention) | 4 | D-2 | I-1 | 0.021 |
| | 7 | C-2 | S-14 | |
| | 8 | D-2 | S-14 | |
| | 11 | C-2 | S-15 | |
| | 12 | D-2 | S-15 | |
| 303 (Invention) | 4 | D-2 | I-5 | 0.022 |
| | 7 | C-2 | S-14 | |
| | 8 | D-2 | S-14 | |
| | 11 | C-2 | S-15 | |
| | 12 | D-2 | S-15 | |
| 304 (Invention) | 4 | D-2 | S-11 | 0.032 |
| | 7 | C-2 | I-12 | |
| | 8 | D-2 | I-12 | |
| | 11 | C-2 | S-15 | |
| | 12 | D-2 | S-15 | |
| 305 (Invention) | 4 | D-2 | S-11 | 0.034 |
| | 7 | C-2 | S-14 | |
| | 8 | D-2 | S-14 | |
| | 11 | C-2 | I-13 | |

TABLE 10-continued

| Sample | Layer | Emulsion | Sensitizing dye | Magenta stain density |
|---|---|---|---|---|
| | 12 | D-2 | I-13 | |

Note: Sensitizing dyes S-7, 10, 12 and 13, not listed in Table 10, were added to Samples 301 to 305, each in the same amount as in Sample 201.

As is evident from Table 10, Samples 302 to 305, in which the sensitizing dyes of the present invention were added to tabular emulsions C-2 and D-2, had lower magenta stain densities than that of comparative Sample 301. Of these samples, Samples 302 and 303, wherein the sensitizing dyes of the present invention were used in the red-sensitive layers, exhibited very low magenta stain densities.

Example 6

Sample 401 was formed in the same way as Sample 101 of Example 1 described in JP-A-2-852, except that layer 9 contained sensitizing dye I-12 of the present invention is an equimolar amount, in place of sensitizing dye S-3. Sample 401 was exposed and developed with the process solutions specified below, in the same way as in Example 4. The results were similar to those achieved in Examples 4 and 5.

The method of processing the samples was as follows:

| Steps | Time | Temperature |
|---|---|---|
| Color developing | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Drying | 1 min. 15 sec. | 55° C. |

The compositions of the respective processing solutions were as follows.

| | (g) |
|---|---|
| (Color Developing Solution) | |
| Diethylenetriaminepentaacetic acid | 1.0 |
| 1-hydorxyethylidene-1,1-diphosphonic acid | 3.0 |
| Sodium sulfide | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxylethyl-amino]-2-methylaniline sulfate | 4.5 |
| Water to make | 1.0 l |
| pH | 10.05 |
| (Bleaching Solution) | |
| Ferric ammonium ethylendiamine tetraacetate dihydrate | 120.0 |
| Disodium ethylenediamine-tetraacetate | 10.0 |
| Ammonium bromide | 100.0 |
| Ammonium nitrate | 10.0 |
| Bleach accelerator, | 0.005 mol |

-continued

| | (g) |
|---|---|
| $(CH_3)_2N—CH_2—CH_2—S—S—CH_2—CH_2—N(CH_3)_2.2HCl$ | |
| Ammonia water (27%) | 15.0 ml |
| Water to make | 10.0 l |
| pH | 6.3 |
| (Bleach-Fixing Solution) | |
| Ferric ammonium ethylenediamine tetraacetate dihydrate | 120.0 |
| Disodium ethylenediamine-tetraacetate | 5.0 |
| Sodium sulfite | 12.0 |
| Ammonium thiosulfat aqueous solution (700 g/liter) | 240.0 ml |
| Ammonia water (27%) | 6.0 ml |
| Water to make | 1.9 l |
| pH | 7.2 |
| (Water-washing solution) | |

This was a solution prepared as follows. First, tap water was passed through a mixed-bed column filled with OH-type strong-base anion exchange resin (Amberlite IR-400, Rosh & Hass Co.) and H-type strong-acid cation exchange resin (Amberlite IR-120B, Rohm & Haas Co.), whereby the calcium and magnesium ions concentration of the water was reduced to 3 mg/l or less. Next, 20 mg/l of sodium dichloroisocyanurate and 1.5 g/l of sodium sulfate were added to the water thus processed, thereby obtaining the washing solution. The washing solution had pH value ranging from 6.5 to 7.5.

| (Stabilizing Solution) | (g) |
|---|---|
| Sodium p-toluenesulfinate | 0.03 |
| Polyoxyethylene-p-monononylphenylether (average polymerization degree: 10) | 0.2 |
| Disodium ethylenediamine tetraacetate | 0.05 |
| 1,2,4-triazole | 1.3 |
| 1,4-bis(1,2,4-triazole-1-ylmethyl)piperazine | 0.75 |
| Water to make | 1.0 liter |
| pH | 8.5 |

(3) Examples Using Emulsions Containing Internal Latent-Image Silver Halide Grains Example 7

1. Preparation of Emulsions 3-1 to 3-8 a. Reparation of emulsion 3-1

First, 800 cc of a 15% $AgNO_3$ aqueous solution and an aqueous solution containing 0.85 mol/liter of KBr and 0.031 mol/liter of KI were added over 60 minutes by double jet method to 1,560 cc of 3.4 gelatin aqueous solution maintained at 75° C., while maintaining the pH value at 6.8 and the silver potential (SCE) at +60 mV. As a result, monodispersed cubic core grains, each having edges 0.35 μm long, were formed. Next, 1.8 mg of compound A'-5 used as sulfur sensitizer, 1.1 mg of sodium chloroaurate used as gold sensitizer, 4.0 mg of compound A'-2, and 0.3 mg of compound A'-3 were added to the core grains, and chemical sensitization was carried out for 60 minutes at pH value of 6.8 and silver potential of +80 mV. The, 0.14 g of compound A'-1 and 0.3 g of compound A'-4 were added, and the temperature was lowered to 50° C. Further, 200 cc of 15% $AgNO_3$ aqueous solution and the aqueous solution containing 0.85 mol/liter of KBr and 0.031 mol/liter were added over 5 minutes at pH value of 6.8 and silver potential of +10 mV, thereby precipitating shells. As a result, monodispersed cubic grains were formed which had an average edge length of 0.38 μm and an average silver iodide content of 3.5 mol %. Soluble silver salt was removed from these grains by means of ordinary flocculation, thereby preparing internal latent-image emulsion 3-1 having pH and pAg values of 6.2 and 8.4, respectively. The variation coefficient of this emulsion, in terms of the distribution of gain size (i.e., edge length), was 8%. (Said variation was a value obtained by multiplying the ratio of the standard deviation of the distribution to the average distribution.) The gains thus formed had such crystal habit that (100) faces amounted to 92%, and (111) faces amounted to 8%.

The ratio of the latent image formed on the grain surface, which was measured by the method described above, was as is shown in the following Table 11. Compounds A'-1 to A'-5 used in preparing emulsion 3-1 will be specified below.

TABLE 11

| Sample | Emulsion | Depth of chemical sensitization site (measured from the grain surface) (μm) | Ratio of latent image formed on the grain surface | Sensitizing dye | Amount of dye added (mol/mol Ag) | Relative sensitivity | Magenta stain density |
|---|---|---|---|---|---|---|---|
| 400 (Comparative) | 3-8 (Surface latent-image emulsion) | 0 | 1.00 | — | — | — | 0.00 |
| 401 (Comparative) | 3-8 (Surface latent-image emulsion) | 0 | 1.00 | S-1 | $1.5 \times 10^{-6}$ | +0.00 | 0.031 |
| 402 (Comparative) | 3-8 (Surface latent-image emulsion) | 0 | 1.00 | S-1 | $2.0 \times 10^{-6}$ | −0.05 | 0.050 |
| 403 (Comparative) | 3-8 (Surface latent-image emulsion) | 0 | 1.00 | S-1 | $3.0 \times 10^{-6}$ | −0.12 | 0.065 |
| 404 (Comparative) | 3-1 (Internal latent-image emulsion) | 0.0135 | 0.40 | S-1 | $1.5 \times 10^{-6}$ | +0.18 | 0.032 |
| 405 (Comparative) | 3-1 (Internal latent-image emulsion) | 0.0135 | 0.40 | S-1 | $2.0 \times 10^{-6}$ | +0.20 | 0.051 |
| 406 (Comparative) | 3-1 (Internal latent-image emulsion) | 0.0135 | 0.40 | S-1 | $3.0 \times 10^{-6}$ | +0.14 | 0.067 |
| 407 (Invention) | 3-1 (Internal latent-image emulsion) | 0.0135 | 0.40 | I-1 | $1.5 \times 10^{-6}$ | +0.22 | 0.005 |
| 408 (Invention) | 3-1 (Internal latent-image emulsion) | 0.0135 | 0.40 | I-1 | $2.0 \times 10^{-6}$ | +0.24 | 0.007 |
| 409 (Invention) | 3-1 (Internal latent-image emulsion) | 0.0135 | 0.40 | I-1 | $3.0 \times 10^{-6}$ | +0.20 | 0.009 |

TABLE 11-continued

| Sample | Emulsion | Depth of chemical sensitization site (measured from the grain surface) (μm) | Ratio of latent image formed on the grain surface | Sensitizing dye | Amount of dye added (mol/mol Ag) | Relative sensitivity | Magenta stain density |
|---|---|---|---|---|---|---|---|
| 410 (Comparative | 3-8 (Surface latent-image emulsion) | 0 | 1.00 | I-1 | $2.0 \times 10^{-6}$ | −0.04 | 0.007 |
| 411 (Invention) | 3-1 (Internal latent-image emulsion) | 0.0135 | 0.40 | I-1 | $2.0 \times 10^{-6}$ | +0.24 | 0.007 |
| 412 (Invention) | 3-1 (Internal latent-image emulsion) | 0.0135 | 0.40 | I-5 | $2.0 \times 10^{-6}$ | +0.25 | 0.008 |
| 413 (Invention) | 3-1 (Internal latent-image emulsion) | 0.0135 | 0.40 | I-8 | $2.0 \times 10^{-6}$ | +0.23 | 0.005 |
| 414 (Invention) | 3-1 (Internal latent-image emulsion) | 0.0135 | 0.40 | I-12 | $2.0 \times 10^{-6}$ | +0.22 | 0.004 |
| 415 (Invention) | 3-5 (Internal latent-image emulsion) | 0.0068 | 0.55 | I-1 | $2.0 \times 10^{-6}$ | +0.21 | 0.007 |
| 416 (Invention) | 3-4 (Internal latent-image emulsion) | 0.0096 | 0.45 | I-1 | $2.0 \times 10^{-6}$ | +0.23 | 0.007 |
| 417 (Invention) | 3-2 (Internal latent-image emulsion) | 0.0190 | 0.30 | I-1 | $2.0 \times 10^{-6}$ | +0.20 | 0.008 |
| 418 (Comparative) | 3-3 (Internal latent-image emulsion) | 0.0270 | 0.10 | I-1 | $2.0 \times 10^{-6}$ | +0.15 | 0.008 |
| 419 (Invention) | 3-6 (Internal latent-image emulsion) | 0.0135 | 0.80 | I-1 | $2.0 \times 10^{-6}$ | +0.19 | 0.007 |
| 420 (Invention) | 3-7 (Internal latent-image emulsion) | 0.0135 | 0.10 | I-1 | $2.0 \times 10^{-6}$ | +0.16 | 0.007 |

A'-1

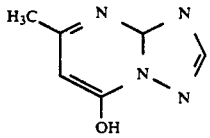

A'-2

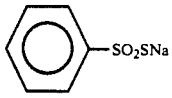

A'-3 $K_2IrCl_6$

A'-4

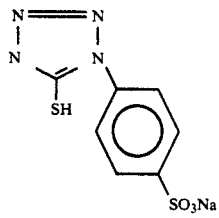

A'-5

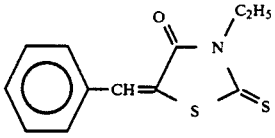

b. Preparation of emulsion 3-2 to 3-5

Emulsions 3-2 to 3-5 were prepared by the same way as emulsion 3-1, except that the ratio of the $AgNO_3$ aqueous solution used for forming the core and the shell was varied. Emulsions 3-2 to 3-5 were thereby internal latent-image emulsions which has chemical sensitization sites at different depths, as is specified in Table 11.

c. Preparation of emulsion 3-6

Emulsion 3-6 was prepared by the same method as emulsion 3-1, except that the shell was formed at 75° C. and silver potential of +60 mV. This emulsion was an internal latent-image emulsion which had a greater ratio of surface latent image than emulsion 3-1.

d. Preparation of emulsion 3-7

Emulsion 3-7 was prepared by the same method as emulsion 3-1, except that the shell was formed at 40° C. and silver potential of −30 mV and that the $AgNO_3$ aqueous solution was added at a rate five times higher than in preparation of emulsion 3-1. This emulsion was an internal latent-image emulsion which had a smaller ratio of surface latent image than emulsion 3-1.

e. Preparation of emulsion 3-8

Emulsion 3-8 was prepared in the same way as emulsion 3-1, except that the sulfur sensitizer, the gold sensitizer, and compounds A'-1, A'-2, A'-3 and A'-4 were added, not before the shell-forming step, but after the shell-forming step and the step of removing the soluble silver, and that chemical sensitization was performed on the surface of the shell. Emulsion 3-8 acquired optimal sensitivity by adding the sensitizers in an amount 1.2 times greater than in the preparation of emulsion 3-1.

2. Preparation of Samples 400 to 420

The sensitizing dye of the present invention and the comparative sensitizing dye S-1, all specified in Table 11, were added to emulsions 3-1 to 3-8 at 65° C. Further, 7 mol/mol Ag of coupler C-1, a coating aid, and a viscosity-adjusting agent were added to the emulsions. Each of the emulsions was coated on a support, in such an amount that 2 μg was applied per square centimeter. As a result, Samples 401 to 420 were formed. To evaluate the magenta stains of Sample 401 to 420, which resulted from the sensitizing dye, Sample 400 was formed to which no sensitizing dye was added. Sensitizing dye S'-1 described above and coupler C-1 (will be specified in Table A), both used in preparing Samples 401 to 420.

3. Evaluation of Samples 400 to 420

Samples 400 to 420, thus formed, were exposed for 1/100 second to white light applied through a gray wedge, at exposure amount of 20 CMS, then were processed by the method as will be specified below, and were subjected to sensitometry.

Further, the magenta stain density of each sample thus processed was evaluated by subtracting the magenta stain density of Sample 400 containing no sensitizing dye, from the magenta stain density of the sample. The magenta stain densities of Samples 401 to 420, thus measured, were as is shown in Table 11.

The steps of the process, described above, were as follows:

| Steps | Time | Temperature- |
|---|---|---|
| First developing | 6 min. | 38° C. |
| Washing | 2 min. | 38° C. |
| Reversing | 2 min. | 38° C. |
| Color Developing | 6 min. | 38° C. |
| Control | 2 min. | 38° C. |
| Bleaching | 6 min. | 38° C. |
| Fixing | 4 min. | 38° C. |
| Washing | 4 min. | 38° C. |
| Stabilization | 1 min. | 25° C. |

The compositions of the respective processing solutions were as follows.

| (First developing solution) | |
|---|---|
| Pentasodium nitrilo-N,N,N-trimethylene phosphonate | 2.0 g |
| Sodium sulfite | 30 g |
| Hydroquinone potassium monosulfonate | 20 g |
| Potassium carbonate | 33 g |
| 1-phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

The pH was adjusted by hydrochloric acid or potassium hydroxide.

| (Reversing solution) | |
|---|---|
| Pentasodium nitrilo-N,N,N-trimethylene phosphonate | 3.0 g |
| Stannous chloride dihydrate | 1.0 g |
| p-aminophenol | 0.1 g |
| Sodium hydroxide | 8 g |
| Glacial acetic acid | 15.0 ml |
| Water to make | 1000 ml |
| pH | 6.00 |

The pH was adjusted by hydrochloric acid or potassium hydroxide.

| (Color developing solution) | |
|---|---|
| Pentasodium nitrilo-N,N,N-trimethylene phosphonate | 2.0 g |
| Sodium sulfite | 7.0 g |
| Tripotassium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-(β-methanesulfonamidoethyl)-3-methyl-4-aminoaniline sulfate | 11 g |
| 3,6-dithiaoctane-1,8-diol | 1.0 g |
| Water to make | 1000 ml |
| pH | 11.80 |

The pH was adjusted by hydrochloric acid or potassium hydroxide.

| (Control solution) | |
|---|---|
| Disodium ethylenediamine tetraacetate dihydrate | 8.0 g |
| Sodium sulfite | 12 g |
| 1-thioglycerol | 0.4 ml |
| Water to make | 1000 ml |

The pH was adjusted by hydrochloric acid or potassium hydroxide.

| (Bleaching solution) | |
|---|---|
| Disodium ethylenediamine tetraacetate dihydrate | 2.0 g |
| Ferric ammonium ethylenediamine tetraacetate dihydrate | 120 g |
| Potassium bromide | 100 g |
| Ammonium nitrate | 10 g |
| Water to make | 1000 ml |
| pH | 5.70 |

The pH was adjusted by hydrochloric acid or potassium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted by hydrochloric acid or ammonia water.

| (Stabilizing Solution) | |
|---|---|
| Formalin (37%) | 5.0 ml |
| Polyoxyethylene-p-monononylphenyl ether (av. polymerization degree: 10) | 0.3 ml |
| Water to make | 1000 ml |

The features of Samples 400 to 420 were as is shown in Table 11 presented above.

As can be understood from Table 11, Samples 401 to 403, in which comparative sensitizing dye S-1 was added to the surface latent image emulsion (i.e., emulsion 3-8), had magenta stain densities of 0.010 or more. Thus, Samples 401 to 403 are not desirable.

Of Samples 404 to 406, in which sensitizing dye S-1 was added to the internal latent-image (i.e., emulsion 3-1), Sample 405 exhibited an optimal sensitivity since the dye was added in a greater amount than to emulsion 3-8. Although the sensitivity was higher than that of Sample 401 in which a sensitizing dye was added in an optimal amount to emulsion 3-8, it exhibited so high a color-remaining density that it cannot be used in practice. In other words, Sample 401 failed to realize the advantage of the internal latent-image emulsion.

Sample 408, in which a sensitizing dye of the present invention was added in an optimal amount, was not only more sensitive than Sample 405 in which sensitizing dye S-1 was used, but also exhibited a very low color-remaining density of 0.007. Obviously, Sample 408 is desirable very much. This advantage was remarkable in the internal latent-image emulsions of the present invention. Sample 410, in which sensitizing dye I-1 was added to emulsion 3-8, had but a sensitivity lower by 0.28 than that of Sample 408.

Samples 411 to 414, in which other sensitizing dyes of the present invention were added, achieved almost the same advantage.

As is shown in Table 11, Samples 415, 416, 408, 417, and 418. The internal latent-image emulsions used in these samples had had chemical sensitization sites at greater depths from the grain surface, in the order the samples are mentioned. The deeper the chemical sensitization site, the lower the sensitivity. It was found that Sample 418 had a chemical sensitization site at depths of more than 0.02 μm, and exhibited an extremely low sensitivity.

Samples 419 and 420, in which use was made of emulsions 3-6 and 3-7, respectively, which had chemical sensitization sites at depths of less than 0.02 μm, achieved almost the same advantage. However, the most desirable results were obtained in the case where use was made of emulsion 3-1 in which the ratio of the latent image formed on the grain surface is 0.2 to 0.7.

Example 8

Preparation of Sample 501

A multilayered color light-sensitive material constituted by layers having the following compositions was formed on an undercoated 127 μm thick triacetylcellulose film support, thereby obtaining Sample 501. Numerals indicate an addition amount per $m^2$. Note that the effects of the added compounds are not limited to those described here.

| | |
|---|---|
| Layer 1: Antihalation layer | |
| Black colloidal silver | silver 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Dispersed fine crystals in dye E-1 | 0.1 g |
| Layer 2: Interlayer | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.4 mg |
| Layer 3: Interlayer | |
| Surface-fogged and internally fogged fine grain silver iodobromide emulsion (average grain size = 0.06 μm, variation coefficient: 18%, AgI content: 1 mol %) | silver 0.05 g |
| Gelatin | 0.4 g |
| Layer 4: Low red-sensitive emulsion layer | |
| Emulsion A-3 | 0.1 g |
| Emulsion B-3 | 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Layer 5: Medium red-sensitive emulsion layer | |
| Emulsion B-3 | silver 0.2 g |
| Emulsion C-3 | silver 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Layer 6: High red-sensitive emulsion layer | |
| Emulsion D-3 | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Layer 7: Interlayer | |
| Gelatin | 0.6 g |
| Additive M-1 | 0.3 g |
| Color-mixing inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| Layer 8: Interlayer | |
| Surface-fogged and internally fogged silver iodobromide emulsion (average grain size: 0.06 μm, variation coefficient: 16%, AgI content: 0.3 mol %) | silver 0.02 g |
| Gelatin | 1.0 g |
| Additive P-1 | 0.2 g |
| Color-mixing inhibitor Cpd-A | 0.1 g |
| Layer 9: Low green-sensitive emulsion layer | |
| Emulsion E-3 | silver 0.1 g |
| Emulsion F-3 | silver 0.2 g |
| Emulsion G-3 | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Layer 10: Medium green-sensitive emulsion layer | |
| Emulsion G-3 | silver 0.3 g |
| Emulsion H-3 | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |

-continued

| | |
|---|---|
| Layer 11: High green-sensitive emulsion layer | |
| Emulsion I-3 | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Layer 12: Interlayer | |
| Gelatin | 0.6 g |
| Layer 13: Yellow filter layer | |
| Yellow colloidal silver | silver 0.07 g |
| Gelatin | 1.1 g |
| Color-mixing inhibitor Cpd-A | 0.01 g |
| High-boiling organic solvent Oil-1 | 0.01 g |
| Dispersed fine crystals in dye E-2 | 0.05 g |
| Layer 14: Interlayer | |
| Gelatin | 0.6 g |
| Layer 15: Low blue-sensitive emulsion layer | |
| Emulsion J-3 | silver 0.2 g |
| Emulsion K-3 | silver 0.3 g |
| Emulsion L-3 | silver 0.1 g |
| Gelatin | 0.8 g |
| Coupler C-5 | 0.2 g |
| Coupler C-6 | 0.1 g |
| Coupler C-10 | 0.4 g |
| Layer 16: Medium blue-sensitive emulsion layer | |
| Emulsion L-3 | silver 0.1 g |
| Emulsion M-3 | silver 0.4 g |
| Gelatin | 0.9 g |
| Coupler C-5 | 0.3 g |
| Coupler C-6 | 0.1 g |
| Coupler C-10 | 0.1 g |
| Layer 17: High blue-sensitive emulsion layer | |
| Emulsion N-4 | silver 0.4 g |
| Gelatin | 1.2 g |
| Coupler C-5 | 0.3 g |
| Coupler C-6 | 0.6 g |
| Coupler C-10 | 0.1 g |
| Layer 18: First protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Layer 19: Second protective layer | |
| Colloidal silver | silver 0.1 mg |
| Fine grain silver iodobromide emulsion (average grain size: 0.06 μm; AgI content: 1 mol %) | silver 0.1 g |
| Gelatin | 0.4 g |
| Layer 20: Third protective layer | |
| Gelatin | 0.4 g |
| Polymethylmethacrylate (average grain size: 1.5 μm) | 0.1 g |
| Copolymer of methylmethacrylate and acrylic acid in the ratio of 4:6 (av. grain size: 1.5 μm) | 0.1 g |
| Silicone oil | 0.03 g |
| Surfactant W-1 | 3.0 mg |
| Surfactant W-2 | 0.03 g |

The compound used in forming Sample 501 will be identified by their names or chemical formulas, in Table A later presented.

In addition to the above compositions, additives F-1 to F-3, F-6, F-8, and F-18 to F-20 were added to all of the emulsion layers. Furthermore, in addition to the above compositions, gelatin hardener H-1 and surfactants W-1 and W-6 for coating and emulsification were added to each layer.

Further, as antiseptic and mildewproofing agents, phenol, 1,2-benzisothiazoline-3-one, 2-phenoxyethanol, phenethyl alcohol, and butyl para-benzoate were added. The emulsions and the compound, all used in Sample 501, will be specified in the following Tables 12 to 14:

TABLE 12

| Emulsion | Features of grains | Average equivalent-sphere (μm) | Variation coefficient (%) | AgI content (%) |
|---|---|---|---|---|
| A-3 | Monodispersed decatetrahedral grains | 0.28 | 16 | 3.7 |
| B-3 | Monodispersed cubic, internal latent-image grains | 0.30 | 10 | 3.3 |
| C-3 | Monodispersed tabular grains, Average aspect ratio: 4.0 | 0.38 | 18 | 5.0 |
| D-3 | Tabular grains, Average aspect ratio: 8.0 | 0.68 | 25 | 2.0 |
| E-3 | Monodispersed cubic grains | 0.20 | 17 | 4.0 |
| F-3 | Monodispersed cubic grains | 0.23 | 16 | 4.0 |
| G-3 | Monodispersed cubic, internal latent-image grains | 0.28 | 11 | 3.5 |
| H-3 | Monodispersed cubic, internal latent-image grains | 0.32 | 9 | 3.5 |
| I-3 | Tabular grains, Average aspect ratio: 9.0 | 0.80 | 28 | 1.5 |
| J-3 | Monodispersed decatetrahedral grains | 0.30 | 18 | 4.0 |
| K-3 | Monodispersed tabular grains Average aspect ratio: 7.0 | 0.45 | 17 | 4.0 |
| L-3 | Monodispersed cubic, internal latent-image grains | 0.46 | 14 | 3.5 |
| M-3 | Monodispersed tabular grains Average aspect ratio: 10.0 | 0.55 | 13 | 4.0 |
| N-3 | Tabular grains Average aspect ratio: 12.0 | 1.00 | 33 | 1.3 |

TABLE 13

Spectral Sensitization of Emulsions A-3 to G-3

| Emulsion | Sensitizing dye added | Amount per mol of silver halide (g) |
|---|---|---|
| A-3 | S-1 | 0.025 |
| | S-2 | 0.25 |
| | S-7 | 0.01 |
| B-3 | S-1 | 0.01 |
| | S-2 | 0.25 |
| | S-7 | 0.01 |
| C-3 | S-1 | 0.02 |
| | S-2 | 0.25 |
| | S-7 | 0.01 |
| D-3 | S-1 | 0.01 |
| | S-2 | 0.10 |
| | S-7 | 0.01 |
| E-3 | S-3 | 0.5 |
| | S-4 | 0.1 |
| F-3 | S-3 | 0.3 |
| | S-4 | 0.1 |
| G-3 | S-3 | 0.25 |
| | S-4 | 0.08 |
| | S-8 | 0.05 |

TABLE 14

| Spectral Sensitization of Emulsions H-3 to N-3 | | |
|---|---|---|
| Emulsion | Sensitizing dye added | Amount per mol of silver halide (g) |
| H-3 | S-3 | 0.2 |
| | S-4 | 0.06 |
| | S-8 | 0.05 |
| I-3 | S-3 | 0.3 |
| | S-4 | 0.07 |
| | S-8 | 0.1 |
| J-3 | S-6 | 0.2 |
| | S-5 | 0.05 |
| K-3 | S-6 | 0.2 |
| | S-5 | 0.05 |
| L-3 | S-6 | 0.22 |
| | S-5 | 0.06 |
| M-3 | S-6 | 0.15 |
| | S-5 | 0.04 |
| N-3 | S-6 | 0.22 |
| | S-5 | 0.06 |

Preparation of Samples 501 to 506

Samples 502 to 506 were formed by the same way as Sample 501, except that the emulsion and the sensitizing dyes specified in Table 15 were respectively added in same silver amount and equimolar amount, in place of emulsion 3-2 and sensitizing dye S-1 added to emulsions 3-2 used in Sample 501.

Samples 501 to 506, thus formed, were exposed for 1/100 second to white light applied through a wedge and were processed by the method as will be specified below. They were evaluated for their sensitivities and their magenta stain densities with that of Sample 506 used as reference. The results were as is shown in the following Table 15:

TABLE 15

| Sample | Emulsion | Sensitizing dye | Relative sensitivity | Magenta stain density |
|---|---|---|---|---|
| 501 (Comparative) | B-3 | S-1 | 0.00 | 0.027 |
| 502 (Comparative) | J-3 | S-1 | −0.09 | 0.025 |
| 503 (Comparative) | J-3 | I-10 | −0.08 | 0.004 |
| 504 (Invention) | B-3 | I-10 | +0.03 | 0.003 |
| 505 (Invention) | B-3 | I-8 | +0.04 | 0.004 |
| 506 (Comparative) | B-3 | None | −0.50 | 0.000 |

The steps of processing Samples 501 to 506 were as follows:

| Steps | Time | Temperature- |
|---|---|---|
| First developing | 6 min. | 38° C. |
| Washing | 2 min. | 38° C. |
| Reversing | 2 min. | 38° C. |
| Color Developing | 6 min. | 38° C. |
| Control | 2 min. | 38° C. |
| Bleaching | 6 min. | 38° C. |
| Fixing | 4 min. | 38° C. |
| Washing | 4 min. | 38° C. |
| Stabilization | 1 min. | 25° C. |

The compositions of the respective processing solutions used in processing Samples 501 to 506 were as follows.

| (First developing solution) | |
|---|---|
| Pentasodium nitrilo-N,N,N-trimethylene phosphonate | 1.5 g |
| Pentasodium ethylenetriamine pentaacetate | 2.0 g |
| Sodium sulfite | 30 g |
| Hydroquinone potassium monosulfonate | 20 g |
| Potassium carbonate | 15 g |
| Sodium bisulfate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Water to make | 1000 ml |
| pH | 9.60 |

The pH was adjusted by hydrochloric acid or potassium hydroxide.

| (Reversing solution) | |
|---|---|
| Pentasodium nitrilo-N,N,N-trimethylene phosphonate | 3.0 g |
| Stannous chloride dihydrate | 1.0 g |
| p-aminophenol | 0.1 g |
| Sodium hydroxide | 8 g |
| Glacial acetic acid | 15.0 ml |
| Water to make | 1000 ml |
| pH | 6.00 |

The pH adjusted by hydrochloric acid or potassium hydroxide.

| (Color developing solution) | |
|---|---|
| Pentasodium nitrilo-N,N,N-trimethylene phosphonate | 2.0 g |
| Sodium sulfite | 7.0 g |
| Tripotassium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-(β-methanesulfonamidoethyl)-3-methyl-4-aminoaniline sulfate 3/2 sulfuric acid monohydrate | 11 g |
| 3,6-dithiaoctane-1,8-diol | 1.0 g |
| Water to make | 1000 ml |
| pH | 11.80 |

The pH was adjusted by hydrochloric acid or potassium hydroxide.

| (Control solution) | |
|---|---|
| Disodium ethylenediamine tetraacetate dihydrate | 8.0 g |
| Sodium sulfite | 12 g |
| 1-thioglycerol | 0.4 ml |
| Formaldehyde sodium bisulfite adduct | 30 g |
| Water to make | 1000 ml |
| pH | 6.20 |

The pH was adjusted by hydrochloric acid or potassium hydroxide.

| (Bleaching solution) | |
|---|---|
| Disodium ethylenediamine tetraacetate dihydrate | 2.0 g |

-continued

| (Bleaching solution) | |
|---|---|
| Ferric ammonium ethylenediamine tetraacetate dihydrate | 120 g |
| Potassium bromide | 100 g |
| Ammonium nitrate | 10 g |
| Water to make | 1000 ml |
| pH | 5.70 |

The pH was adjusted by hydrochloric acid or potassium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted by hydrochloric acid or ammonia water.

| (Stabilizing Solution) | |
|---|---|
| Benzoisothiazoline-3-one | 0.02 g |
| Polyoxyethylene-p-monononylphenyl ether (av. polymerization degree: 10) | 0.3 g |
| Water to make | 1000 ml |
| pH | 7.0 |

As is evident from Table 15, the emulsion of the present invention and the sensitizing dyes of the present invention, used in combination, achieve a high sensitivity, and are useful in obtaining high-quality images having no color-remaining.

(4) Examples Wherein a Methine Compound of the present invention Is Added at 50° C. or More in Any Step from Emulsion-Forming Step to Emulsion-Coating Step Example 9

Preparation of Sample 601

A multilayered color light-sensitive material constituted by layers having the following compositions was formed on an undercoated 127 μm thick triacetylcellulose film support, thereby obtaining Sample 601. Numerals indicate an addition amount per $m^2$. Note that the effects of the added compounds are not limited to those described here.

| | |
|---|---|
| Layer 1: Antihalation layer | |
| Black colloidal silver | silver 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Dispersed fine crystals in dye E-1 | 0.1 g |
| Layer 2: Interlayer | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.4 mg |
| Layer 3: Interlayer | |
| Surface-fogged and internally fogged fine grain silver iodobromide emulsion (average grain size = 0.06 μm, variation coefficient: 18%, AgI content: 1 mol %) | silver 0.05 g |
| Gelatin | 0.4 g |
| Layer 4: Low red-sensitive emulsion layer | |
| Emulsion A-4 | 0.1 g |
| Emulsion B-4 | 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Layer 5: Medium red-sensitive emulsion layer | |
| Emulsion B-4 | silver 0.2 g |
| Emulsion C-4 | silver 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Layer 6: High red-sensitive emulsion layer | |
| Emulsion D-4 | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Layer 7: Interlayer | |
| Gelatin | 0.6 g |
| Additive M-1 | 0.3 g |
| Color-mixing inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye D-1 | 0.02 g |
| Compound Cpd-C | 5 mg |
| Compound Cpd-J | 5 g |
| Compound Cpd-K | 5 g |
| High-boiling organic solvent Oil-1 | 0.02 g |
| Layer 8: Interlayer | |
| Surface-fogged and internally fogged silver iodobromide emulsion (average grain size: 0.06 μm, variation coefficient: 16%, AgI content: 0.3 mol %) | silver 0.02 g |
| Gelatin | 1.0 g |
| Additive P-1 | 0.2 g |
| Color-mixing inhibitor Cpd-A | 0.1 g |
| Layer 9: Low green-sensitive emulsion layer | |
| Emulsion E-4 | silver 0.1 g |
| Emulsion F-4 | silver 0.2 g |
| Emulsion G-4 | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Layer 10: Medium green-sensitive emulsion layer | |
| Emulsion G-4 | silver 0.3 g |
| Emulsion H-4 | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Layer 11: High green-sensitive emulsion layer | |
| Emulsion I-4 | silver 0.5 g |

-continued

| | |
|---|---|
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Layer 12: Interlayer | |
| Gelatin | 0.6 g |
| Layer 13: Yellow filter layer | |
| Yellow colloidal silver | silver 0.07 g |
| Gelatin | 1.1 g |
| Color-mixing inhibitor Cpd-A | 0.01 g |
| High-boiling organic solvent Oil-1 | 0.01 g |
| Dispersed fine crystals in dye E-2 | 0.05 g |
| Layer 14: Interlayer | |
| Gelatin | 0.6 g |
| Layer 15: Low blue-sensitive emulsion layer | |
| Emulsion J-4 | silver 0.6 g |
| Gelatin | 0.8 g |
| Coupler C-5 | 0.2 g |
| Coupler C-6 | 0.1 g |
| Coupler C-10 | 0.4 g |
| Layer 16: Medium blue-sensitive emulsion layer | |
| Emulsion K-4 | silver 0.4 g |
| Gelatin | 0.9 g |
| Coupler C-5 | 0.3 g |
| Coupler C-6 | 0.1 g |
| Coupler C-10 | 0.1 g |
| Layer 17: High blue-sensitive emulsion layer | |
| Emulsion L-4 | silver 0.4 g |
| Gelatin | 1.2 g |
| Coupler C-5 | 0.3 g |
| Coupler C-6 | 0.6 g |
| Coupler C-10 | 0.1 g |
| Layer 18: First protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Layer 19: Second protective layer | |
| Colloidal silver | silver 0.1 mg |
| Fine grain silver iodobromide emulsion (average grain size: 0.06 μm; AgI content: 1 mol %) | silver 0.1 g |
| Gelatin | 0.4 g |
| Layer 20: Third protective layer | |
| Gelatin | 0.4 g |
| Polymethylmethacrylate (average grain size: 1.5 μm) | 0.1 g |
| Copolymer of methylmethacrylate and acrylic acid in the ratio of 4:6 (av. grain size: 1.5 μm) | 0.1 g |
| Silicone oil | 0.03 g |
| Surfactant W-1 | 3.0 mg |
| Surfactant W-2 | 0.03 g |

The compounds used in forming Sample 601 will be identified by their names or chemical formulas, in Table A later presented.

In addition to the above compositions, additives F-1 to F-8 were added to all of the emulsion layers. Furthermore, in addition to the above compositions, gelatin hardener H-1 and surfactants W-3, W-5, and W-6 for coating and emulsification were added to each layer.

Further, as antiseptic and mildewproofing agents, phenol, 1,2-benzisothiazoline-3-one, 2-phenoxyethanol, and phenethyl alcohol were added.

The silver iodobromide emulsions used in Sample 601 will be specified in the following Table 16:

TABLE 16

| Emulsion | Features of grains | Average equivalent-sphere (μm) | Variation coefficient (%) | AgI content (%) |
|---|---|---|---|---|
| A-4 | Monodispersed decatetrahedral grains | 0.28 | 16 | 3.7 |
| B-4 | Monodispersed cubic, internal latent-image grains | 0.30 | 10 | 3.3 |
| C-4 | Monodispersed tabular grains, Average aspect ratio: 4.0 | 0.38 | 18 | 5.0 |
| D-4 | Tabular grains, Average aspect ratio: 4.0 | 0.68 | 25 | 2.0 |
| E-4 | Monodispersed cubic grains | 0.20 | 17 | 4.0 |
| F-4 | Monodispersed cubic grains | 0.23 | 16 | 4.0 |
| G-4 | Monodispersed cubic, internal latent-image grains | 0.28 | 11 | 3.5 |
| H-4 | Monodispersed cubic grains | 0.32 | 9 | 3.5 |
| I-4 | Tabular grains, Average aspect ratio: 5.0 | 0.80 | 28 | 1.5 |
| J-4 | Monodispersed decatetrahedral grains | 0.30 | 18 | 4.0 |
| K-4 | Monodispersed tabular grains, Average aspect ratio: 7.0 | 0.45 | 17 | 4.0 |
| L-4 | Monodispersed tabular grains, Average aspect ratio: 10.0 | 0.55 | 13 | 4.0 |

The particles of the spectral sensitization applied to emulsions E-4 to M-4, all used in preparing Sample 601, are as shown in the following Table 17:

TABLE 17

Spectral Sensitization of Emulsions E-4 to L-4

| Emulsion | Sensitizing dye added | Amount per mol of silver halide (g) |
|---|---|---|
| E-4 | S-3 | 0.5 |
| | S-4 | 0.1 |
| F-4 | S-3 | 0.3 |
| | S-4 | 0.1 |
| G-4 | S-3 | 0.25 |
| | S-4 | 0.08 |
| | S-8 | 0.05 |
| H-4 | S-3 | 0.2 |
| | S-4 | 0.06 |
| | S-8 | 0.05 |
| I-4 | S-3 | 0.3 |
| | S-4 | 0.07 |
| | S-8 | 0.1 |
| J-4 | S-6 | 0.2 |
| | S-5 | 0.05 |
| K-4 | S-6 | 0.2 |
| | S-5 | 0.05 |
| L-4 | S-6 | 0.15 |
| | S-5 | 0.04 |

Preparation of Samples 602 to 607

Samples 602 to 607 were formed by the same way as Sample 601, except that the sensitizing dyes specified in the following Table 18 were added in place of the sensitizing dyes added to emulsions A-4 to D-4 used in Sample 601, at the temperatures specified also in the following Table 18. In preparing Samples 602 to 607, the sensitizing dyes were added after the chemical sensitization, each in an amount of 0.6 g per mol of silver halide.

TABLE 18

| Sample | Emulsion A-4 | | Emulsion B-4 | | Emulsion C-4 | | Emulsion D-4 | |
|---|---|---|---|---|---|---|---|---|
| | Dye | Temp. | Dye | Temp. | Dye | Temp. | Dye | Temp. |
| 601 (Comparative) | S-1,2 | 40° C. | S-1,2 | 40° C. | S-1,2 | 40° C. | S-1,2 | 40° C. |
| 602 (Comparative) | S-1,2 | 60° C. | S-1,2 | 60° C. | S-1,2 | 60° C. | S-1,2 | 60° C. |
| 603 (Comparative) | S-8,3 | 60° C. | S-8,2 | 60° C. | S-8,2 | 60° C. | S-8,2 | 60° C. |
| 604 (Comparative) | I-1,S-2 | 40° C. | I-1,S-2 | 40° C. | I-1,S-2 | 40° C. | I-1,S-2 | 40° C. |
| 605 (Invention) | I-1,S-2 | 60° C. | I-1,S-2 | 60° C. | I-1,S-2 | 60° C. | I-1,S-2 | 60° C. |
| 606 (Invention) | I-4,S-2 | 60° C. | I-4,S-2 | 60° C. | I-4,S-2 | 60° C. | I-4,S-2 | 60° C. |
| 607 (Control) | No dye used | | No dye used | | No dye used | | No dye used | |

Samples 601 to 607, thus formed, were exposed for 1/100 second to white light applied through a gray wedge, at exposure amount of 20 CMS, then were processed by the method as will be specified below, and were subjected to sensitometry. The samples were exposed, after subjected to the incubation at 50° C. and relative humidity of 80% for 3 days, or not subjected to the incubation.

The sensitivities of Samples 601 to 607 were evaluated, by using the reciprocal of the exposure amount required to impart a density of 1.0 to Sample 601, as the reference value of 100.

Further, the magenta stain density of each sample thus processed was evaluated by subtracting the magenta stain density of Sample 607, from the magenta stain density of the sample processed directly after the coating of the emulsion.

Samples 601 to 607 were also exposed, by using a wedge designed to measure granularity, whereby the granularity each sample had a density of 1.0 was measured.

The R sensitivities, color-stains, and R granularity of the samples 601 to 606 were as is shown in the following Table 19:

TABLE 19

| Sample | R sensitivity | 50° C., 80% for 3 days | Color-remaining | R granularity |
|---|---|---|---|---|
| 601 (Comparative) | 100 | 76 | 0.12 | 0.023 |
| 602 (Comparative) | 122 | 87 | 0.36 | 0.024 |
| 603 (Comparative) | 122 | 47 | 0.02 | 0.021 |
| 604 (Comparative) | 101 | 79 | 0.00 | 0.021 |
| 605 (Invention) | 123 | 94 | 0.00 | 0.021 |
| 606 (Invention) | 125 | 97 | 0.00 | 0.020 |

The steps of processing Samples 601 to 607 were as follows:

| Steps | Time | Temperature- |
|---|---|---|
| First developing | 6 min. | 38° C. |
| Washing | 2 min. | 38° C. |
| Reversing | 2 min. | 38° C. |
| Color Developing | 6 min. | 38° C. |
| Control | 2 min. | 38° C. |
| Bleaching | 6 min. | 38° C. |
| Fixing | 4 min. | 38° C. |
| Washing | 4 min. | 38° C. |
| Stabilization | 4 min. | 25° C. |

The compositions of the respective processing solutions used in processing Samples 601 to 607 were as follows.

| (First developing solution) | |
|---|---|
| Pentasodium nitrilo-N,N,N-trimethylene phosphonate | 2.0 g |
| Sodium sulfite | 30 g |
| Hydroquinone potassium monosulfonate | 20 g |
| Potassium carbonate | 33 g |
| 1-phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

The pH was adjusted by hydrochloric acid or potassium hydroxide.

| (Reversing solution) | |
|---|---|
| Pentasodium nitrilo-N,N,N-trimethylene phosphonate | 3.0 g |
| Stannous chloride dihydrate | 1.0 g |
| p-aminophenol | 0.1 g |
| Sodium hydroxide | 8 g |
| Glacial acetic acid | 15.0 ml |
| Water to make | 1000 ml |
| pH | 6.00 |

The pH was adjusted by hydrochloric acid or potassium hydroxide.

| (Color developing solution) | |
|---|---|
| Pentasodium nitrilo-N,N,N-trimethylene phosphonate | 2.0 g |
| Sodium sulfite | 7.0 g |
| Tripotassium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-(β-methanesulfonamidoethyl)-3-methyl-4-aminoaniline sulfate | 11 g |
| 3,6-dithiaoctane-1,8-diol | 1.0 g |
| Water to make | 1000 ml |
| pH | 11.80 |

The pH was adjusted by hydrochloric acid or potassium hydroxide.

| (Control solution) | |
|---|---|
| Disodium ethylenediamine tetraacetate dihydrate | 8.0 g |
| Sodium sulfite | 12 g |
| 1-thioglycerol | 0.4 ml |
| Water to make | 1000 ml |
| pH | 6.20 |

The pH was adjusted by hydrochloric acid or potassium hydroxide.

| (Bleaching solution) | |
|---|---|
| Disodium ethylenediamine tetraacetate dihydrate | 2.0 g |
| Ferric ammonium ethylenediamine tetraacetate dihydrate | 120 g |
| Potassium bromide | 100 g |
| Ammonium nitrate | 10 g |
| Water to make | 1000 ml |
| pH | 5.70 |

The pH was adjusted by hydrochloric acid or potassium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted by hydrochloric acid or ammonia water.

| (Stabilizing Solution) | |
|---|---|
| Formalin (37%) | 5.0 ml |

-continued

| (Stabilizing Solution) | |
|---|---|
| Polyoxyethylene-p-monononylphenyl ether (av. polymerization degree: 10) | 0.5 ml |
| Water to make | 1000 ml |
| pH | Not adjusted |

As is evident from Table 19, Sample 603 could not achieve the object of the present invention, since its sensitivity much decreased while the sample was stored at high humidity, through the use of a greatly water-soluble dye served to educe color-remaining. Although Samples 601 and 602 exhibited relatively high sensitivity since conventional sensitizing dyes had been added at high temperatures, they had considerably much color-remaining. By contrast, Samples 605 and 606, both falling within the scope of the present invention, were photographic light-sensitive materials which excelled in sensitivity, graininess and storage stability and which had but a little color-remaining.

Example 10

Samples were formed in the same way as in Example 1 described in JP-A-1-158431, except that layers 3 and 4 were formed by using the same sensitizing dyes and the same emulsions used in Example 9 of the present invention. These samples were processed and tested in the same method as in Example 9. The results were similar to those achieved in in Example 9.

TABLE A

C-1

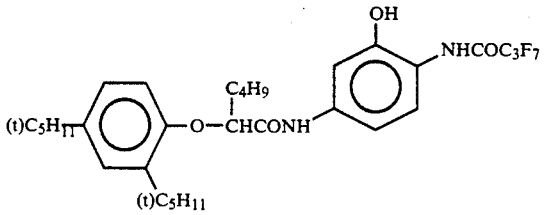

C-2

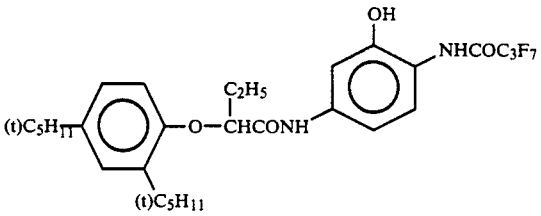

C-3

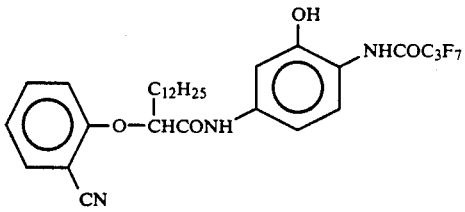

C-4

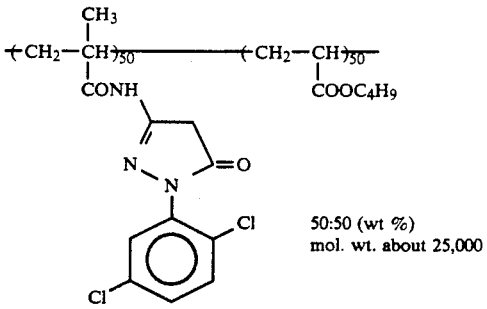

50:50 (wt %)
mol. wt. about 25,000

C-5

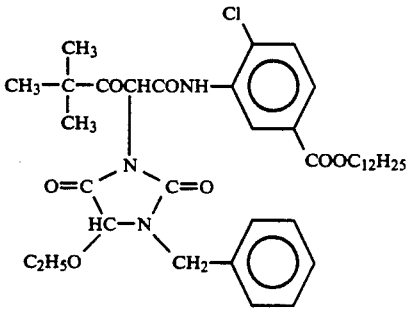

C-6

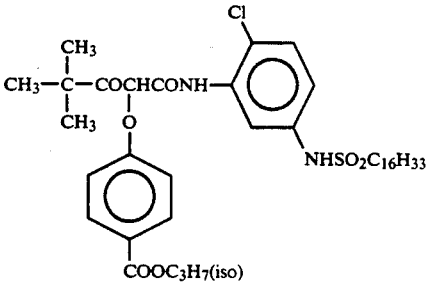

TABLE A-continued
C-7
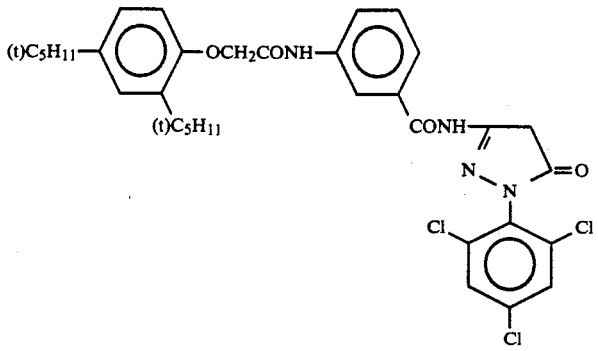
C-8
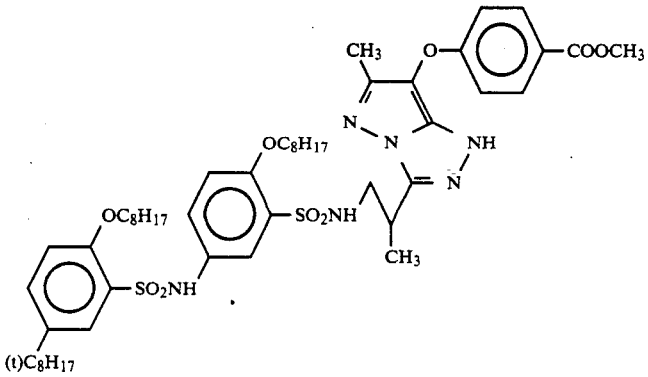
C-9
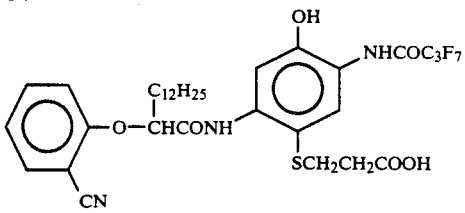
C-10
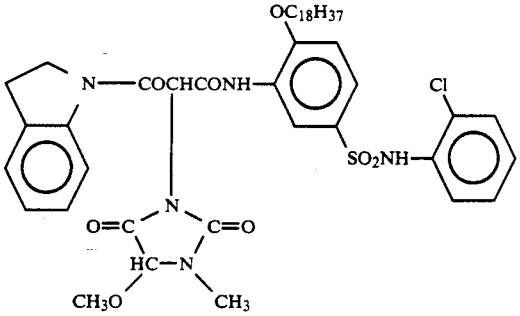
C-11
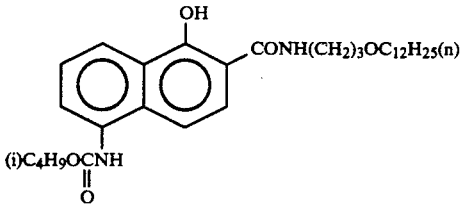
C-12
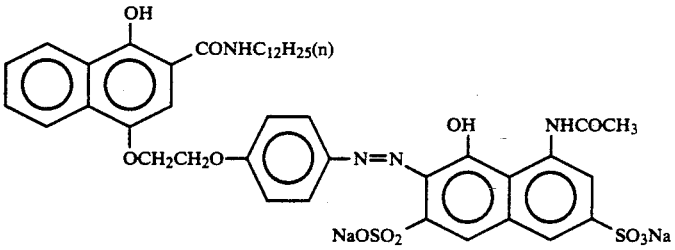
C-13

TABLE A-continued
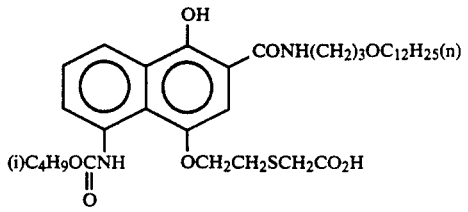
C-14
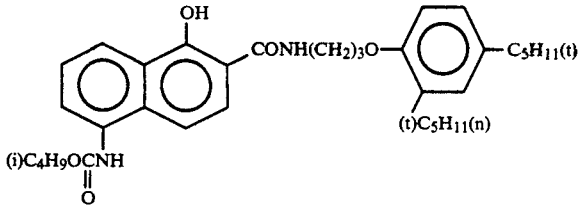
C-15
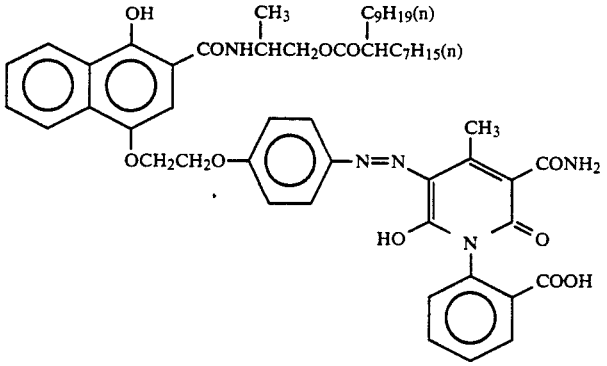
C-16
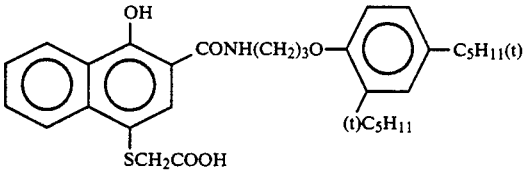
C-17
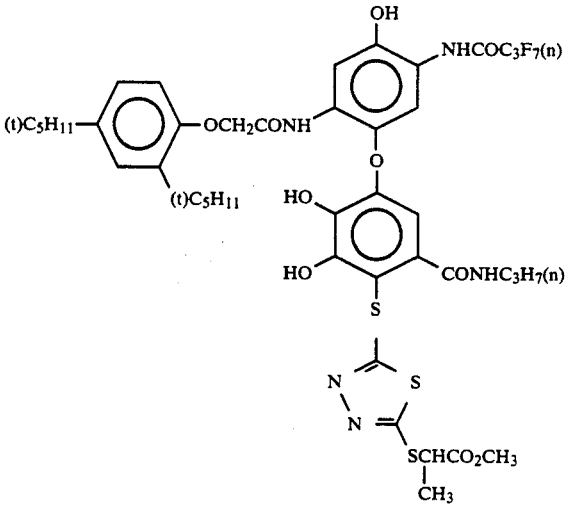
ExM-1

TABLE A-continued
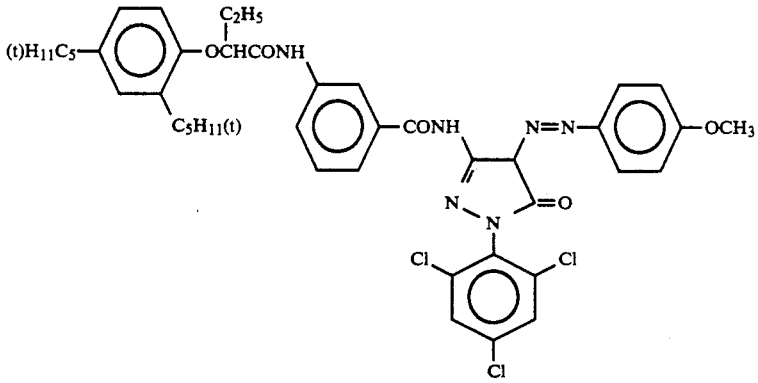
ExM-2
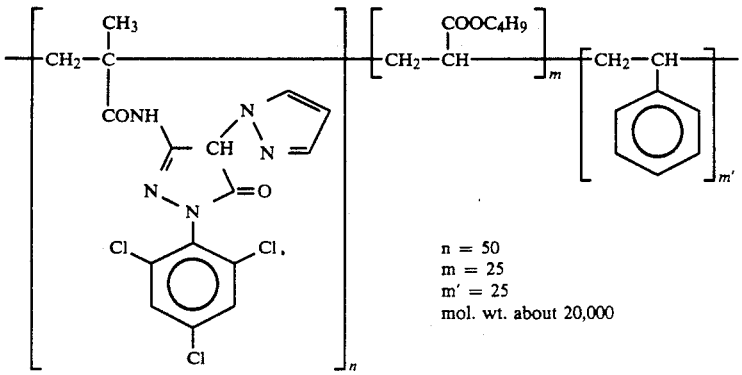
n = 50
m = 25
m' = 25
mol. wt. about 20,000
ExM-3
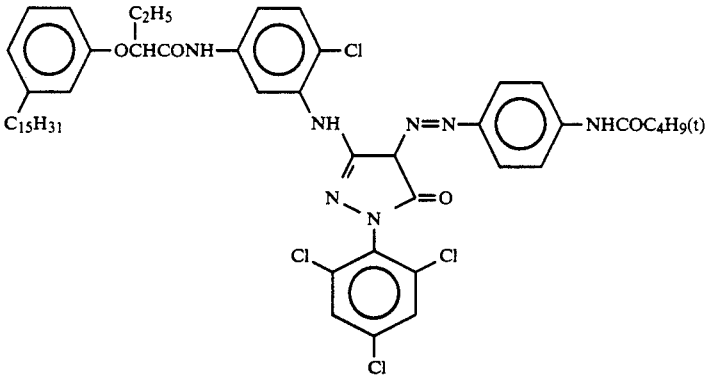
ExM-4
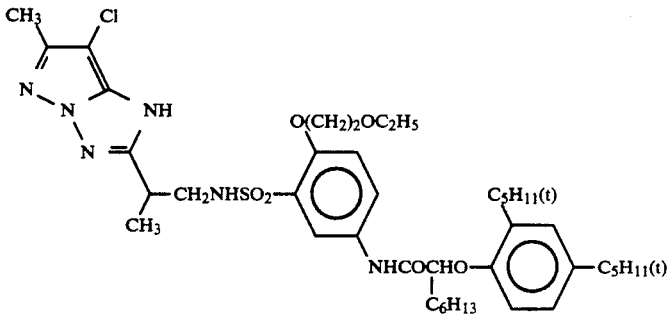
ExM-5

TABLE A-continued
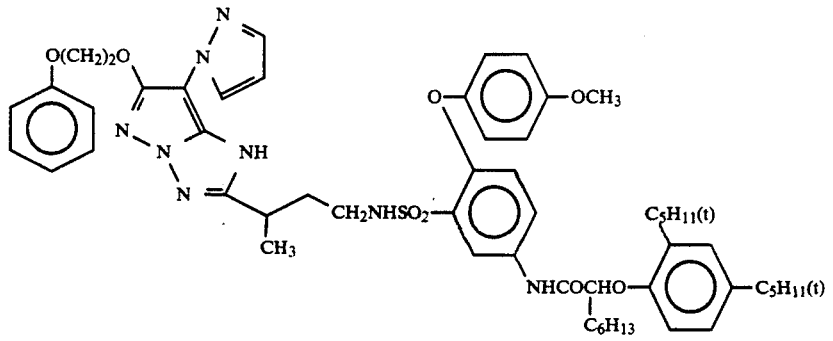
ExY-1
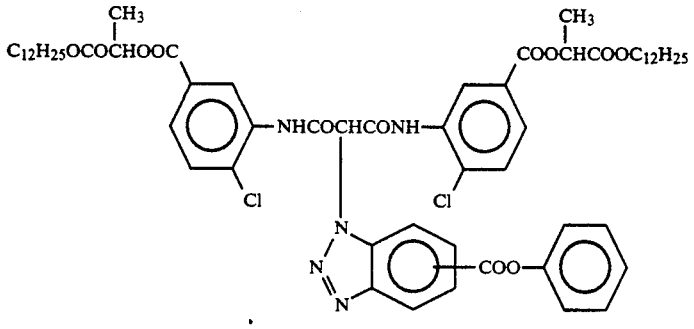
ExY-2
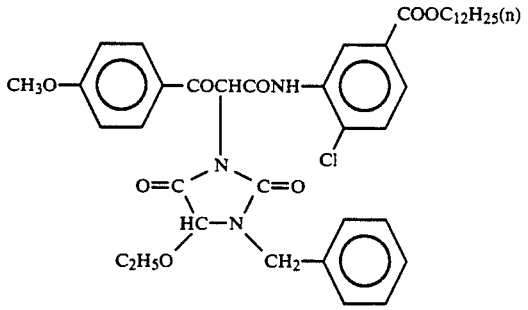
ExF-1
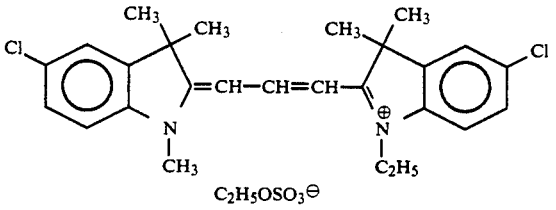
S-1
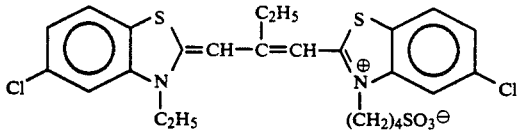
S-2
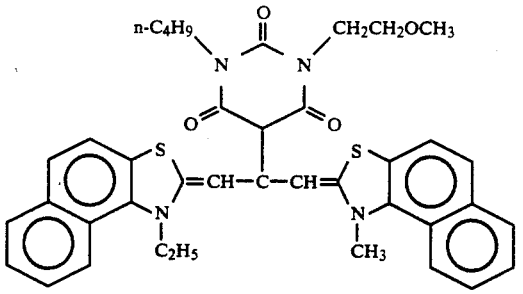
S-3
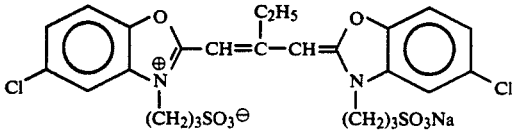
S-4
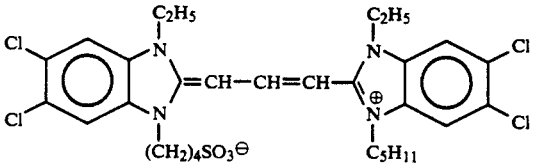
S-5
S-6

TABLE A-continued
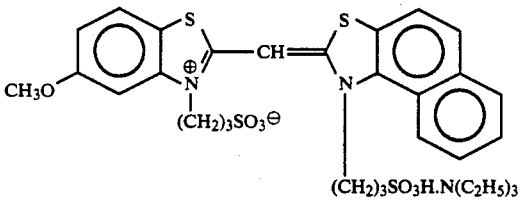
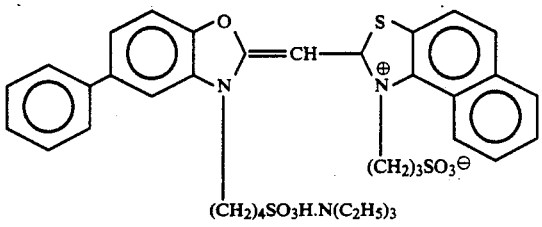
S-7
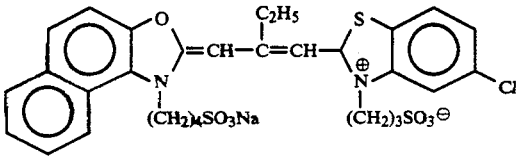
S-8
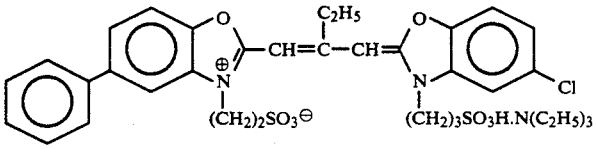
S-9
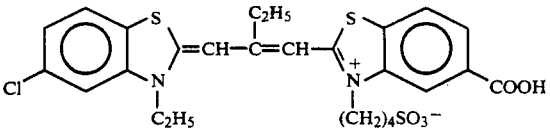
S-10
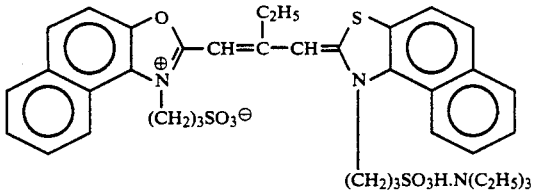
S-11
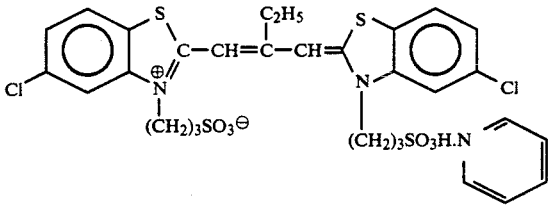
S-12
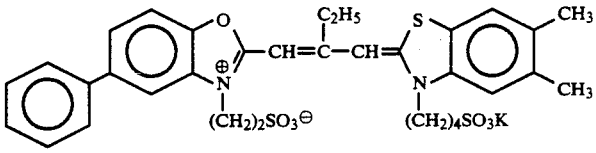
S-13
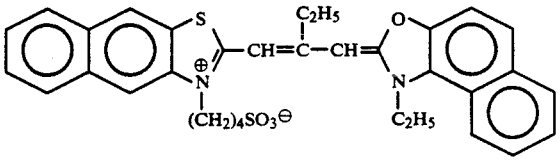
S-14

TABLE A-continued
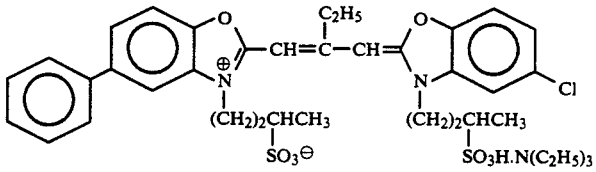
S-15
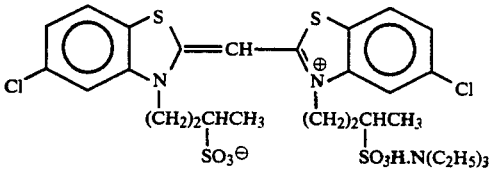
Oil-1
Dibutyl phthalate
Oil-2
Tricresyl phosphate
Oil-3
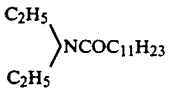
Oil-4
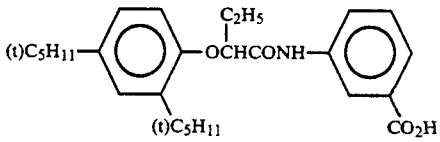
Cpd-A
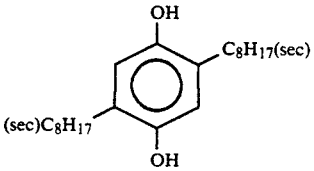
Cpd-B
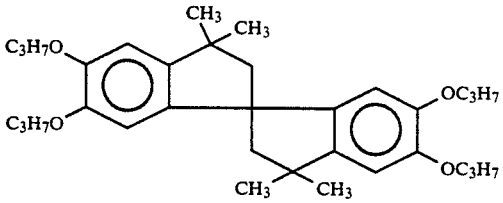
Cpd-C
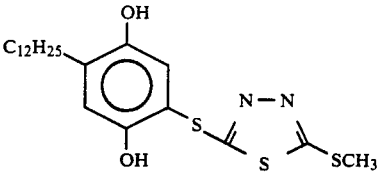
Cpd-D
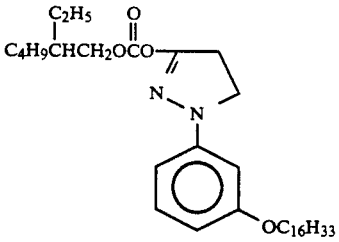
Cpd-E
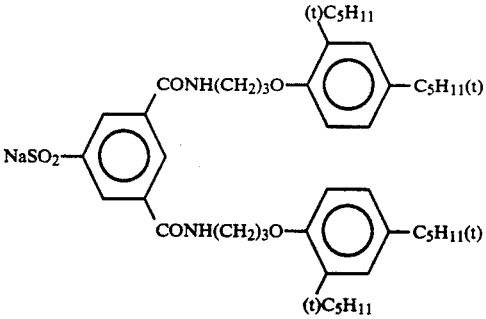
Cpd-F
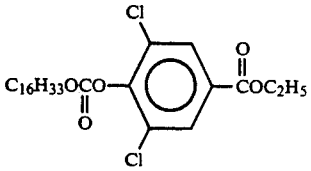
Cpd-G
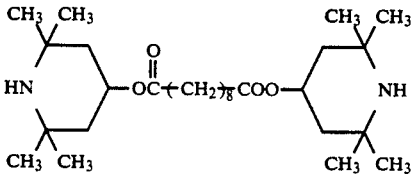
Cpd-H
Cpd-I TABLE A-continued
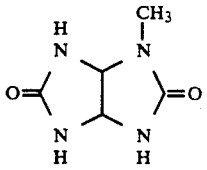
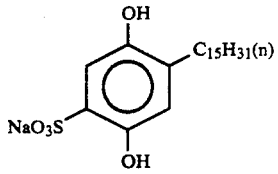
Cpd-J
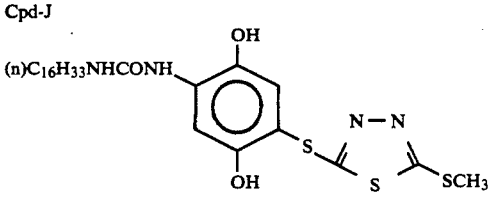
Cpd-K
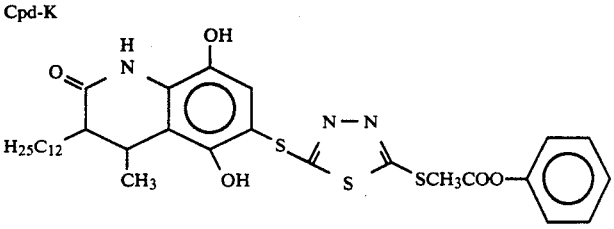
Cpd-1
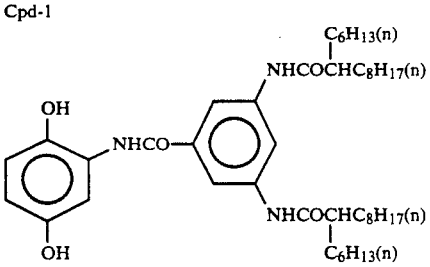
U-1
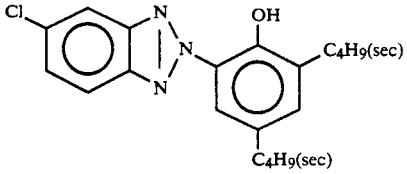
U-2
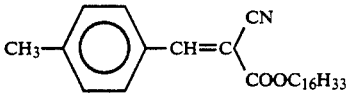
U-3
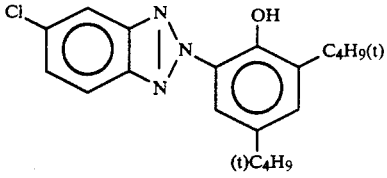
U-4
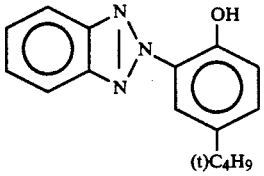
U-5
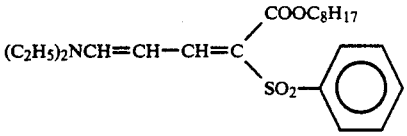
U-6
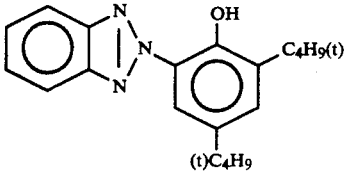
U-7
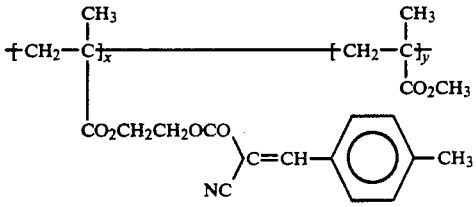
x:y = 70:30 (wt %)
B-1
B-2

TABLE A-continued
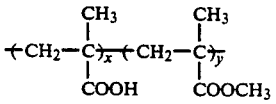
x/y = 10/90
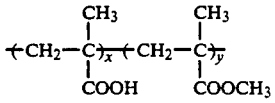
x/y = 40/60
B-3
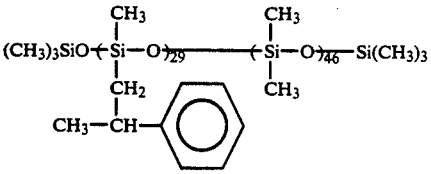
B-4
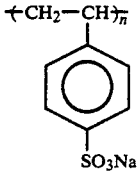
B-5
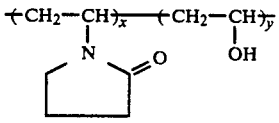
x/y = 70/30
B-6
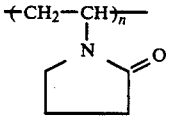
mol. wt. about 10,000
Dye D-1
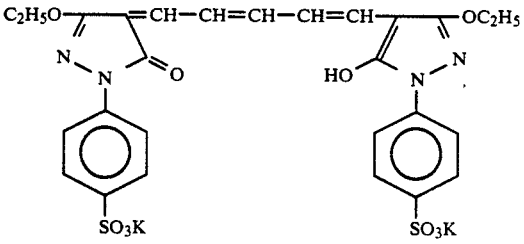
Dye D-2
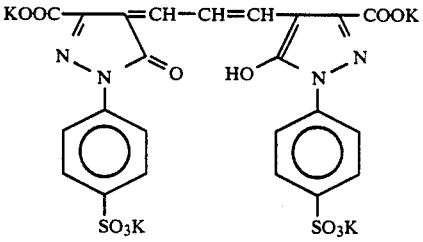
Dye D-3
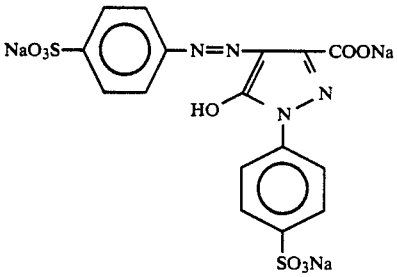
Dye D-4
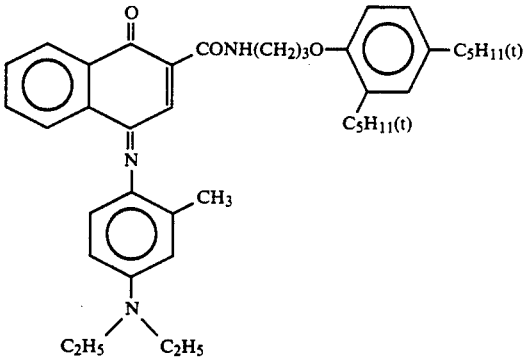
E-1
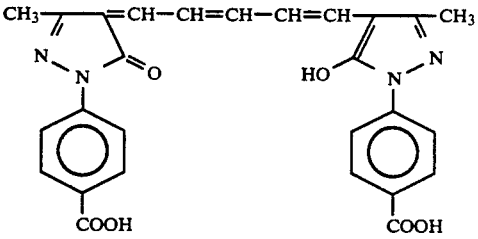
E-2
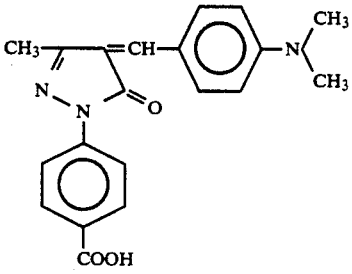
F-1
F-2

TABLE A-continued
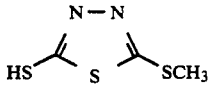
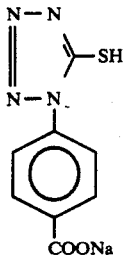
F-3
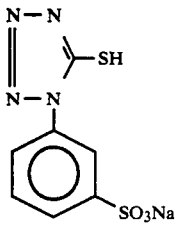
F-4
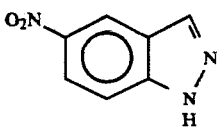
F-5
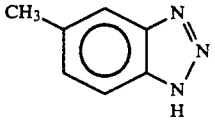
F-6
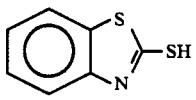
F-7
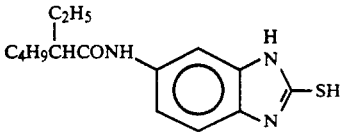
F-8
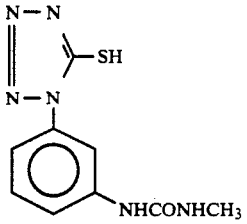
F-9
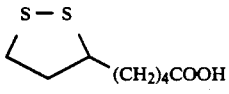
F-10
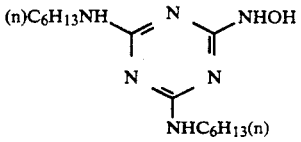
F-11
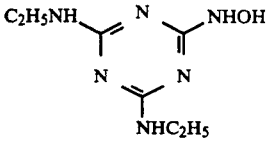
F-12
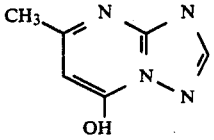
F-13
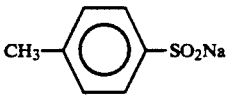
F-14
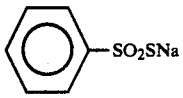
F-15
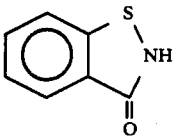
F-16
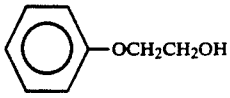
F-17
F-18

TABLE A-continued

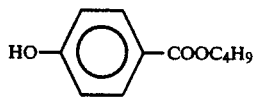

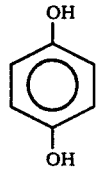

F-19

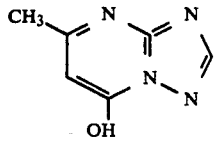

F-20

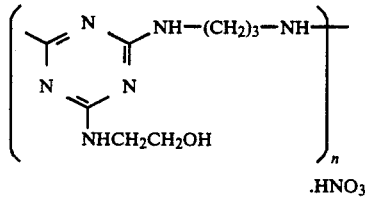

H-1

$CH_2{=}CH{-}SO_2{-}CH_2{-}CONH{-}CH_2$ $CH_2{=}CH{-}SO_2{-}CH_2{-}CONH{-}CH_2$

P-1

$\text{-}(CH_2{-}CH)_n\text{-}$ | $CONHC_4H_9(t)$

M-1

$\text{-}(CH_2{-}CH)_n\text{-}$ | $COOC_4H_9$

W-1

$C_8F_{17}SO_2NHCH_2CH_2CH_2OCH_2CH_2N^{\oplus}(CH_3)_3$

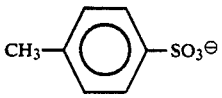

W-2

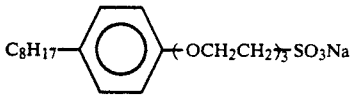

W-3

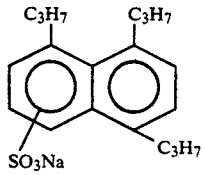

W-4

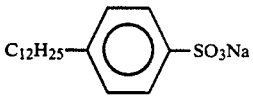

W-5

$C_8F_{17}SO_2N(C_3H_7)CH_2COOK$

W-6

$NaO_3S{-}CH(CH_2COOCH_2CH(C_2H_5)C_4H_9)COOCH_2CH(C_2H_5)C_4H_9$

W-7

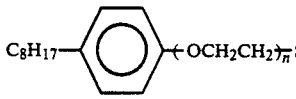

n = 2 to 4

W-8

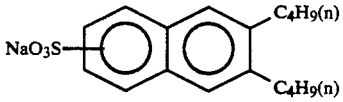

What is claimed is:

1. A silver halide photographic light-sensitive material having at least one silver halide emulsion layer formed on a support, said light-sensitive material having at least one layer which contains a regular silver halide emulsion spectrally sensitized with a methine compound represented by the following formula (I):

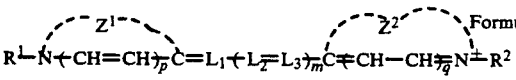

Formula (I)

where $R^1$ is $-(CH_2)_r-CONHSO_2-R^3$ or $-(CH_2)_s-(SO_2NHCO-R^4$, where $R^3$ and $R^4$ are an alkyl group, r and s are an integer ranging from 1 to 5; $R^2$ is a sulfoalkyl group; $Z^1$ and $Z^2$ are non-metal sulfur containing nuclei selected from the group consisting of thiazole, benzothiazole, napthothiazole and thiadiazole nuclei; p and q are 0 or 1; $L_1$, $L_2$ and $L_3$ are methine groups; and m is 0, 1 or 2.

2. The silver halide photographic light-sensitive material according to claim 1, wherein the size of grains contained in the regular silver halide emulsion has a relative standard deviation of 20% or less.

3. A silver halide photographic light-sensitive material having at least one silver halide emulsion layer formed on a support, said light-sensitive material having at least one layer which contains a tabular silver halide emulsion containing tabular silver halide grains having an average diameter/average thickness ratio of 2 or more, which occupy 50% or more of the total projected area of all silver halide grains, and said emulsion containing at least one methine compound represented by the following formula (I):

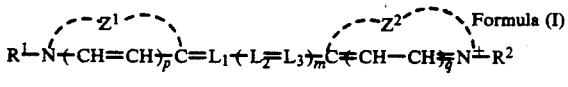

Formula (I)

where $R^1$ is $-(CH_2)_r-CONHSO_2-R^3$ or $-(CH_2)_s-SO_2NHCO-R^4$, where $R^3$ and $R^4$ are an alkyl group, r and s are an integer ranging from 1 to 5; $R^2$ is a sulfoalkyl group; $Z^1$ and $Z^2$ are non-metal sulfur containing nuclei selected from the group consisting of thiazole, benzothiazole, napthothiazole and thiadiazole nuclei; p and q are 0 or 1; $L_1$, $L_2$ and $L_3$ are methine groups; and m is 0, 1 or 2.

4. A silver halide photographic light-sensitive material having at least one silver halide emulsion layer formed on a support, said light-sensitive material having at least one layer which contains a silver halide emulsion containing internal latent-image silver halide grains each chemically sensitized to the depth of less than 0.02 μm from the surface of the grain, and having been spectrally sensitized with at least one methine compound represented by the following formula (I):

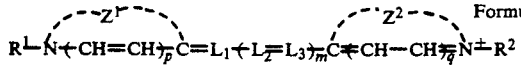

Formula (I)

where $R^1$ is $-(CH_2)_r-CONHSO_2-R^3$ or $-(CH_2)_s-SO_2NHCO-R^4$, where $R^3$ and $R^4$ are an alkyl group, r and s are an integer ranging from 1 to 5; $R^2$ is a sulfoalkyl group; $Z^1$ and $Z^2$ are non-metal sulfur containing nuclei selected from the group consisting of thiazole, benzothiazole, napthothiazole and thiadiazole nuclei; p and q are 0 or 1; $L_1$, $L_2$ and $L_3$ are methine groups; and m is 0, 1 or 2.

5. A silver halide photographic light-sensitive material having at least one silver halide emulsion layer formed on a support, said light-sensitive material having at least one layer which contains a silver halide emulsion spectrally sensitized with at least one methine compound represented by the following formula (I):

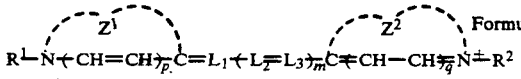

Formula (I)

where $R^1$ is $-(CH_2)_r-CONHSO_2-R^3$ or $-(CH_2)_s-SO_2NHCO-R^4$, where $R^3$ and $R^4$ are an alkyl group, r and s are an integer ranging from 1 to 5; $R^2$ is a sulfoalkyl group; $Z^1$ and $Z^2$ are non-metal sulfur containing nuclei selected from the group consisting of thiazole, benzothiazole, napthothiazole and thiadiazole nuclei; p and q are 0 or 1; $L_1$, $L_2$ and $L_3$ are methine groups; and m is 0, 1 or 2.

* * * * *